US011331550B1

(12) United States Patent
Showalter

(10) Patent No.: US 11,331,550 B1
(45) Date of Patent: May 17, 2022

(54) GAME SET AND METHOD FOR PLAYING THE SAME

(71) Applicant: Edward Showalter, Santa Monica, CA (US)

(72) Inventor: Edward Showalter, Santa Monica, CA (US)

( * ) Notice: Subject to any disclaimer, the term of this patent is extended or adjusted under 35 U.S.C. 154(b) by 0 days.

(21) Appl. No.: 17/390,773

(22) Filed: Jul. 30, 2021

Related U.S. Application Data

(60) Provisional application No. 63/170,397, filed on Apr. 2, 2021.

(51) Int. Cl.
*A63B 67/06* (2006.01)
*A63B 71/02* (2006.01)
*A63B 71/06* (2006.01)

(52) U.S. Cl.
CPC ..... *A63B 67/06* (2013.01); *A63B 71/023* (2013.01); *A63B 71/0605* (2013.01); *A63B 71/0622* (2013.01); *A63B 71/0669* (2013.01); *A63B 2071/024* (2013.01); *A63B 2071/026* (2013.01); *A63B 2071/0625* (2013.01); *A63B 2210/50* (2013.01); *A63B 2220/20* (2013.01); *A63B 2220/801* (2013.01); *A63B 2220/805* (2013.01); *A63B 2220/807* (2013.01); *A63B 2220/808* (2013.01); *A63B 2220/833* (2013.01); *A63B 2225/54* (2013.01); *A63B 2225/74* (2020.08); *A63B 2225/76* (2020.08)

(58) Field of Classification Search
CPC ..... A63B 71/0605; A63B 71/0622; A63B 71/0669
USPC ..... 273/372
See application file for complete search history.

(56) References Cited

U.S. PATENT DOCUMENTS 3,934,879 A * 1/1976 Curtiss ..... A63B 67/06 273/339
5,413,345 A * 5/1995 Nauck ..... A63B 24/0021 348/157
2003/0168811 A1* 9/2003 Gerson ..... F41J 5/056 273/372

(Continued)

FOREIGN PATENT DOCUMENTS

WO WO-2009005491 A1 * 1/2009 ..... A63B 24/0021

*Primary Examiner* — John E Simms, Jr.
*Assistant Examiner* — Rayshun K Peng
(74) *Attorney, Agent, or Firm* — CIONCA IP Law P.C.; Marin Cionca

(57) ABSTRACT

A game set having a flying disc, a goal mount, a target loop configured to attach to the goal mount, the target loop having a loop surface with a solid outer portion that surrounds an open middle portion, the open middle portion having at least one distinct opening, each distinct opening defining a scoring portal, and a score controller having at least one score sensor configured to detect the passage of the flying disk through each scoring portal, a vibration sensor configured to detect the target loop being impacted and wherein the score controller is configured to emit an alert when a sensor is triggered. The score controller may be further comprised of a viewing camera, microphone, game clock, scoreboard, distance verification device, loudspeaker, score buzzer, score indicator light, battery, and wireless transmitter. The score controller may communicate with a game application on a device, enabling "physical virtual" play.

52 Claims, 30 Drawing Sheets

(56) References Cited

U.S. PATENT DOCUMENTS

| | | | | |
|---|---|---|---|---|
| 2011/0250819 | A1* | 10/2011 | Tashman | A63H 33/18<br>446/46 |
| 2018/0093151 | A1* | 4/2018 | Burdan | A63B 71/0672 |
| 2021/0302132 | A1* | 9/2021 | Tsai | F41J 3/0009 |

* cited by examiner

FIG. 13A
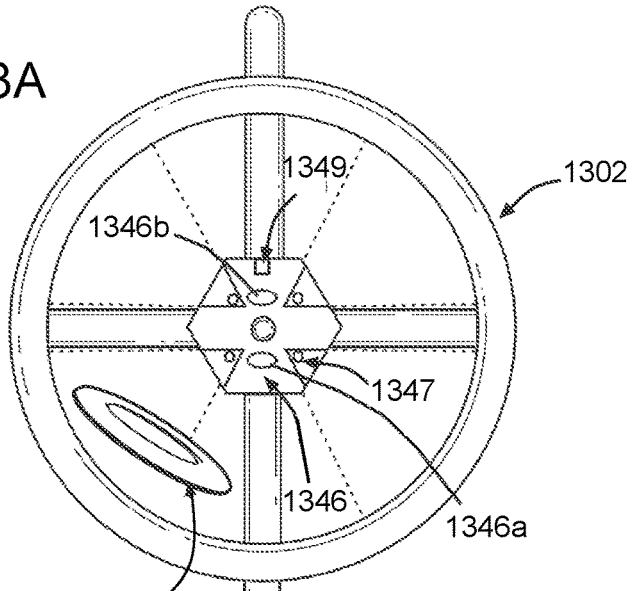
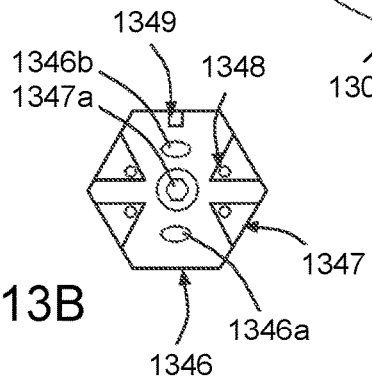
FIG. 13B
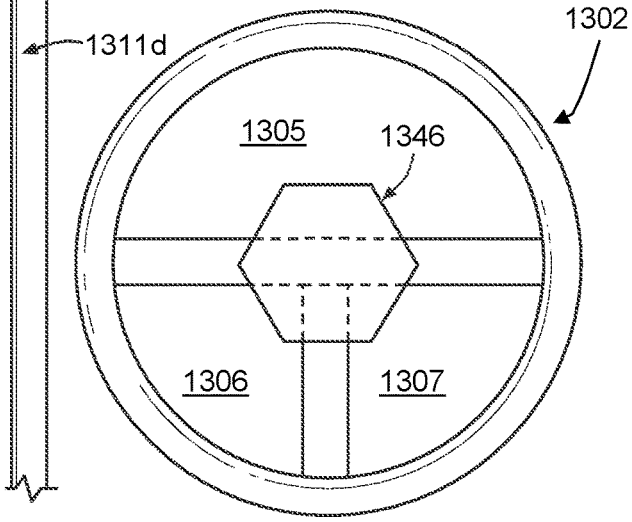
FIG. 13C

FIG. 19A
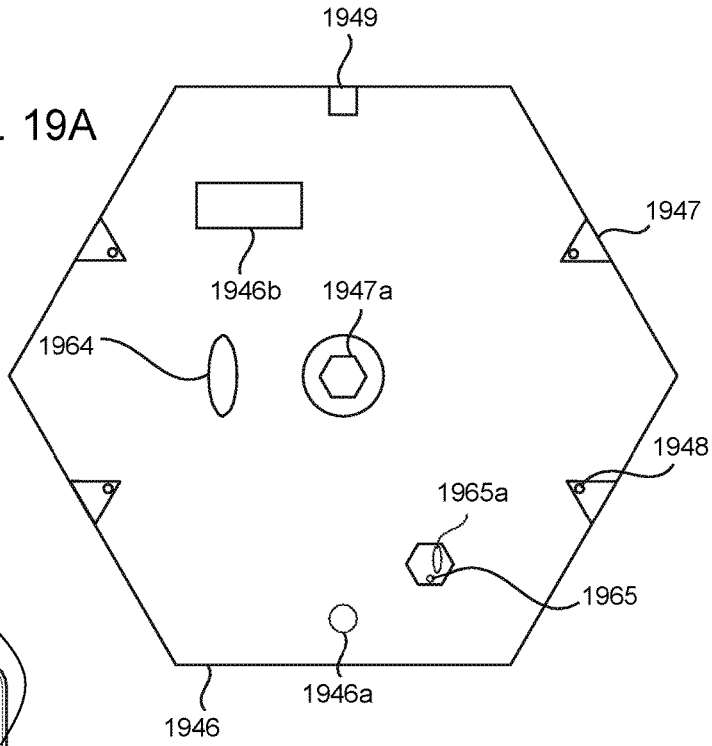
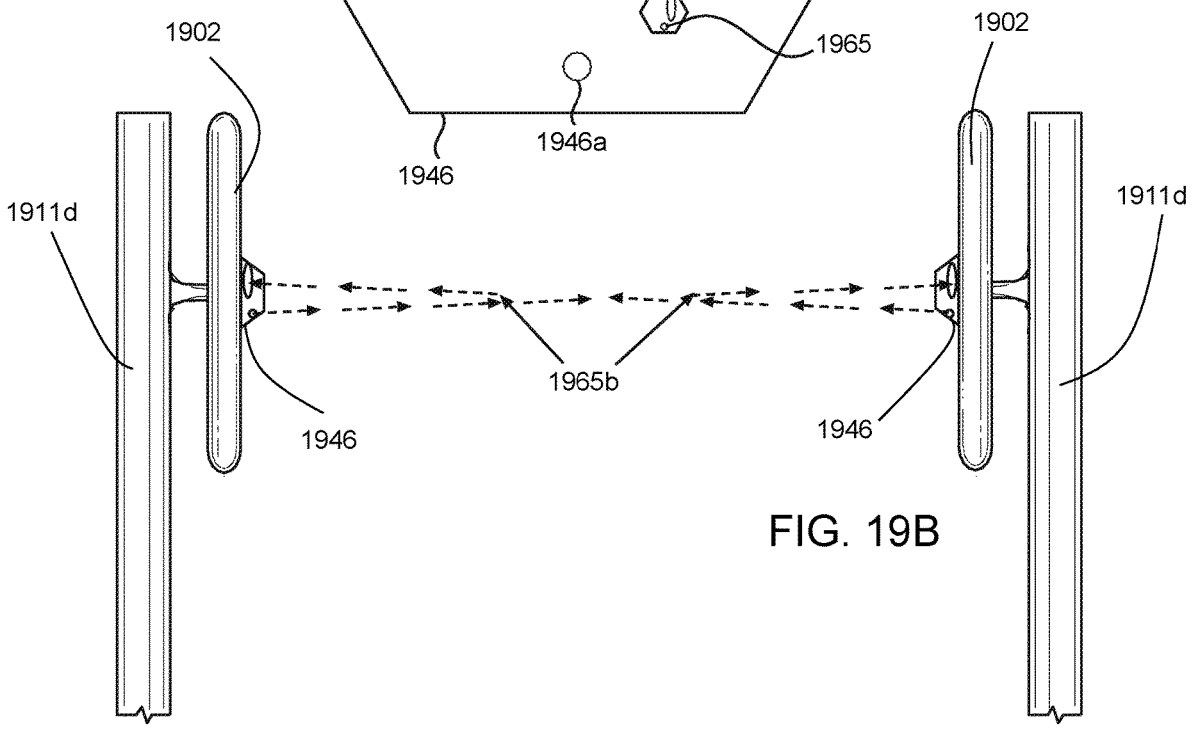
FIG. 19B

FIG. 21A
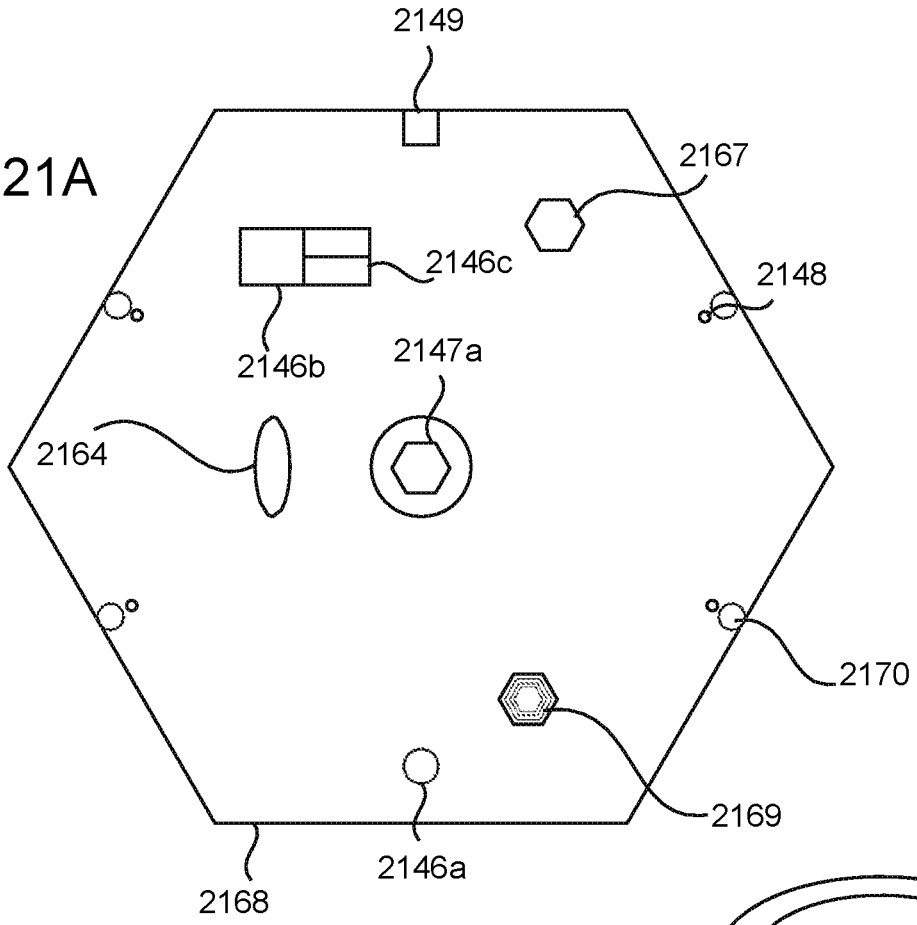
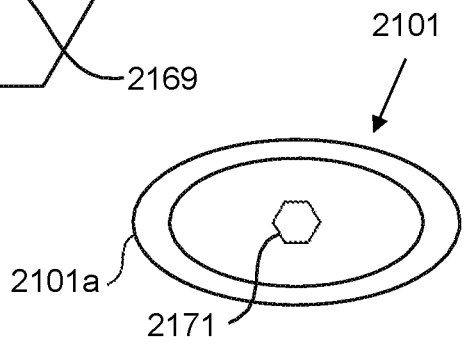
FIG. 21B

GAME SET AND METHOD FOR PLAYING THE SAME

CROSS-REFERENCE TO RELATED APPLICATIONS

This application claims the benefit of U.S. Provisional Application No. 63/170,397, filed Apr. 2, 2021, which is hereby incorporated by reference, to the extent that it is not conflicting with the present application.

BACKGROUND OF INVENTION

1. Field of the Invention

The invention relates generally to game sets and specifically to a game set designed for indoor or outdoor play during the day or night.

2. Description of the Related Art

Many games allow their players to test and improve their skills, such as hand-eye coordination, by providing a target that a player must throw an object at or through. While many players may find these games enjoyable, these games are not without their limitations that may affect both their appeal and feasibility. Some game sets provide a fixed size target, meaning the only way to change the difficulty of hitting the target is to play from further away. This may not be possible if the players only have a small play area. Many game sets lack the proper mechanisms to enable play in the dark, restricting play to daylight hours or well illuminated areas. The targets provided for these game sets may be exceptionally basic, and lack different methods to score points, potentially resulting in scoring being too easy or too hard. Additionally, many outdoor games sets do not provide any real-time feedback after a player scores points, nor any kind of scoring automation, potentially making it difficult to determine if a player scores on a distant goal or in low light conditions and tedious to manually keep track of each player's score. The lack wireless transmission devices in these game sets also prevents their utilization with peripheral electronic devices, such as smartphones, effectively preventing usage of these game sets for "physical virtual" play.

Therefore, there is a need to provide a game set that provides solutions to the shortcomings identified with the prior art.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a game set is provided, the game set comprising: a flying disc and a goal assembly, the goal assembly comprising: a goal mount having: a base end; a goal post connected to the base end; a plurality of target holders on the goal post; a target loop configured to attach to one of the plurality of target holders, the target loop comprising: a loop surface having a solid outer portion that surrounds an open middle portion, the open middle portion having at least one distinct opening, wherein each distinct opening within the open middle portion defines a scoring portal; a docking portion connected to the solid outer portion of the loop surface and configured to connect to one of the plurality of target holders; and a score controller configured to attach to the goal assembly, the score controller having: at least one score configured to detect the passage of the flying disk through each scoring portal; a vibration sensor, wherein the vibration sensor is configured to detect the target loop being impacted by the flying disc and wherein the score controller is configured to emit an alert when the score sensor or the vibration sensor is triggered. One advantage is that the target loop and flying disc may be made of a glow in the dark material, allowing this game set to be used to play during the day or the night and in the light or dark. Another advantage is that while playing at night, players will have the chance to test and improve their perception skills, such as hand-eye coordination and ability to judge distances, while in dark conditions, which may prove helpful to those who drive, exercise, or perform other activities at night. Another advantage is that the physical activity performed when throwing the flying disc may be used as a physical therapy that provides both range of motion and cardiovascular exercise. Another advantage is that when provided in a glow in the dark material, the target loop may appear to float in midair when illuminated during play in darkness, providing a unique spectacle that may act to further increase the challenge associate with throwing a flying disc through it. Another advantage is that the score controller may be used to help keep score through the provided alerts which may be important when playing in darkness or with distant goal assemblies. Another advantage is that the target loop may be provided in a variety of different sizes, shapes, and configurations, in order to alter the difficulty associated with throwing the flying disc through a scoring portal. Another advantage is that the docking portion may be configured to divide the existing scoring portal into a plurality of smaller scoring portals, in order to increase the challenge associated with scoring through each scoring portal. Another advantage is that the score controller may house various additional elements, including a viewing camera, distance verification device, time clock, wireless transmitter, scoreboard, loudspeaker and microphone, which may transmit recorded video, sound and other data to a game application on an electronic device, enabling live streaming of gameplay as well as competitive "physical virtual" game play with players around the world. Another advantage is that the score sensors may be provided as NFC or RFID tag readers that may be configured to enable automated score keeping when used in conjunction with a game application.

In another aspect, a game set is provided, the game set comprising: a flying disc and a goal assembly, the goal assembly comprising: a goal mount having: a base end; a goal post connected to the base end; a plurality of target holders on the goal post; a plurality of target loops, each target loop configured to attach to one of the plurality of target holders, each target loop comprising: a loop surface having a solid outer portion that surrounds an open middle portion, the open middle portion having at least one distinct opening, wherein each distinct opening within the open middle portion defines a scoring portal; a docking portion connected to the solid outer portion of the loop surface and configured to connect to a target holder of the plurality of target holders; and a plurality of score controllers, each score controller configured to attach to the goal assembly, each score controller having: at least one score sensor configured to detect the passage of the flying disk through each scoring portal; a vibration sensor, wherein the vibration sensor is configured to detect the target loop being impacted by the flying disc and wherein the score controller is configured to emit an alert when the score sensor or the vibration sensor is triggered. Again, an advantage is that the target loop and flying disc may be made of a glow in the dark material, allowing this game set to be used to play during the day or the night and in the light or dark. Another advantage is that while playing at night, players will have the chance to test and improve their perception skills, such as hand-eye coordination and ability to judge distances, while in dark conditions, which may prove helpful to those who drive, exercise, or perform other activities at night. Another advantage is that the physical activity performed when throwing the flying disc may be used as a physical therapy that provides both range of motion and cardiovascular exercise. Another advantage is that when provided in a glow in the dark material, the target loop may appear to float in midair when illuminated during play in darkness, providing a unique spectacle that may act to further increase the challenge associate with throwing a flying disc through it. Another advantage is that the score controller may be used to help keep score through the provided alerts, which may be important when playing in darkness or with distant goal assemblies. Another advantage is that the target loop may be provided in a variety of different sizes, shapes, and configurations, in order to alter the difficulty associated with throwing the flying disc through a scoring portal. Another advantage is that the docking portion may be configured to divide the existing scoring portal into a plurality of smaller scoring portals, in order to increase the challenge associated with scoring through each scoring portal. Another advantage is that the score controller may house various additional elements, including a viewing camera, distance verification device, time clock, wireless transmitter, scoreboard, loudspeaker and microphone, which may transmit recorded video, audio and other data to a game application on an electronic device, enabling live streaming of gameplay as well as competitive "physical virtual" game play with players around the world. Another advantage is that the score sensors may be provided as NFC or RFID tag readers that may be configured to enable automated score keeping when used in conjunction with a game application.

In another aspect, a game set is provided, the game set comprising: a propellable object; and a target loop, the target loop comprising: a loop surface having a solid outer portion that surrounds an open middle portion, the open middle portion having at least one distinct opening, wherein each distinct opening within the open middle portion defines a scoring portal and a docking portion connected to the solid outer portion of the loop surface. Another advantage is that the target loop and propellable object may be made of a glow in the dark material, allowing this game set to be used to play during the day or the night and in the light or dark. Another advantage is that the docking portion may be configured to divide the existing scoring portal into a plurality of smaller scoring portals, in order to increase the challenge associated with scoring through each scoring portal. Another advantage is that the target loop may be attached to unique types of goal mounts, such as a game board, and be adapted for use with different types of propellable objects, such as bean bags, soccer balls, footballs, baseballs and hockey pucks.

In another aspect, a method of providing a multiple goal assembly course is provided, comprising the steps of: providing a play space; providing a plurality of goal assemblies in the play space wherein each goal assembly has a goal mount, a target loop attached to the goal mount and a score controller attached to the goal assembly, wherein the target loop has at least one scoring portal and the score controller has a vibration sensor and at least one score sensor configured to detect the passage of a propellable object through each scoring portal; and allowing players to access the play space and use the plurality of goal assemblies. One advantage is that a multiple goal assembly course may be provided by a tournament organizer or course proprietor to be used by players in a play location, allowing players to enjoy a multiple goal assembly course without requiring them to purchase all the provided equipment. Another advantage is that a platform may be provided to allow players to schedule their usage of said course, either through usage of a game application or a scheduling website. Another advantage is that the platform may be configured to accept payment for use of said course, simplifying the player's experience. Another advantage is that players of the course may be provided with play rules that either enhance the play experience or enable certain features, such as automatic score keeping.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which:

FIG. 13A illustrates the front view of a target loop 1302 with an attached score controller 1346, according to an aspect.

FIG. 13B illustrates the front view a score controller, according to an aspect.

FIG. 13C illustrates the front view of a target loop with a simplified attached score controller, according to an aspect.

FIG. 19A illustrates the front view of a score controller, according to an aspect.

FIG. 19B illustrates the side view of two score controllers electronically interfacing, according to an aspect.

FIG. 21A illustrates the front view of a score controller having four electronic tag readers, a viewing camera, a time clock, a scoreboard, a microphone, a speaker, and various additional elements, according to an aspect.

FIG. 21B illustrates the top perspective view of a flying disc having an attached electronic tag, according to an aspect.

DETAILED DESCRIPTION

Figures 1A, 1B, 1C, 1D:
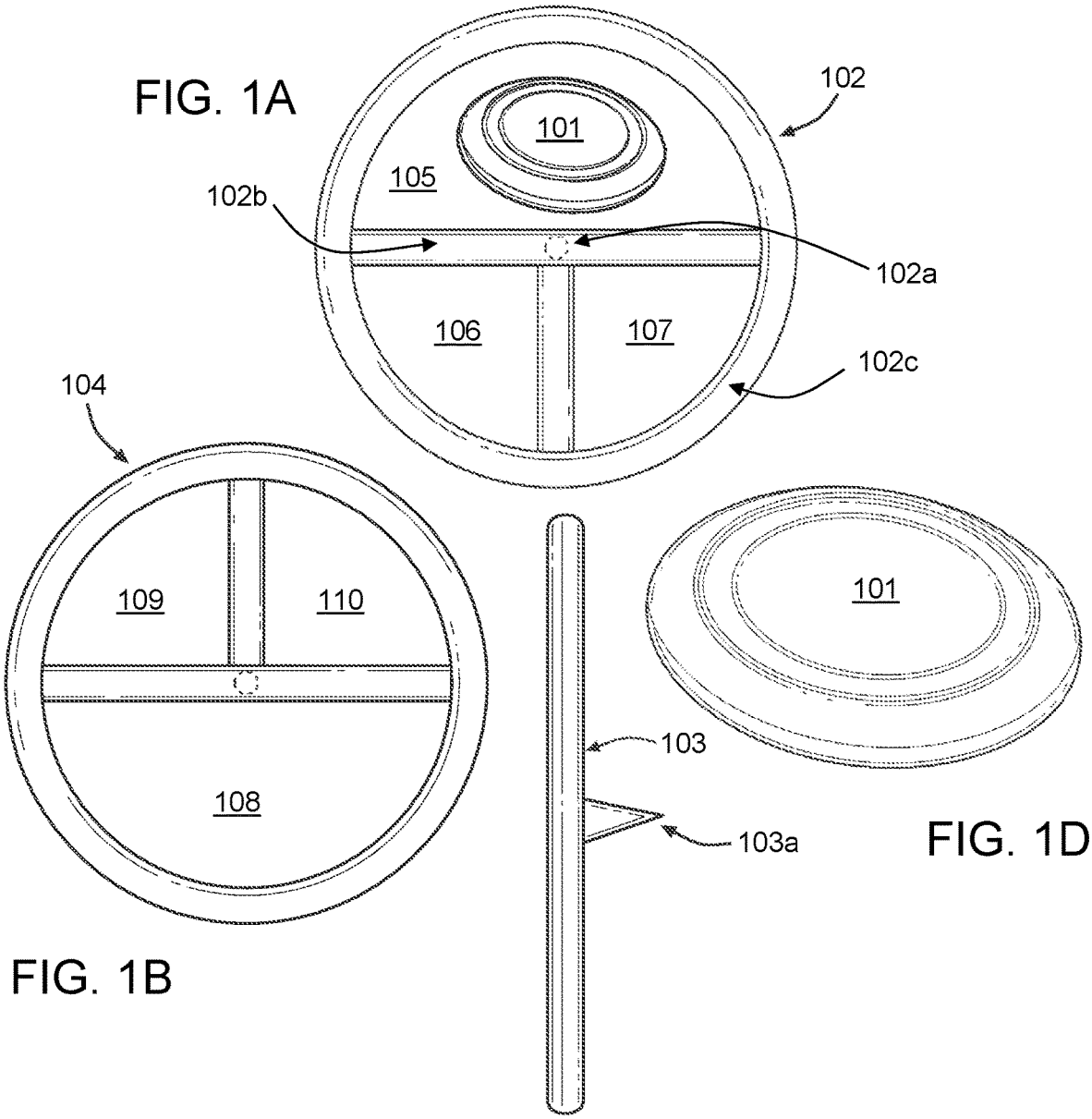
FIG. 1A illustrates the front view of a flying disc traveling through a target portal in a target loop, according to an aspect.
FIG. 1B illustrates the front view of a target loop in an alternate orientation, according to an aspect.
FIG. 1C illustrates the side view of a target loop, according to an aspect.
FIG. 1D illustrates the top perspective view of a flying disc, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

As used herein and throughout this disclosure, the term "mobile device" refers to any electronic device capable of communicating across a mobile network. A mobile device may have a processor, a memory, a transceiver, an input, and an output. Examples of such devices include cellular telephones, portable computers, etc. A transceiver includes but is not limited to cellular, GPRS, Bluetooth, and Wi-Fi transceivers.

Mobile devices communicate with each other and with other elements via a network, for instance, a cellular network. A "network" can include broadband wide-area networks, local-area networks, and personal area networks. Communication across a network can be packet-based or use radio and frequency/amplitude modulations using appropriate analog-digital-analog converters and other elements. Examples of radio networks include Wi-Fi and BLUETOOTH® networks, with communication being enabled by transceivers. A network typically includes a plurality of elements such as servers that host logic for performing tasks on the network. Servers may be placed at several logical points on the network. Servers may further be in communication with databases and can enable communication devices to access the contents of a database. For instance, an authentication server hosts or is in communication with a database having authentication information for users of a mobile network. A "user account" may include several attributes for a particular user, including a unique identifier of the mobile device(s) owned by the user, relationships with other users, call data records, bank account information, etc. A billing server may host a user account for the user to which value is added or removed based on the user's usage of services. One of these services includes mobile payment. In exemplary mobile payment systems, a user account hosted at a billing server is debited or credited based upon transactions performed by a user using their mobile device as a payment method.

For the following description, it can be assumed that most correspondingly labeled elements across the figures (e.g., 105 and 205, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1A illustrates the front view of a flying disc 101 traveling through a target portal 105 in a target loop 102, according to an aspect. FIG. 1B illustrates the front view of a target loop 104 in an alternate orientation, according to an aspect. FIG. 1C illustrates the side view of a target loop 103, according to an aspect. FIG. 1D illustrates the top perspective view of a flying disc 101, according to an aspect. For the herein disclosed game, a game set that is used for play may be comprised of a flying disc 101, a goal mount, a target loop 102 attached to the goal mount and a score controller attached to the target loop, wherein the combination of the goal mount, target loop 102 and a score controller may be referred to as a goal assembly. Alternatively, the combination of a goal mount and a target loop may also be referred to as a goal assembly. The target loop 102 may be comprised of a loop surface 102*c* having a solid outer portion that surrounds an open middle portion, the open middle portion having at least one distinct opening, wherein each distinct opening within the open middle portion defines a scoring portal and a docking portion connected to the solid outer portion of the loop surface and configured to connect to one of the plurality of target holders. The docking surface may be comprised of a docking mount 102*b* attached to the solid outer portion of the loop surface 102*c* and a docking rod 102*a* attached to docking mount 102*b*. The loop surface 102*c* may have a circular, solid outer portion composed of a glow in the dark material surrounding an open circular center portion. The docking mount 102*b* may connect to the target loop 102 from within the middle of its open center portion and divide the singular scoring portal into a plurality of smaller scoring portals. The loop surface 102*c*, docking mount 102*b* and docking rod 102*a*, may be attached to each other accordingly using clips, clasps, or an adhesive material, be provided as a singular unified piece, as with manufacturing through injection molding, or be otherwise combined through known methods in the field. The scoring portals 105, 106 and 107 may be formed as a result of divisions made by docking mount 102*b* or potentially other elements, such as a goal post. As can be seen in target portal 102, the docking mount 102*b* may be comprised of two legs, one leg that bisects the scoring portal into two half sized scoring portals and one leg that further bisects one of the half sized scoring portals into two quarter sized scoring portals. As a result, target portal 102 may have three scoring portals; one half sized target portal 105 and two quarter sized scoring portals 106 and 107. The docking mount 102*b* may be made a glow in the dark material. The docking rod 102*a* may be attached to the docking mount and be positioned coaxially with the loop surface 102*c*. The docking rod 102*a* may be configured to be securely inserted into a target port on a goal mount or, conversely, may be present on the goal mount itself and configured to be securely inserted into a central port on the target loop. The docking rod 102*a* may be cone shaped to enable a friction-based connection with a corresponding target port but may also exist in a variety of shapes and forms as needed. Additional features, such as friction clips or friction bumps, may be provided on the docking rod or within an attached target port in order to further secure the target loop and an attached goal mount together.

Target loop 102 may be rotated in order to change the positioning of its scoring portals. The physical structure of target loop 102 and target loop 104 may be the same, but the positioning of their respective scoring portals is different, due to the difference in their orientations. As such, it can be seen that target portal 105 corresponds to target portal 108, target portal 106 corresponds to target portal 110 and target portal 107 corresponds to target portal 109. Each corresponding target portal pair represents the equivalent target portals on differently oriented target loops. Target loop 103 may also be seen as having the same physical structure as the two aforementioned target loops but is displayed from a side view to better display its docking rod 103*a*. The orientation of a target loop 102 may affect the difficulty associated with throwing an object through a particular scoring portal. Additionally, the herein disclosed game may be played in the dark, potentially adding to the difficulty of throwing a flying disc 101 through one of the scoring portals. In order to enable play in the dark, significant scoring elements, such as the loop surface 102*c* and loop mount 102*b* may need to be made of a glow in the dark material, and properly phosphoresced in order to maintain their visibility. By having a glow in the dark target loop 102 attached to a goal mount that does not glow in the dark, the target loop 102 may have the appearance of floating in the air while glowing in darkness. The material used to construct the target loop 102 and flying disc 101 may be a plant-based bioplastic which may be inherently biodegradable and renewable. This bioplastic may also have inherent phosphorescent properties that provide a glow in the dark quality to these components. Constructing the target loop 102 and flying disc 101 out of a glow in the dark material may not be essential for play during the daytime and/or in well-lit play areas. Though the target loop 102 depicted within FIG. 1 may have three scoring portals, the size and quantity of each scoring portal may be modified through various methods and will be described in greater detail hereinafter.

Figure 2A:
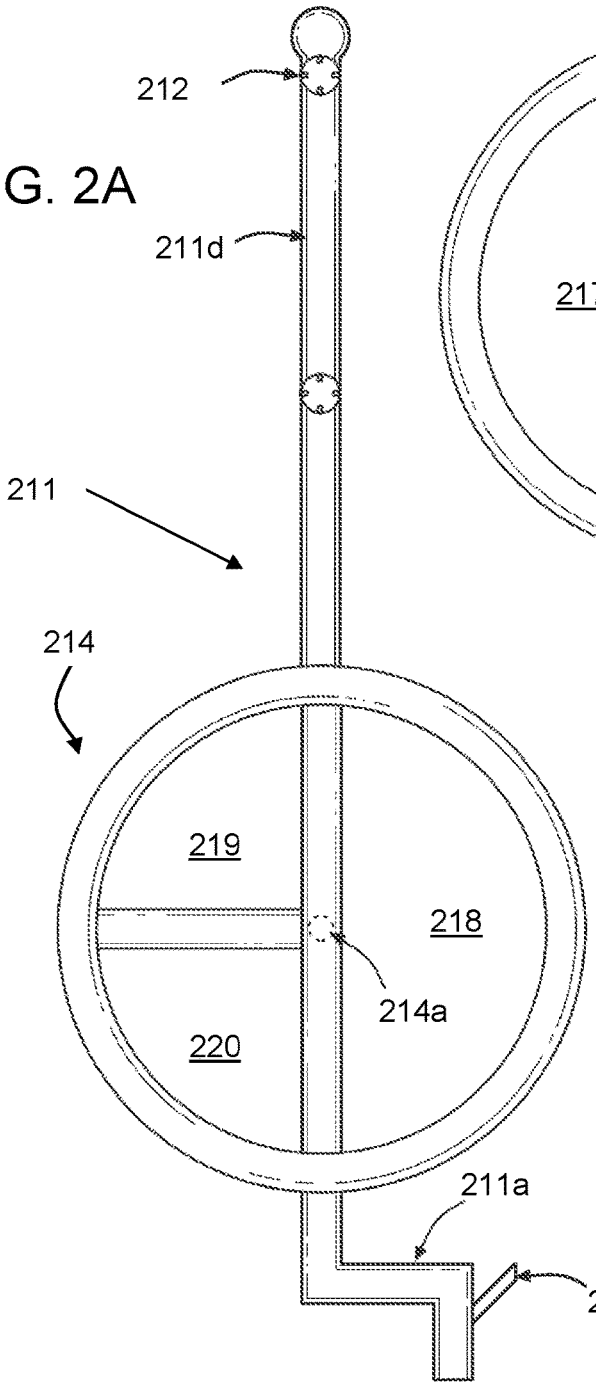
FIG. 2A illustrates the front view of a goal mount having a target loop secured in a low height target port, according to an aspect.
Figure 2B:
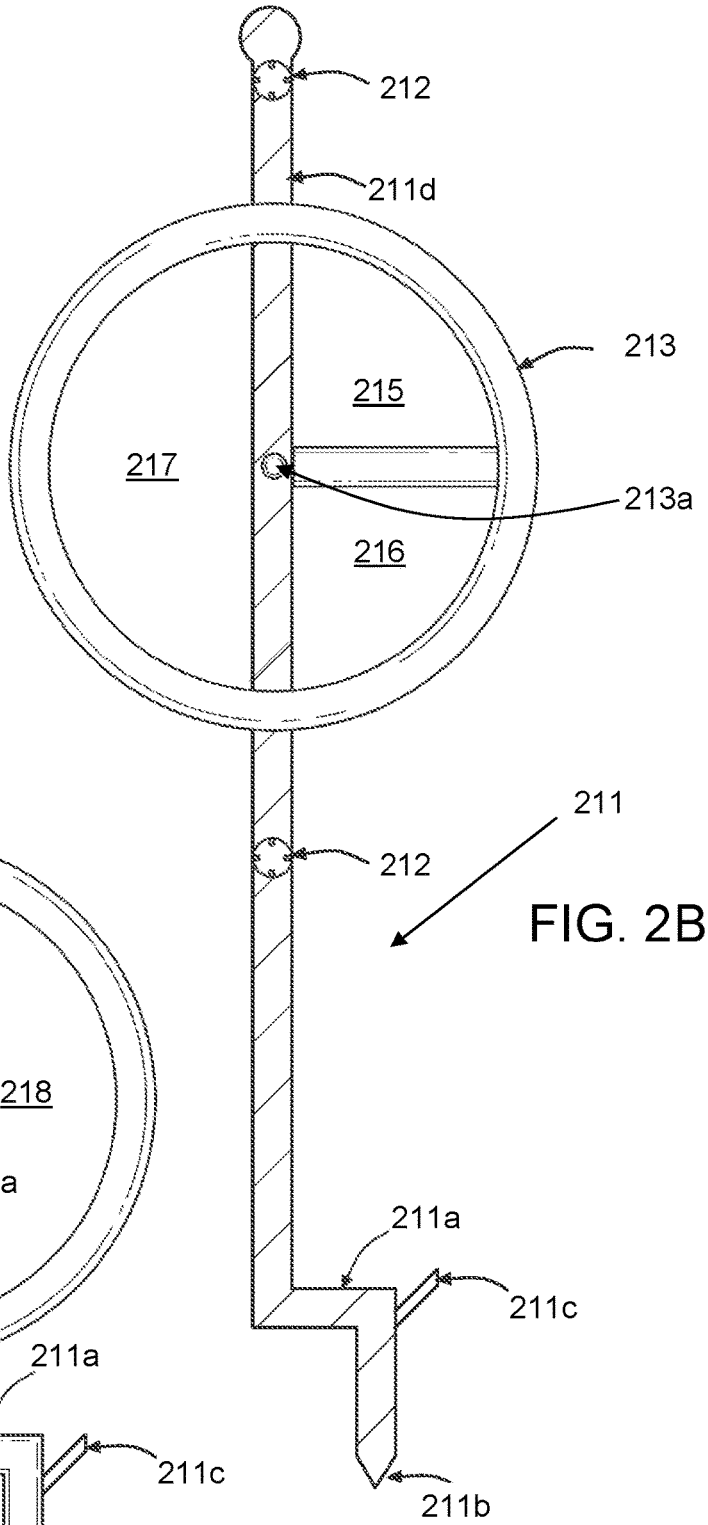
FIG. 2B illustrates the front view of a goal mount having a target loop secured in an intermediate height target port, according to an aspect.

FIG. 2A illustrates the front view of a goal mount 211 having a target loop 214 secured in a low height target port 212, according to an aspect. FIG. 2B illustrates the front view of a goal mount 211 having a target loop 213 secured in an intermediate height target port 212, according to an aspect. A goal mount 211 may be used as the mounting surface for a target loop for herein disclosed game. A goal mount 211 may be comprised of a base end 211*b*, a weight mount 211*c* attached to the base end 211*b*, a horizontal mount section 211*a* attached to the base end, and a goal post 211*d* attached to the horizontal mount section 211*a*. The goal post 211*d* may have a plurality of target ports 212 along its height. The base end 212*b*, may be a spike, and the spike may be anchored into an external surface, such as dirt or sand, through application of a downward force to the horizontal mount section 211*a*. The weight mount 211*c* may be used to hold a counterbalance or base weight, such as a water weight, in applications where it is necessary.

A target loop 213 may be attached to goal mount 211 by a target port 212 on a goal post 211*d*. The target ports 212 may be positioned at different heights on the goal post 211*d*, allowing target loops to be attached to the goal mounts 211 at different heights. The target ports 212 may contain small teeth or ridges, which may help to more securely attach a target loop 213 to the goal post 211*d*, as well as prevent unwanted rotation of the target loop 213 during use. Target loop 214 is attached to a goal post 211*d* by a low height target port 212, while target loop 213 is attached to a goal post 211*d* by an intermediate height target port 212. The difference in height between these two target loops 213 and 214 may affect the difficulty associated with throwing an object through their respective scoring portals. As can be seen in the goal mount 211 assembly of target loop 213, the post 211*d* may be hidden behind its docking mount 213*b*, such that the presence of a vertical element behind the target loop 213 does not further divide its three formed target portals 215, 216 and 217. Target loops 213 and 214 also share the same physical structure as target loop 102, albeit at different rotational orientations. The goal mount 211 may be constructed of a suitable material, such as plastic or metal, and may be the same material as the target loop 213 or flying disc.

Figure 3A:
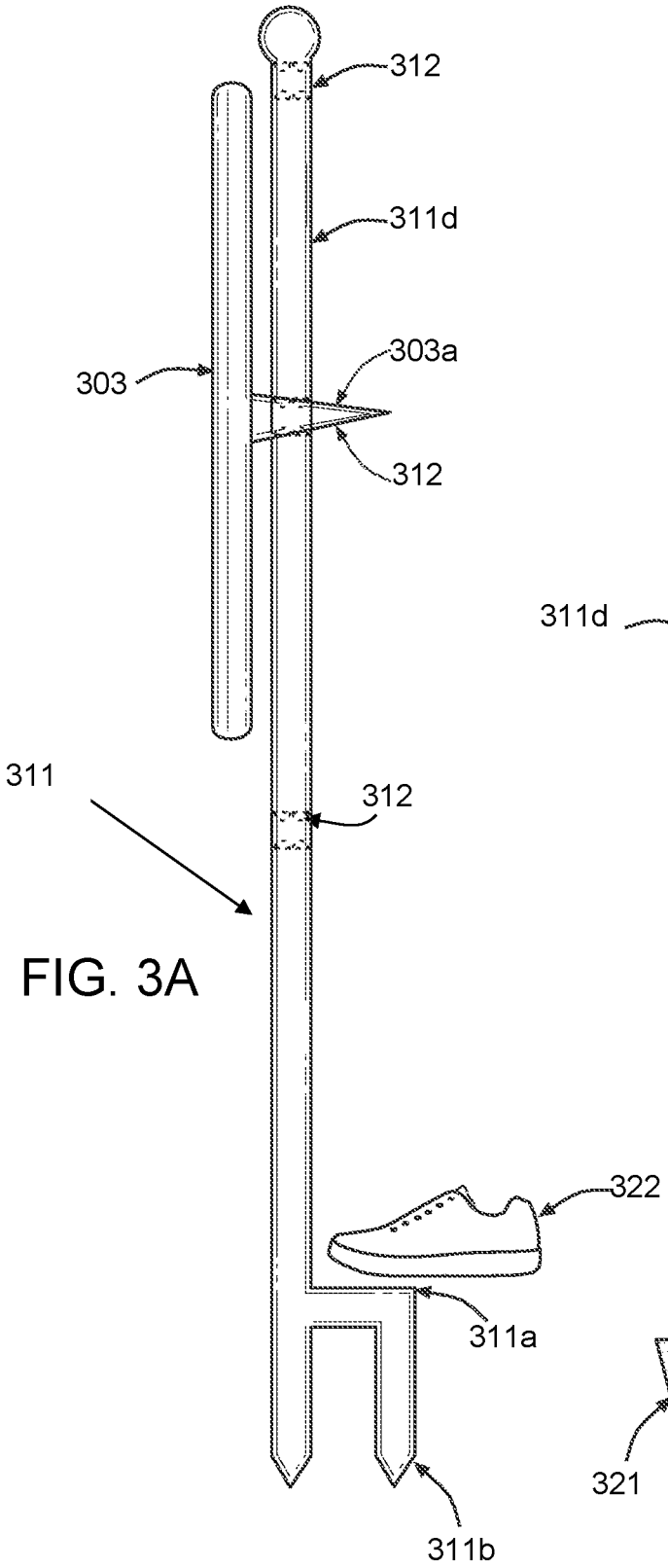
FIG. 3A illustrates the side view of a goal mount having two base ends, according to an aspect.
Figure 3B:
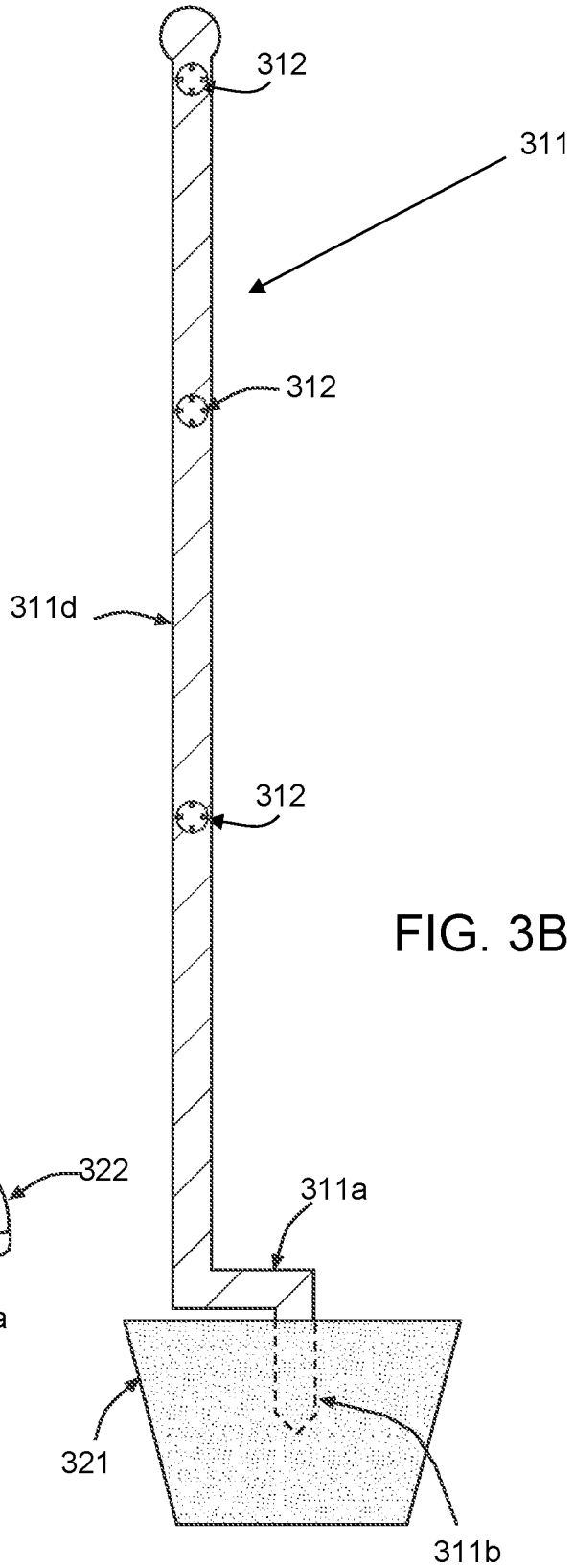
FIG. 3B illustrates the front view of a goal mount having a base end anchored in a base foundation, according to an aspect.

FIG. 3A illustrates the side view of a goal mount 311 having two base ends 311*b*, according to an aspect. FIG. 3B illustrates the front view of a goal mount 311 having a base end 311*b* anchored in a base foundation 321, according to an aspect. One may choose to vary the stabilization method of the base end 311*b* as needed, based on the application and environment. In some instances, in which the goal mount 311 may need to be anchored into a soft surface, such as dirt or sand, a spike may be used as a base end 311*b*. An additional base end 311*b* in the form of a second spike attached to the horizontal mount section 311*a* may be implemented in order to further secure the goal mount 311. As discussed hereinabove, the goal mount 311 may be secured through application of a downward force on the horizontal mount section 311*a* to push the base end 312*b* spikes in the external surface. This force may be applied to the horizontal mount section 311*a* by having a user step down on it with a shoe 322. An additional stabilization method may involve the securing of a base end 311*b* within a base foundation 321 to act as a stand unit. The base foundation 321 may be implemented in a variety of shapes and forms but must have a proper shape and sufficient weight to stabilize the attached goal post 311*d* and target loop 303, as well as securely hold the base end 311*b*.

Figure 4A:
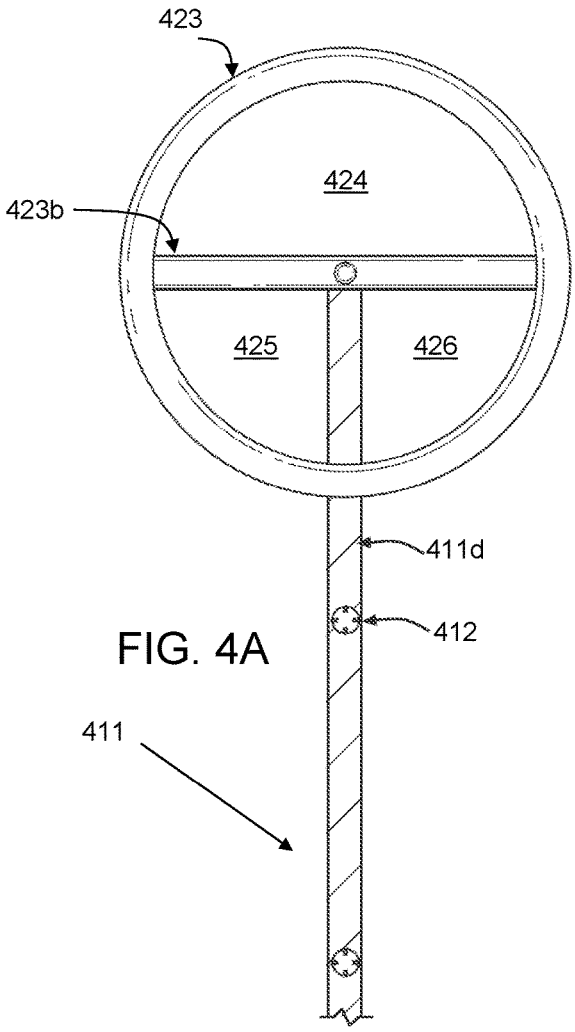
FIG. 4A illustrates the front view of a target loop attached to a top target port of a goal post, according to an aspect.
Figure 4B:
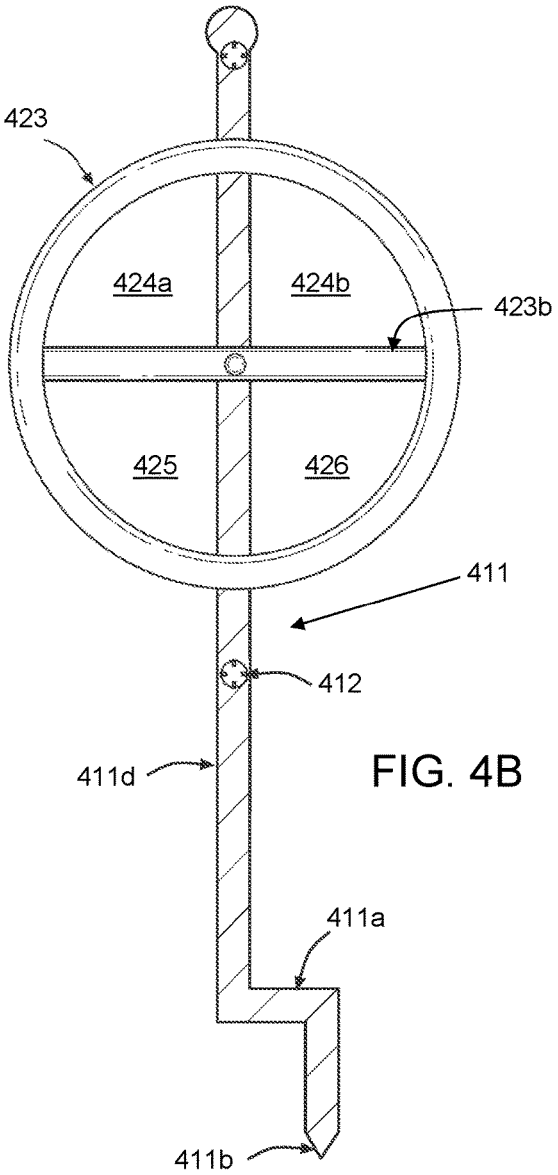
FIG. 4B illustrates the front view of a target loop attached to an intermediate height target port of a goal post, according to an aspect.

FIG. 4A illustrates the front view of a target loop 423 attached to a top target port 412 of a goal post 411*d*, according to an aspect. FIG. 4B illustrates the front view of a target loop 423 attached to an intermediate height target port 412 of a goal post 411*d*, according to an aspect. Target loop 423 differs from the previously described target loops, having a port mount 423*b* that bisects the target loop into two half sized scoring portals. Attachment of the target loop 423 to different target ports 412 located within the goal post 411*d* may result in the formation of different scoring portals, based on the target loop 423 orientation. Attaching the target loop 423 to a target port 412 located at the top of the goal post 411*d*, while orienting the port mount 432*b* such that it runs horizontally (perpendicular to the goal post 411*d*), will result in the formation of one half sized scoring portal 424 and two quarter sized scoring portals 425 and 426. This positioning results with target loop 423 having a scoring portal arrangement similar to that of target loop 102, despite the difference in their port mounts, through utilization of the goal post 411*d* to bisect one of the two half sized scoring portals formed in target loop 423.

The goal post 411*d* may also be used to divide the other half sized scoring portal of the target loop 423 through proper positioning of the target loop 423. If the target loop 423 was attached to a target port 412 positioned in the middle of the goal post 411*d* while maintaining the horizontal positioning of the port mount, the resulting goal assembly would have four quarter sized scoring portals, 424*a*, 424*b*, 425 and 426. Additional sizes and quantities of scoring portals may be formed as a result of varying the shape of the port mount 423*b*, the target port 412 that the target loop 423 is attached to and the orientation of the target loop 423. In order to properly illuminate the scoring portals formed in the target loop by the goal post 411*d* during usage in the dark, certain portions of the goal post 411*d* may also need to be made of or coated in a glow in the dark material, otherwise potential obstructions may not be visible to players.

Figures 5A, 5B, 5C:
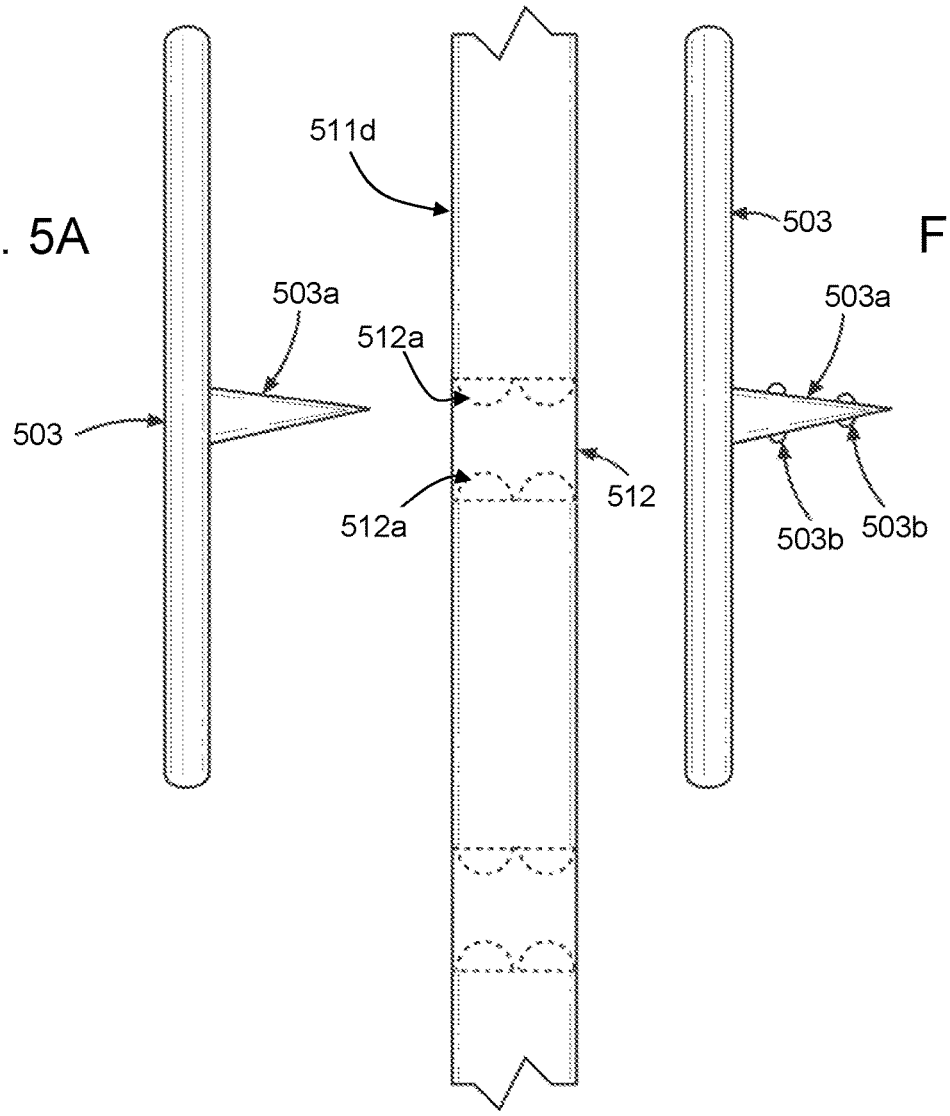
FIG. 5A illustrates the side view of a target loop, according to an aspect.
FIG. 5B illustrates the side view of a goal post adapted with friction bumps in its target ports, according to an aspect.
FIG. 5C illustrates the side view of a target loop adapted with friction bumps, according to an aspect.

FIG. 5A illustrates the side view of a target loop 503, according to an aspect. FIG. 5B illustrates the side view of a goal post 511*d* adapted with friction bumps 512*a* in its target ports 512, according to an aspect. FIG. 5C illustrates the side view of a target loop 503 adapted with friction bumps 503*b*, according to an aspect. In order to better secure a target loop 503 to a target port 512 on the goal post 511*d*, rod friction bumps 503*b* on the docking rod 503*a* and port friction bump 512*a* in the target port 512 may be implemented. Rod friction bumps 503*b* on the docking rod 503*a* may be interlocked securely with port friction bumps 512*a* in a target port 512 to reduce the likelihood of the target loop from being knocked off of the goal post 511*d* from an impact on the target loop. The utilization of this securing method may prove beneficial in cases in which heavy and repeated impacts to the target loop are expected.

Figure 6:
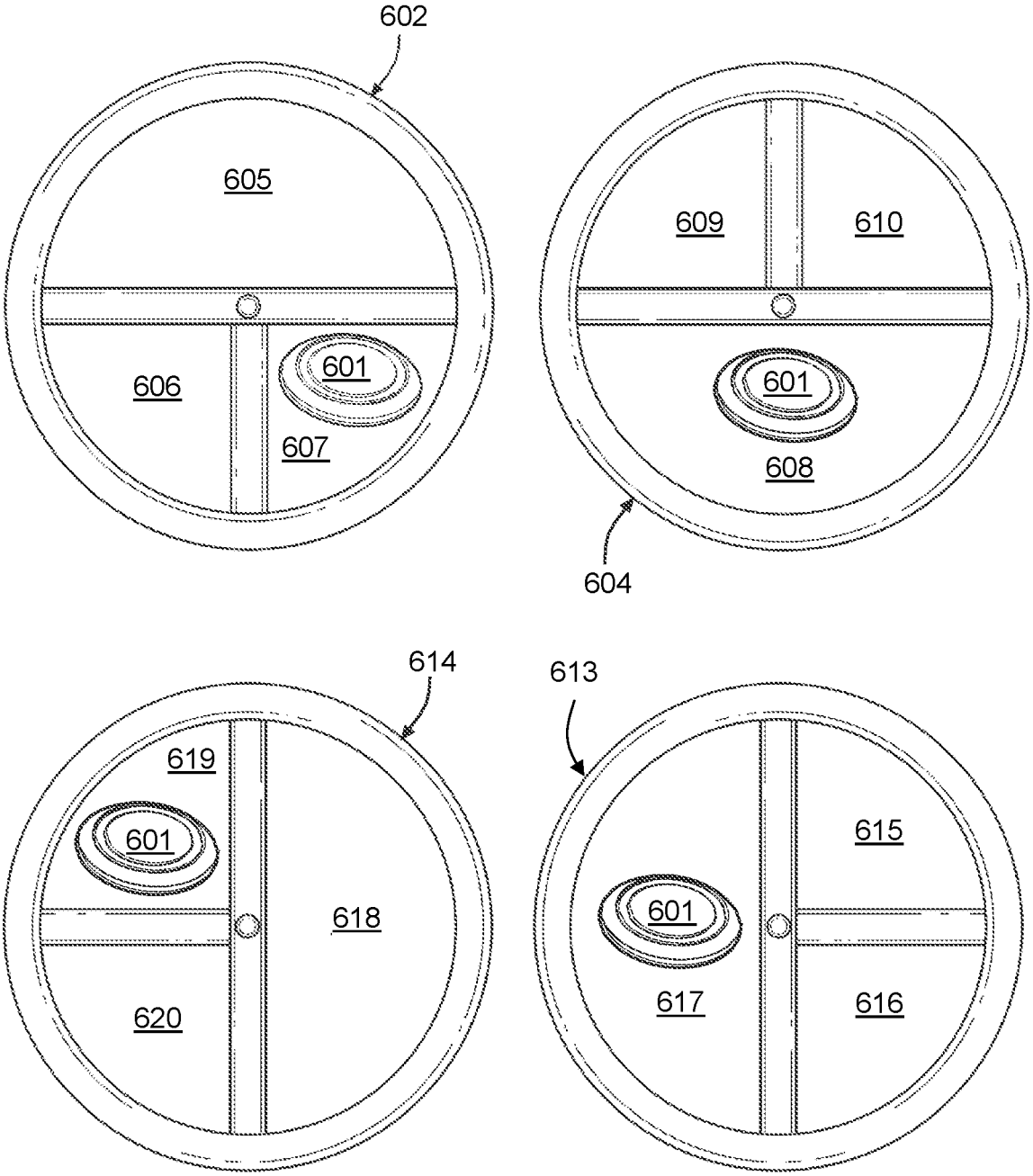
FIG. 6 illustrates the front view of four flying discs, each disc flying through a different target loop, and each target loop having a different orientation, according to an aspect.

FIG. 6 illustrates the front view of four flying discs 601, each disc flying through a different target loop, and each target loop having a different orientation, according to an aspect. One of the features of the herein disclosed goal is the ability of a user to rotate the attached target loop at will. The target loops 602, 604, 613 and 614 may all represent different potential rotations of the same target loop, having two quarter sized scoring portals and one half sized scoring portal. The specific orientation of the three scoring portals may be adjusted through simple rotation of the target loop prior to installation on a goal post. Using the target loop orientations 602 or 604 with a vertical scoring pole may result in the formation of four quarter sized scoring portals as a result of the scoring pole running behind the two half sized scoring portal, effectively bisecting each into two quarter sized scoring portals. The half sized portal of target loops 602 and 604 may be maintained by positioning the target loop on a terminal end of the goal post and having the goal post between the two quarter sized scoring portals, effectively covering it with part of the docking mount. Both target loop orientations depicted in 613 and 614 may leave the half sized scoring portal intact when using a vertical goal post, as a result of the goal post running along one of half sized scoring portal's edges, rather than down its middle. Alternative target loop orientations may also be possible that result in different quantities of different sized scoring portals, such as by rotating any depicted target loop orientation by 45 degrees.

Figure 7:
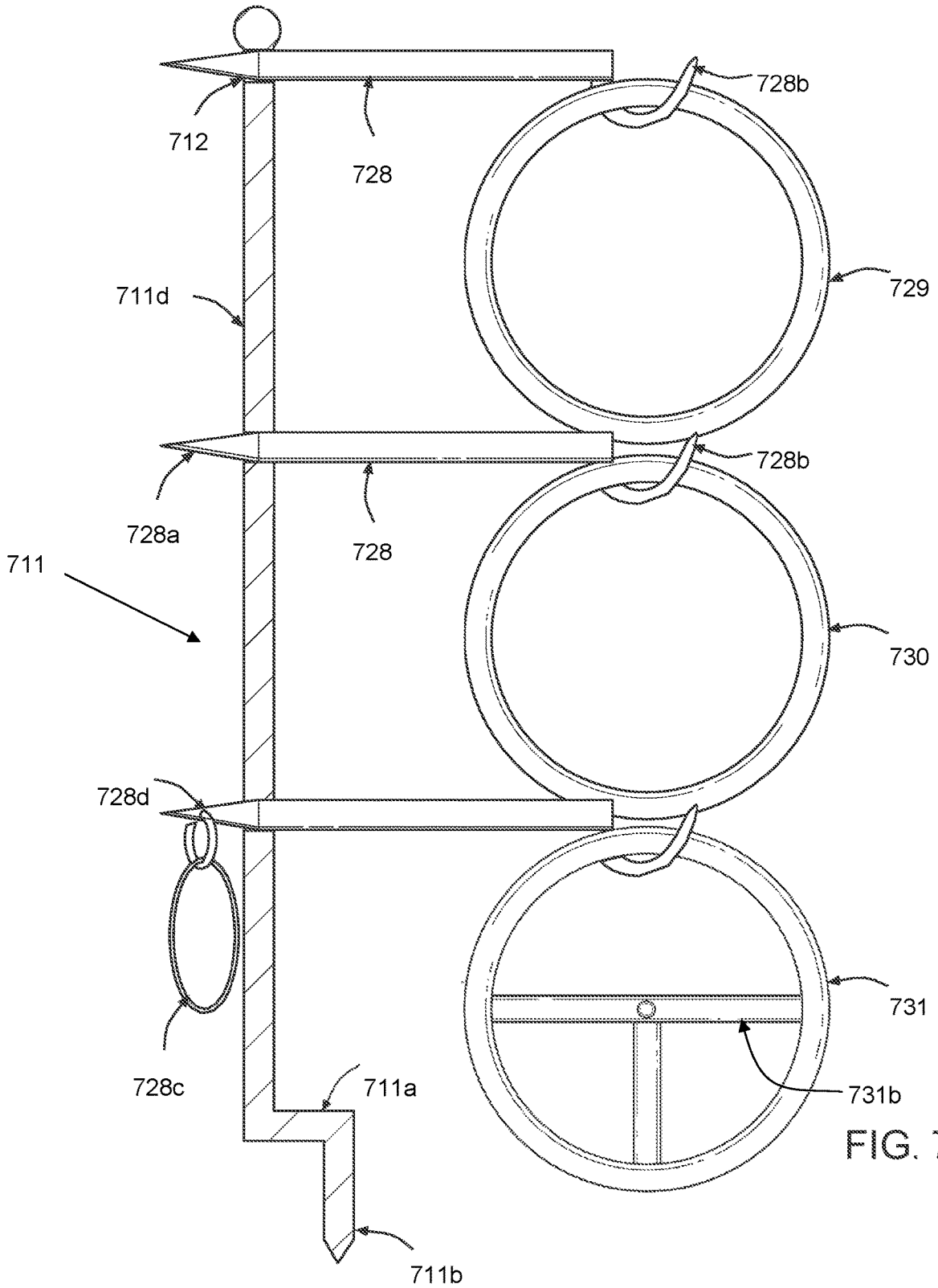
FIG. 7 illustrates the front view of a goal mount having three hooks, and each hook holding a different target portal, according to an aspect.

FIG. 7 illustrates the front view of a goal mount 711 having three loop hooks 728*b*, and each hook 728*b* holding a different target portal, according to an aspect. Aside from connecting a target loop to the goal post 711*d* using the docking rods described previously, one may also connect the goal post 711*d* and target loops through alternative methods. One may choose to implement a crossbar 728 having a tapered cone 728*a* as a crossbar rod on one end and a loop hook 728*b* on the other end. The tapered cone 728*a* of the hook pole may be inserted into a target port 712 as with the above-described docking rods to achieve a comparably secure fit. The loop hook 728*b*, being secured to the goal post 711*d* as a result of the insertion of the tapered cone end 728*a* into a target port 712, may hold a target loop by its loop surface, using the loop surface itself as a docking portion. In this instance, and some others that employ loop hooks 728*b* or similar technologies as the target holder, the docking surface of the target loop may be the solid outer portion of the loop surface itself. Each tapered cone 728*a* may have a balance hole 728*d* within it, each balance hole 728*d* adapted with a joint ring connected to a counter-balanced ring 728*c*, for the mounting of a counterbalance, as needed. Alternatively, the crossbar 728 may have a threaded crossbar shaft (not shown) configured to insert though a target port 712 in the goal post 711*d*, which may be secured in place by crossbar bolt (not shown). Similar methods of attaching a counterbalance may also be used, such a connecting the counterbalance directly to the balance hole 728*d* or threading a threaded counterbalance (not shown) directly into the crossbar 728. As can be seen in FIG. 7, the goal mount 711 is holding one single scoring portal target loop 729 off of an upper crossbar, one single scoring portal target loop 730 off of a middle crossbar and one triple scoring portal target loop 731 off of a lower crossbar. In an embodiment of the goal mount and target loop assembly depicted in FIG. 7, each target loop may be accompanied by a score controller, such as score controller 1346 described in FIG. 13, attached to either the target loop or the goal mount, such that score keeping may be done through electronic monitoring of each scoring portal.

With a goal mount 711 having a plurality of crossbars 728, a plurality of target loops may be held. These target loops may be provided in a variety of shapes and sizes, which may affect how difficult a user may find it to throw an object through their respective scoring portals. In an example, a top target loop 729 may be made smaller than a middle target loop 730. Due to the top target loop 729 being smaller and at a higher elevation than the middle target loop, one may assume that it would be more difficult for one to successfully throw an object through target loop 729 compared to target loop 730. As can be seen in FIG. 7, the usage of loop hooks 728*b* allows for the loop surface to act as a loop mount, removing the need for a loop mount disposed within the center of the loop surface. Despite this, target loop 731 may still have an internal loop mount 731*b* as described previously, in order to create distinct scoring portals within a target loop 731.

Figures 8A, 8B:
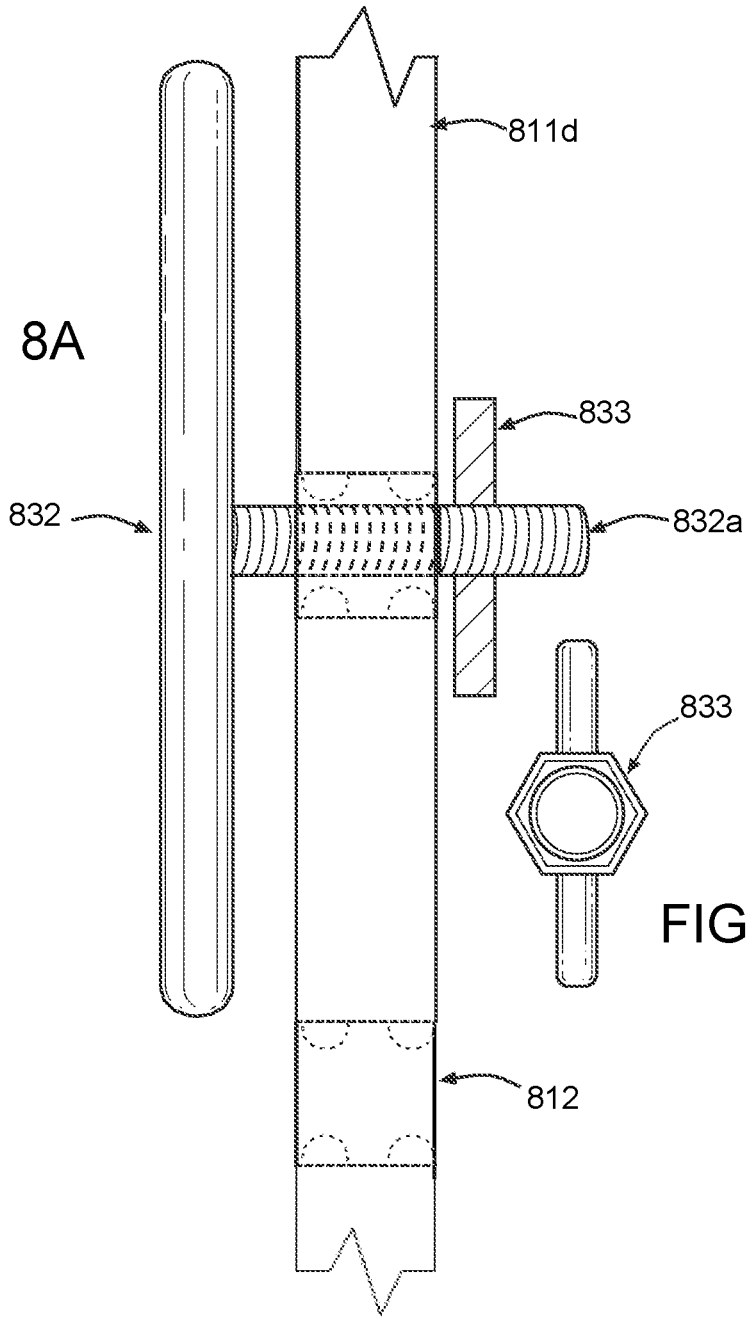
FIG. 8A illustrates the side view of a target loop attached to a goal post through usage of a threaded shaft, according to an aspect.
FIG. 8B illustrates the front view of a threaded shaft locking nut, according to an aspect.

FIG. 8A illustrates the side view of a target loop 832 attached to a goal post 811*d* through usage of a threaded shaft 832*a*, according to an aspect. FIG. 8B illustrates the front view of a threaded shaft locking nut 833, according to an aspect. Multiple methods of interconnecting the target loop to the goal post 811*d* may be utilized depending on the needs of the user. One alternate method of interconnection is the usage of a threaded post 832*a* on the target loop 832, rather than the aforementioned rods, or hooks. The threaded post 832*a* may be inserted through a target port in the goal post 811*d* and secured to the goal post 811*d* using a threaded shaft locking nut 833 screwed over the exposed end of the threaded post 832*a*. This method of fastening the target loop 832 to the goal post 811*d* provides an exceptionally secure attachment of the two elements and may be useful in instances where the impact of a thrown object may be expected to dislodge an alternatively attached target loop from the goal post 811*d*. The threaded shaft 832*a* may also be provided as a separate element which is configured to travel through a central port (not shown) in the target loop 832, as well as a target port 812, to be secured to the goal post 811*d* by a threaded shaft locking nut 833 screwed on to each side of the threaded shaft 832*a*. Additional mounting materials, such as mounting clamps (not shown), may be implemented alongside the herein described target loop mounting methods to further secure the target loop 832 to the goal post 811*d* to prevent the target loop 832 from being dislodged or otherwise moved out of position during play.

Figure 9:
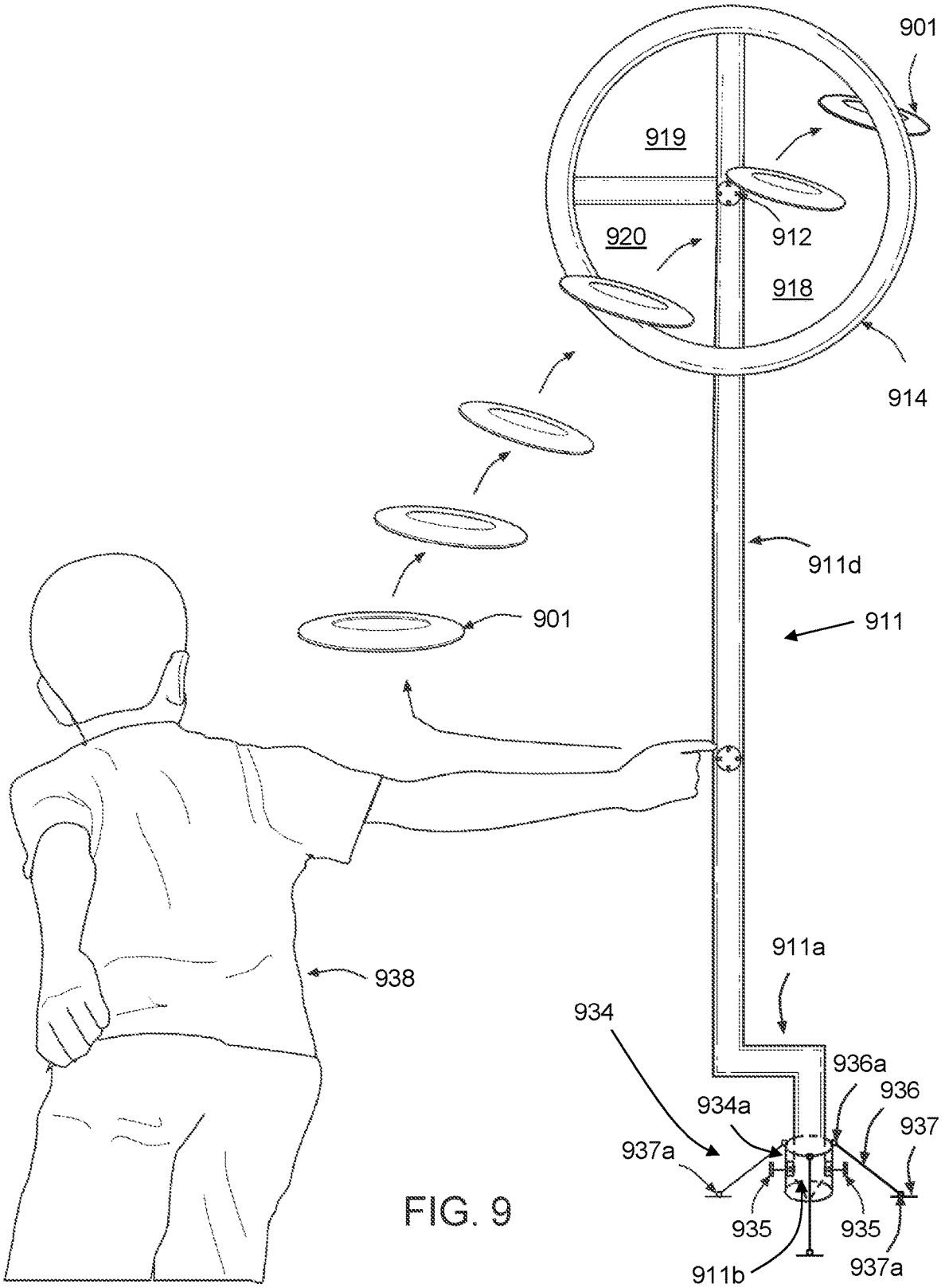
FIG. 9 illustrates the back view of a player throwing a flying disc through a target loop that is attached to a goal post having a tripod stand, according to an aspect.

FIG. 9 illustrates the back view of a player 938 throwing a flying disc 901 through a target loop 914 that is attached to a goal post 911*d* having a tripod stand 934, according to an aspect. A tripod stand 934 may act as a stand unit and connect directly to a base end 911*b* on the goal mount 911. The tripod stand may be comprised of tripod body 934*a* having a slot adapted to fit the base end 911*b*, two tripod screws 935, drilled through the tripod body 934*a* into its slot, which may be used to further secure the base end 911*b* to the tripod body 934*a*, and three foldable leg assemblies, each leg assembly comprised of a leg hinge 936*a* attached to the tripod body 934*a*, a leg 936 attached to the leg hinge 936*a*, a foot hinge 937*a* attached to the leg, and a foot pad 937 attached to the foot hinge 973*a*. The tripod stand 934 is assembled in such a way that the legs assemblies may be folded when not in use and that when in use, the foot pads help to keep the attached goal post 911*d* properly oriented (e.g. sufficiently upright) during use on uneven surfaces, such as sand or gravel or when positioned on a hill. Various elements of the tripod stand 934, as well as those of other stand units, may be modified depending on the needs of the application, such as including additional tripod screws 935 drilled through the tripod body 934*a* to facilitate a more secure fit of the tripod stand 934 to the goal mount 911.

In herein disclosed game, players may receive points from either throwing a flying disc 901 through a scoring portal in the target loop 914 or impacting the target loop 914 itself. The amount of points the player will receive may be based upon the difficulty of the corresponding achieved action. The player 938 can be seen throwing a flying disc through 901 scoring portal 918, an action of intermediate difficulty, and thus may be awarded two points. The number of points awarded for each scoring option should be weighted accordingly based on the accompanying difficulty factors, which will be discussed in greater depth herein.

Figure 10:
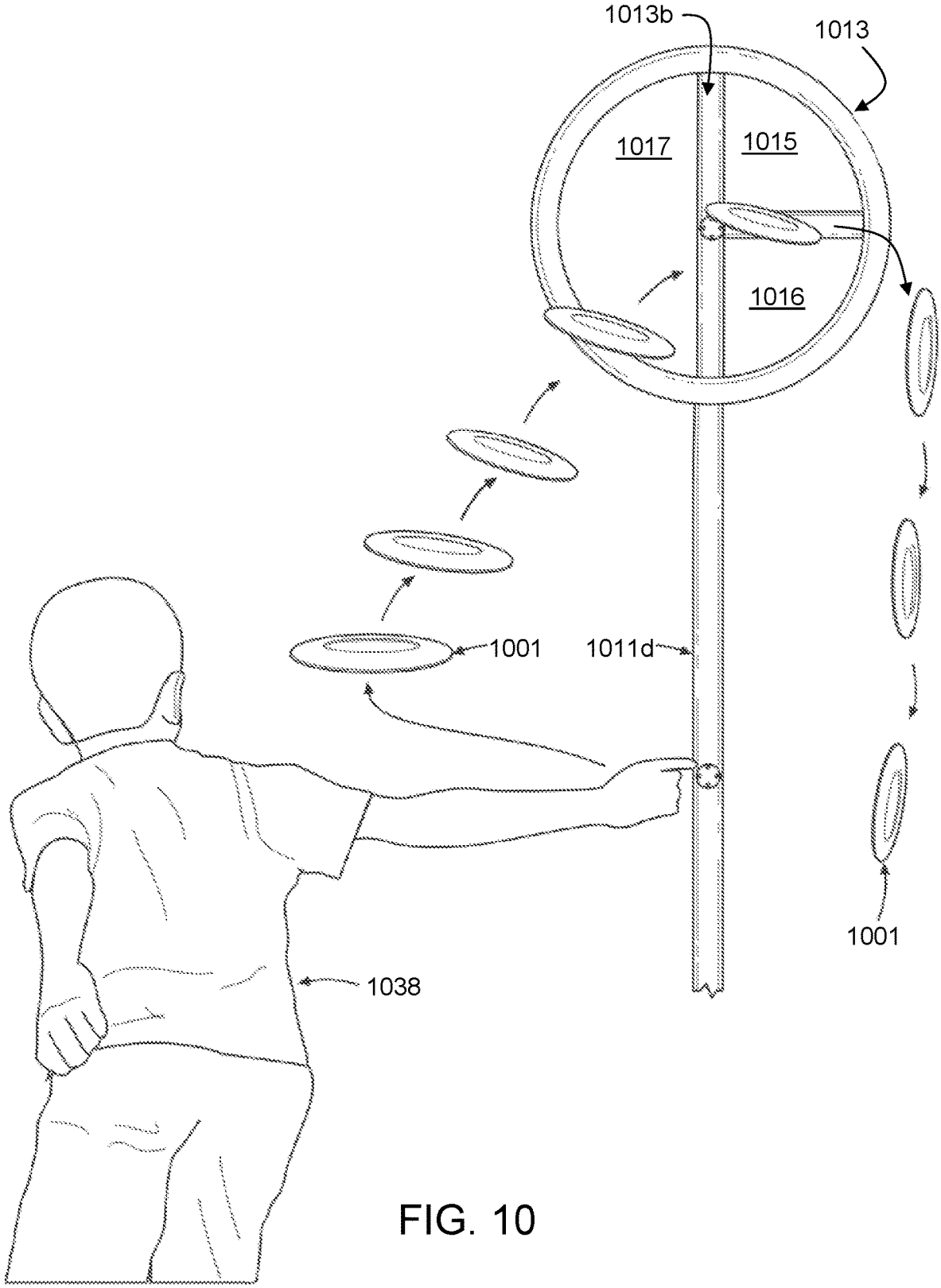
FIG. 10 illustrates the back view of a player throwing a flying disc that collides with a target loop attached to a goal post, according to an aspect.

FIG. 10 illustrates the back view of a player 1038 throwing a flying disc 1001 that collides with the target loop 1013 attached to a goal post 1011*d*, according to an aspect. Generally, the scoring rules for herein disclosed game are set up such that performing higher difficulty scoring actions awards larger amounts of points. As can be seen, the player 1038 does not manage to throw the flying disc 1001 through any of the scoring portals but does manage to hit the target loop 1013 itself. Depending on the rules established for use, this may award a small point value to player 1038 during play. Hitting the target loop 1013 with a thrown object may be the easiest action possible that awards a player 1038 with points, and thusly may have a lowest point value, such as one point. As discussed in FIG. 9, an intermediate difficulty action, such as throwing a flying disc through a half-sized scoring portal 1017 may award the player 1038 with an intermediate point value, such as two points. Throwing a flying disc 1001 through a quarter sized scoring portal such a 1015 or 1016, may award a high point value, such as three points, due this task being more difficult than scoring in the half-sized scoring portal 1017 or hitting the target loop 1013. Generally, the smaller a scoring portal is, the harder it is to score through, and thus should award a greater number of points.

Several other factors may affect the difficulty associated with throwing a flying disc 1001 through a particular scoring portal. Due to the way a right-handed player throws a flying disc 1001, the right-handed player may find it easier to score in scoring portals on the right side of the target loop. The opposite may be true of left-handed players, who may find it easier to throw a flying disk through a scoring portal on the left side of the target loop. Players may find the difficulty of the game being inadvertently changed based on their preferred throwing hand; therefore, points may need to be adjusted based on the how the player throws the flying disc 1001, or the target loop 1013 may need to be rotated based on which hand the player 1038 uses. Scoring points through smaller target loops may also award higher amounts of points. Additionally, it may be harder to throw an object through a scoring portal that is at a higher height when compared to the ground of the play area, due to the increased throw distance and resultant required throw force needed to score in it. Thus, scoring in a scoring portal that is at a higher height when compared to the ground of the play area may award more points than scoring in a scoring portal positioned at a lower height. The shape of the scoring portals may also affect scoring difficulty. A square scoring portal formed in a square target loop may be easier to score in when compared to the "pie shaped" scoring portals formed in circular target loops depicted thus far, meaning that a greater number of points should be awarded for scoring in a "pie-shaped" scoring portal, compared to a square shaped scoring portal. These variable elements that affect the number of points awarded for scoring a goal in a particular scoring portal, may all become relevant with complex goal mounts, which may hold a plurality of different types of target loops at different heights and in different orientations and positions. Further rules may be implemented, such as including a game time limit, score limit and shot clocks, or other game rules to tailor the game to the needs of the players or otherwise conform to established regulations, such as in tournament play.

When playing with new or inexperienced players, such as small children, one may choose to implement various alterations to reduce the difficulty associated with scoring points. For example, one may choose to reduce the distance that the player must stand away from the target loop 1013, which will reduce the required flying disc 1001 throw distance, reducing difficulty. Placing the target loop 1013 on a lower target port 1012 may also reduce the difficulty associated with scoring points, depending on the height of the players. Using larger target loops 1013 may also reduce the difficulty associated with scoring points by increasing the size of each formed scoring portal. Having fewer scoring portals on each target loop 1013 will also result in having larger scoring portals, which will make throwing a flying disc 1001 through each scoring portal easier. Having only one scoring portal in a target loop, such as with scoring portal 730 of FIG. 7, will maximize the size of said scoring portal, making throwing a flying disc 1001 through said scoring portal easier. Smaller diameter flying discs 1001 may also be provided, such as a 6-inch diameter flying discs instead of an 8.25-inch diameter or larger flying discs, which would not only be easier to throw through a scoring portal 1013 due to its smaller size but may also be more easily handled by smaller children or senior players who may struggle with larger diameter flying discs. Multiple flying discs 1001 of various diameters may be provided in the same game set to allow for fine tuning of scoring difficulty, as well as enablement of senior, younger, and/or inexperienced players. Finally, as discussed above, putting specific scoring portals on the same side of the target loop as the throwing hand of the player(s) will make it easier to score in these scoring loop. A player may choose to orient larger sized scoring portals 1017 on the same side of the target loop as their throwing hand, in order to make scoring in this largest scoring portal 1017 even easier, or potentially do the same with the smaller scoring portals 1015 and 1016, in order to reduce the difficulty associated with trying to score in scoring portals that award larger point amounts. As the players become more experienced, the difficulty may be gradually increased at will by reversing the changes above that made scoring points easier. Even when playing in a small play area, in which throw distance cannot be modified significantly, the difficulty of scoring points may still be increased by altering other difficulty factors, such as using smaller target loops, target loops with more target portals, resulting in smaller target portals, and higher elevation target portals.

Figure 11:
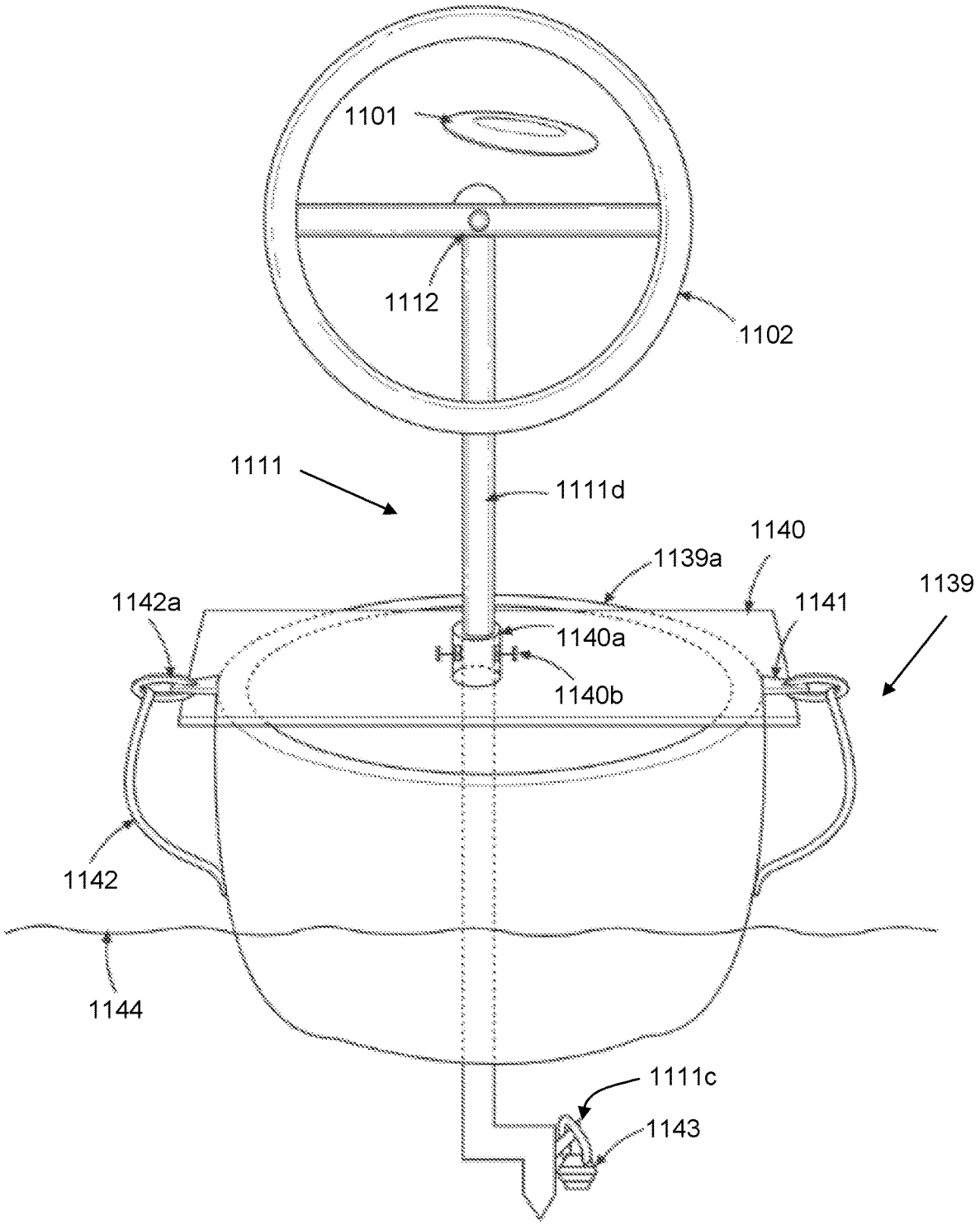
FIG. 11 illustrates the front view of a target loop attached to a goal mount, the goal mount having a floating base positioned on a body of water, according to an aspect.

FIG. 11 illustrates the front view of a target loop 1102 attached to a goal mount 1111, the goal mount 1111 having a floating base 1139 positioned on a body of water, according to an aspect. A unique stand unit that may be implemented within the herein described goal mount 1111 is a floatation device 1139*a* capable of keeping the target loop 1102 above the surface of a body of water 1144. The floating base 1139 may be comprised of a base plate 1140 with a mount pipe 1140*a* having solid wall surrounding a cylindrical opening running completely through the center of the plate. A plurality of screws 1140*b* may run through the walls of the mount pipe 1140*a*, in order to secure a goal post 1111*d* fitted through the mount pipe 1140*a*. The base plate 1140 may be attached to two or more brackets 1141, each connected to a clasp hook 1142*a*. The clasp hooks 1142*a* may be attached to each other by straps which go around the bottom end of the floatation device 1139*a*, effectively securing the base plate 1140, and thus the attached goal post 1111*d* to the floatation device 1039*a*. As a result of the goal post 1111*d* running completely through the mount pipe 1140*a*, the base end 1111*d* of the goal mount 1111 may be submerged below the surface of the water 1144. A counterweight 1143 may be attached to the weight mount 1111*c* of the goal mount 1111 in order to help keep the goal upright. This floating base 1139 expands the functionality of the goal mount 1111, enabling the herein disclosed game to be played on pools, lakes, and other bodies of water.

Figure 12:
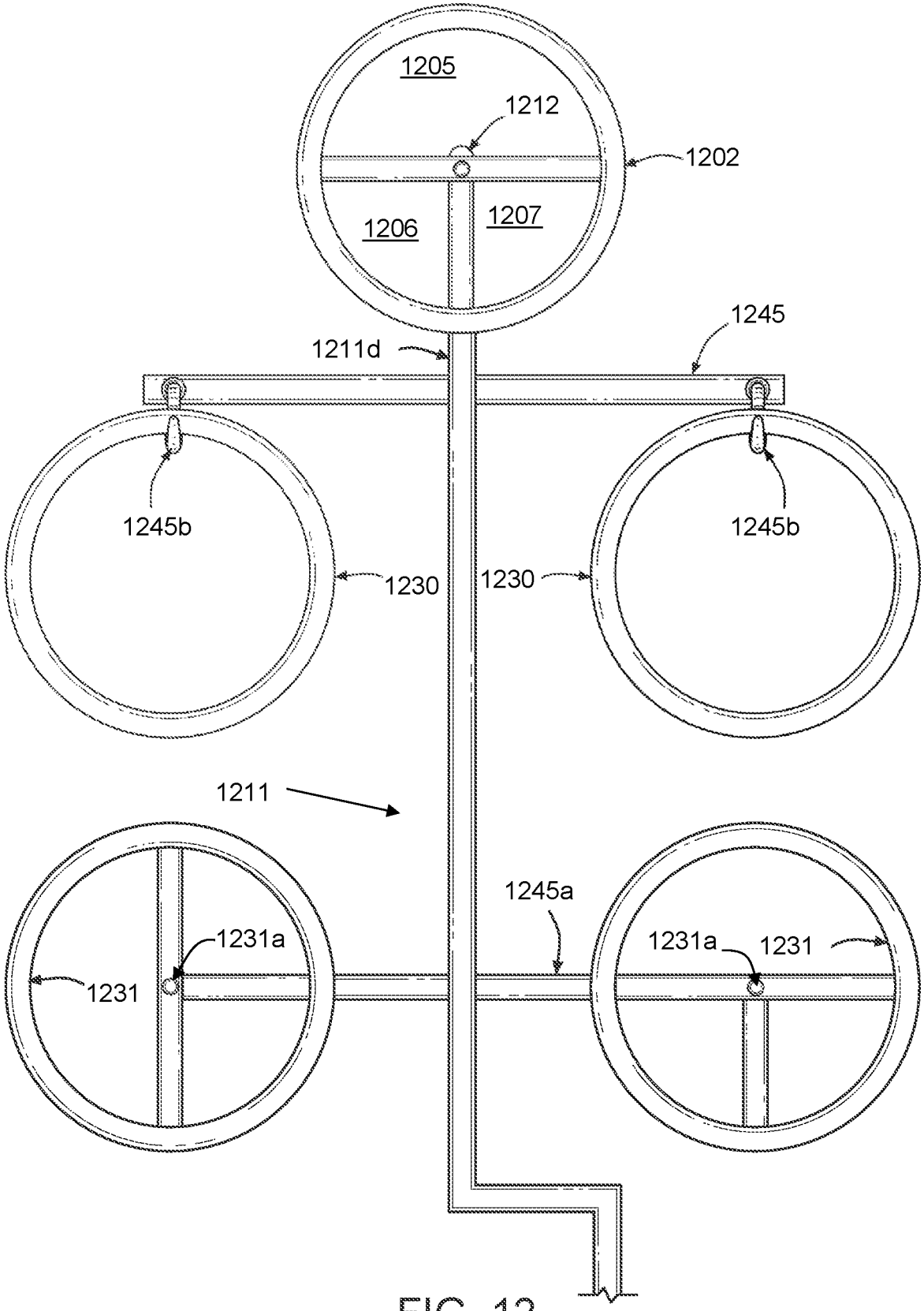
FIG. 12 illustrates the front view of a goal post adapted to hold five target loops using multiple attachment methods, according to an aspect.

FIG. 12 illustrates the front view of a goal post 1211*d* adapted to hold five target loops using multiple attachment methods, according to an aspect. A variety of attachment methods for combining the target loops with a goal post 1211*d* may be implemented in a singular goal assembly. Goal post 1211*d* has two crossbars attached to it at different heights, an upper crossbar 1245 on a top portion of the goal post 1211*d* and a lower crossbar 1245*a* on a bottom portion of the goal post 1211*d*. Theses crossbars may be attached to the goal post 1211*d* permanently through welding or similar methods, or temporarily, through a crossbar rod on each crossbar that docks in a target port on the goal post 1211*d* or similar methods. The upper crossbar may have loop hooks 1245*b* which connect directly to the loop surface of upper target loops 1230, similarly to loop hooks 728*b* found in FIG. 7. The lower crossbar 1245*a* may have target ports (not shown) to hold docking rods 1231*a* on each of the two lower target loops 1231. A top target loop 1202 may be attached to the goal post 1211*d* using a mechanism similar to that of the two lower target loops, having a docking rod on the target loop 1202 that is inserted into a target port on the goal post 1211. Each of the formed scoring portals should be assigned a point value based upon the aforementioned difficulty factors, including target portal height, shape, orientation and size. A goal assembly holding a variety of different target loops at different heights and in different ways provides the players with a variety of unique ways to score points. In an embodiment of the goal mount and target loop assembly depicted in FIG. 12, each target loop may be accompanied by a score controller, such as score controller 1346 described in FIG. 13, attached to either the target loop or the goal mount, such that score keeping may be done through electronic monitoring of each scoring portal.

In an alternative embodiment of the goal mount and target loop assembly depicted in FIG. 12, all score controllers and electronic elements may be omitted. The omission or removal of score controllers and other electronic elements from goal assemblies may help to reduce the price of a game set, as well as reduce the amount of upkeep and maintenance required. While other goal assemblies described herein may be provided with score controllers, such as the goal assemblies from FIG. 13A, FIG. 15, FIG. 22, any goal assembly may be adjusted to omit or remove any score controller. Any goal assembly described or depicted as including a score controller herein may be provided without one, while any goal assembly described or depicted without a score controller herein may have one incorporated into it.

FIG. 13A illustrates the front view of a target loop 1302 with an attached score controller 1346, according to an aspect. FIG. 13B illustrates the front view a score controller 1346, according to an aspect. FIG. 13C illustrates the front view of a target loop 1302 with a simplified attached score controller 1346, according to an aspect. The score controller 1346 is an essential component to a herein disclosed game set, especially when playing in the dark or from faraway distances. The score controller 1346 may be comprised of a vibration sensor 1346*a*, a time clock 1346*b*, four score sensors 1347, with at least one for each target portal, a viewing camera 1347*a*, four score indicator lights 1348, with at least one for each target portal, and a score buzzer 1349. While the score controller 1346 depicted in FIG. 13A-13B may have four score sensors 1347 and four score indicator lights 1348, these quantities may be varied as long as the included score sensor(s) 1347 are able to detect and differentiate travel through each scoring portal and the score controller 1346 is capable of conveying said information to the player through some mechanism. Each of the scoring portals formed on a target loop may be fitted with a score sensor 1347 and a score indicator light 1348. The score controller 1346 may be further comprised of a wireless transmitter (not shown), such as a Wi-Fi or Bluetooth transmitter, in order to enable communication between the score controller and an external device, such as a smartphone. Each score sensor 1347 is arranged such that it may be triggered by the passage of an object, for example, a glow in the dark flying disc 1301, through a corresponding scoring portal resulting in the actuation of score buzzer 1349 and/or a corresponding score indicator light 1348. The score indicator lights 1348 may be provided as LED lights or as other comparable lighting devices know in the industry. The score buzzer 1349 may be provided as speaker, air horn, or other comparable audio device known in the industry. The score controller 1346 may be arranged in such a way that scoring a goal within each scoring portal triggers a specific score sensor 1347 resulting in a unique alert in the form of a unique color of emitted light being produced by the corresponding score indicator light 1348 and/or a unique emitted sound being produced by the score buzzer 1349. This will help players know not only when a goal is scored, but also which scoring portal was scored in, even in the dark and from faraway distances during the day or night. The score sensors 1347 used may be optics-based sensors, including photosensors and photoelectric sensors (light beam/laser reflector sensors), or any other sensor capable of detecting the passage of an object through its associated scoring portal. A time clock 1346*b* may also be present on the score controller 1346, to provided players with relevant information, such as game time remaining or shot clock time, as applicable. A power source such as a rechargeable battery (not shown), may be provided to power the score controller 1346. This rechargeable battery may be attached to a solar panel (not shown) in order to enable recharging while not in use. While the score controller 1346 may be depicted as being directly attached to the target loop in FIG. 13A, it may also be possible to attach it to other elements of the goal assembly, such as the goal post 1311*d*, as long as each element on the score controller 1346 is capable of performing its intended function from this position. It should be understood that score controller 1346, as well as any potential score controller variants, may be applied to any target loop, goal mount or other applicable portion of any goal assembly even if not shown doing so in the provided figures. For example, a score controller may be attached to each target loop depicted in FIG. 7, FIG. 12, such that each target loop has a corresponding score controller, even if it is not visible in the provided figures. Score controllers may alternatively be attached to other goal assembly elements, such as crossbar 728 from FIG. 7, as long as each score controller is positioned properly to detect scoring through each provided scoring portal.

To enable point scoring through hitting the target loop 1302 certain instrumentation may need to be implemented. By providing a vibration sensor 1346*a* on the score controller, the vibration sensor 1346*a* may be triggered as the result of a direct impact of an object with the target loop 1302 during play. This triggering of the vibration sensor 1346*a* may actuate a unique alert in the form of a unique color of emitted light being produced by the corresponding score indicator light 1348 and/or a unique emitted sound being produced by the score buzzer 1349. Alternatively, each unique score sensor 1347 may trigger a unique color of emitted light from a corresponding score indicator light 1348, but also the same emitted sound from the score buzzer 1349 for any score sensor being triggered. For example, for a score controller 1346 incorporated on the target loop 1302 from FIG. 13C, one score indicator light 1348 may flash a red light when a score sensor corresponding to the half sized scoring portal 1305 is triggered, another score indicator light 1348 may flash a blue light when a score sensor corresponding to the left side quarter sized scoring portal 1306 is triggered, yet another score indicator light 1348 may flash a yellow light when a score sensor corresponding to the right side quarter sized scoring portal 1307 is triggered, and a final score indicator light 1348 may flash green when the vibration sensor 1346*a* is triggered. With each of these score sensors 1347 and the vibration sensor 1346*a* being triggered, the score buzzer 1349 may also produce a loud sound that would be audible to players, even at a distance. The score indicator lights 1348 and score buzzer 1349 may provide both players and viewers with an alert that indicates not only if the player scored, but how many points they earned. This alert may be easily detected by players and viewers regardless of lighting conditions in the day or night, as well as from large distances away. In order to further verify an impact with the target loop 1302, a viewing camera 1347*a* may also be provided on the score controller 1346. Due to the potential of the vibration sensor 1346*a* being trigger by an impact with the goal post in a region beyond the target loop 1302, it may be necessary to add a method to verify target loop 1302 impact. A viewing camera 1347*a* may be configured to allow a viewer to confirm an impact of a glow in the dark flying disc 1301 or another object with the target loop 1302, even in the dark or when the player is far away from the target loop. The score controller 1346 may be fitted with a wireless transmittance device, such that one may see through the viewing camera 1347*a* using a smartphone, mobile device or other Wi-Fi enabled device. A game application (or "game app") may be downloaded on a smartphone or other Wi-Fi enabled device to allow for the viewing of live streaming footage or instant replays through the viewing camera 1347*a* by the device user. This video footage may be used not only for spectating, but also for score confirmation purposes. The score controller 1346 may be included as a removable portion of the goal assembly, allowing a user to remove the score controller for recharging, maintenance, or replacement. With the addition of a score controller, elements depicted and described in previous figures may be provided together as a set to enable play of herein disclosed game. Upon the addition of a score controller 1346 to the goal mount and attached target loop 1302 as depicted in FIG. 13A, the formed apparatus may be referred to as a goal assembly. Goal assemblies may be provided with multiple target loops 1302 and multiple accompanying score controllers 1346. A basic set may include a flying disc, a goal mount, a target loop and a score controller. The flying disc and target loop may be composed of a glow in the dark material such that it may provide visible light in the presence of a UV-light source. When assembled, the provided goal mount may look like the one depicted in FIG. 2B, having a plurality of target ports. The provided target loop 213 may also look similar to the one depicted in FIG. 2B, having three scoring portals. The score controller may attach to the target loop as depicted by the connection of target loop 1302 and score controller 1346, and employ connective methods such as magnets, clips, snaps, or other attachments methods used in the field. The score controller 1346 may also alternatively be attached directly to the goal mount 1311, using friction clips, nuts and bolts, or comparable methods know in the industry, in an appropriate location, such as behind the target loop 1302, in order maintain the functionality of the included score controller elements. The target loop may attach to the goal post as before, using a cone shaped docking rod 213*a* attached to the target loop 213 to insert into a target port 212 on the goal post 211. Upon installation of the target loop 213 on the goal mount 211, the herein disclosed game may be played by throwing the provided flying disc at the target, in an attempt to throw it through a target portal, in order to score points. The difficulty associated with scoring may be modified in several ways, including changing the ring orientation or position, using a different size of flying disc, and throwing the flying disc from a greater distance. The herein disclosed game may be played with one or more players for a set amount of time, or to certain score. Additionally, a UV-light source, such as a UV flashlight, may be provided with the set, in order to allow users to re-excite the glow in the dark elements, to enable continued glowing during play.

Aside from this basic set, more complex sets may also be provided. A large set may include a flying disc, a goal mount, five target loops and five score controllers. The goal mount and target loops of his set may be arranged similarly to the goal assembly depicted in FIG. 12, but with score controllers on each of the target loops. This set may include crossbars like 1245 and 1245*a* as an additional set element, each crossbar fitted with a conical crossbar rod, similar to those found on certain target loops, designed to fit within target ports 1212 on the goal post 1211, or as a preinstalled components on the goal post. Each crossbar may be adapted with target ports (not shown) or hooks 1245*b* to hold a desired type of target loop. Upon installation, the crossbars extend horizontally beyond the goal post and may hold multiple target loops in symmetrical positions on the left and right sides of the goal post. Multiple types of target loops may be provided, such as having two open loops similar to target loops 1230 and three divided target loops, each having three target portals, as with target loops 1202 and 1231. The two open target loops may be attached to opposite sides of a crossbar by hooks, such as hooks 1245*b* attached to an upper crossbar 1245. Two of the three divided target loops 1231 may be attached to a lower crossbar 1245*a* by inserting docking rods 1231*a* from the target loops 1231 into target ports (not shown) on the lower crossbar 1245*a*. It should be understood that these target ports on the crossbars are similar to the target ports 1212 on the goal post 1211*d*, each target port on a crossbar allowing for the securing of a target loop without allowing it to rotate freely. The final target loop 1202 may be attached to a target port 1212 on the top of the goal post 1211*d*. Each target loop must have a score controller 1346 that is suitably arranged around it, in order to allow goals made in each of the formed scoring portals to be indicated visually and/or auditorily. Each scoring portal should have its own color and/or unique sound that occurs upon scoring in it or impacting it, in order to easily indicate how many points should be awarded. In this set, the position and orientation of each target loop may be modified at will to alter game difficulty. The positioning of the crossbars 1245 and 1245*a* may also be changed to alter game difficulty. Additionally, difficulty factors such as required throw distance and flying disc size, amongst other difficulty factors described herein, may also be modified to alter game difficulty. As with the basic set, a UV-light source, such as a UV flashlight, may be provided with any other the set in order to allow users to re-excite any glow in the dark elements, to enable continued visible glowing during play in the dark.

The herein disclosed game set may be used both indoors and outdoors, during the day or night and in both the light and dark environments, through the appropriate usage of the potential peripherals. A goal assembly intended for play in the dark may have components made of a glow in the dark material accordingly that may be phosphoresced by a provided UV-light source to maintain its visibility. That same glow in the dark game set may be used in the light as well, as the glow in the dark material will not interfere with its functionality, though glow in the dark elements need not be provided if the game set is only intended to be played in sufficiently lit conditions. The game set may be used outdoors, on surfaces including as sand, grass, gravel, concrete, water or any other surface that is compatible with an implemented stand unit or an element of the goal mount. The game set may also be used indoors, in locations with an appropriate amount of space, including a school gymnasium or an indoor play arena.

Figure 14A:
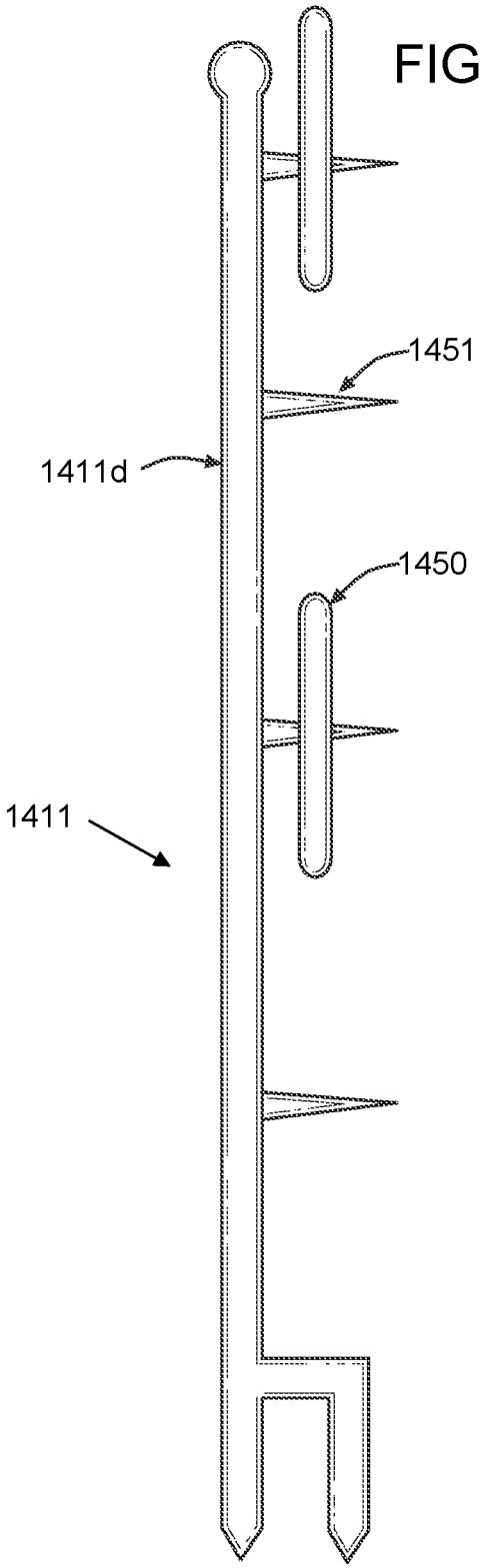
FIG. 14A illustrates the side view of a goal post having a plurality cone shaped post rods with one cone shaped post rod inserted into a central port on a target loop, according to an aspect.
Figure 14B:
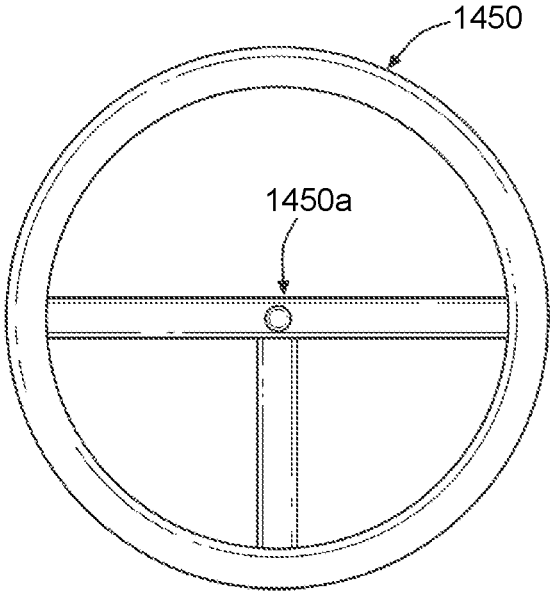
FIG. 14B illustrates the front view of a target loop having a central port, according to an aspect.

FIG. 14A illustrates the side view of a goal post 1411*d* having a plurality cone shaped post rods 1451 with one cone shaped post rod 1451 inserted into a central port 1450*a* on a target loop 1450, according to an aspect. FIG. 14B illustrates the front view of a target loop 1450 having a central port 1451, according to an aspect. While in previous examples, a cone shaped docking rod may be present on the target loop as its docking surface and a target port was present on the goal post as its target holder, through simple modification, these elements may be swapped. Goal post 1411*d* may connect to a target loop through insertion of a cone shaped post rod 1451 present on the goal post 1411*d* into a central port 1450*a* present on the target loop 1450.

With any game set provided, a variety of elements may be provided in various forms. The target holders present on a target mount may be loop hooks, target ports, cone shaped post rod 1451, or any other form capable of securely attaching to the provided docking portion on a target loop. Similarly, the docking portion of the target loop may be a docking mount with a docking rod or a central port 1450*a*, wherein the docking mount may divide the existing target portal into a plurality of target portals, the solid portion of loop surface itself or any other form capable of securely attaching to a provided target holder on the goal mount. A stand unit may also be provided based on the intended play terrain, which may be a tripod, fixture stand, floating base, base foundation, or any other means of stabilizing the goal mount in the desired environment.

Figure 15:
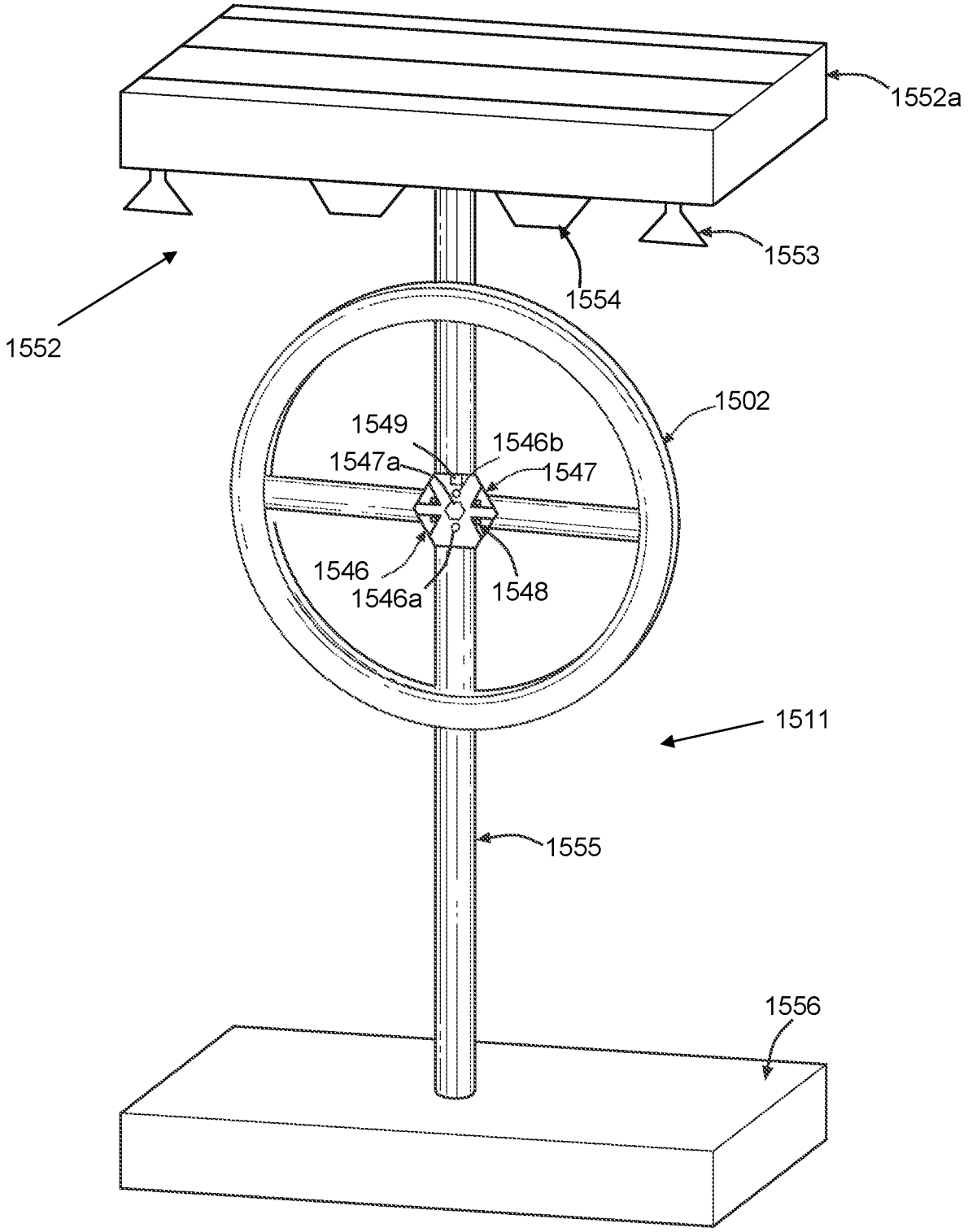
FIG. 15 illustrates the front perspective view of a glow in the dark target loop attached to a goal mount having a glow maintenance lighting source and a concrete stand, according to an aspect.

FIG. 15 illustrates the front perspective view of a glow in the dark target loop 1502 attached to a goal mount 1511 having a glow maintenance lighting source 1552 and a concrete stand 1556, according to an aspect. An important aspect of playing the herein described game in the dark is that the glow in the dark target loop 1502 and its resultant scoring portals must be illuminated. In order to achieve this, one may implement a UV-lighting source to provide non-visible UV-lighting to the target loop to allow it to maintain its phosphorescence, while keeping the surrounding area dark to the human eye. This UV-lighting source may be implemented on temporary or permanent goal assemblies. Permanent goal assemblies may have a permanent goal mount that is provided in a way that does not allow the permanent goal mount to be moved, such as having a goal mount embedded into a concrete floor. In FIG. 15, a permanent goal assembly is provided, comprising a concrete stand 1556 as a stand unit, placed on the ground, a goal post 1555 attached to the concrete stand, a target loop 1502 with a score controller 1546 attached to the goal post 1555, and a glow maintenance lighting source 1552 positioned at a top end of the goal post 1555, opposite the concrete stand 1556. The glow maintenance lighting source 1552 may have a solar panel 1552*a* attached to the top of the goal post 1555, with a UV-LED light fixture 1553 and a glow photosensor 1554 attached to a bottom end the solar panel. The solar panel may incorporate a battery (not shown) to store the solar energy harvested during daylight hours. The glow photosensor 1554 may be configured to activate the UV-LED light fixture 1553 when the glow of the target loop 1502 drops below a certain brightness threshold. This glow maintenance lighting source 1552 may allow for the continued phosphorescence of the glow in the dark target loop 1502 by intermittently providing UV-light whenever the target loop 1502 becomes too dim. The power used to power the UV-light may come entirely from the collected solar energy stored on a battery (not shown), or be provided through alternative methods, such as a connected power line or separate battery pack. A similar glow maintenance lighting assembly may also be used to keep the glow in dark flying discs used glowing, which may be placed beneath a sensor and UV light when not being thrown. The glow in the dark target loop 1502 may be replaced with a cheaper, non-glow in the dark target loop and the glow maintenance lighting source 1552 may be omitted in applications in which glow in the dark properties are not needed, for the purposes of reducing the cost of goal assembly. An embodiment of the goal assembly depicted in FIG. 15 may have a permanent goal mount 1511 that cannot be moved, providing a secure mounting position for the target loop 1502. Said embodiment may have a battery, such as a rechargeable battery (not shown), attached to a solar panel 1552*a* and UV-LED light fixture 1553 of a glow maintenance lighting source 1552 on the goal mount 1511, as well as a score controller 1546. The solar panel 1552*a* may harvest solar energy during daylight hours that is then stored in the attached battery and used to power the score controller 1546 and UV-LED light fixture 1553 during play.

Multiple goal assemblies, including the one depicted in FIG. 15, may be provided in a singular set and be used to create a multiple goal assembly course at a play location. A player may come to the play location and play through each set up goal assembly in a particular sequence, much like the process for playing through a disc golf course. Such a course may be constructed with 9, 18, 27 or any other suitable number of goal assemblies and may have the goal assemblies provided with permanent goal mounts. Alternatively, the player may also play using one or more of the available goal assemblies and do so in no particular sequence. Each goal assembly of the multiple goal assemblies may be provided in a permanent or removable stand unit such as the concrete stand depicted, be permanently or removably anchored into the ground by a base spike as previously described, or otherwise be provided in a way that allows players to score within its held target loop(s). For the goal assemblies, the score controllers 1546 may be permanently attached to the goal post 1555 to provide a sturdier design or be made removable for ease of maintenance. Each score controller 1546 may be provided with a unique identification code (or "ID code") and be configured to sync with the game app, such that a player may use the game app on their smartphone or other device to set which goal they are scoring on, to enable electronic score keeping for each goal assembly as well as the entire course, including the 9, 18, or 27 goal assembly course described above. This process may be automated if the player must use the provided goal assemblies in a particular sequence, as a score controller 1546 may automatically be ready to keep score for a particular player if it is notified, through a wired or wireless connection, by a previously scored upon score controller. For example, if upon scoring in a goal assembly #1, the scoring monitor of goal assembly #1 communicates with the scoring monitor of goal assembly #2, the latter scoring monitor can be configured to add points scored from the next scored goal in goal assembly #2 to the previous number of points scored in goal assembly #1, and therefore keep score. This score keeping process may also allow a player to activate a score controller 1546 on a goal assembly they will use through usage of the game app. Alterations that may enable fully automated electronic score keeping, such as using RFID, NFC or other proximity-based detection technologies, will be discussed in greater detail hereinafter. While the goal assembly of FIG. 15 may be adapted with glow in the dark materials and a glow maintenance lighting source as detailed above, it may also be used just as effectively in well-lit environments, such as outside during the day, enabling such a goal assembly to be used at any time of day. A battery, such as a rechargeable battery (not shown), may be included on each goal assembly of the multiple goal assembly course to provide power to score controllers and any other powered elements. Alternatively, it may be possible to use a power cord or similar method to provide power to each goal assembly from an external source. While score controllers 1546 described may be used in conjunction with the described goal assemblies of a multiple goal assembly course as detailed above, score controllers may also be adapted for use with other types of goals, such as disc golf basket and chain goals. Therefore, a plurality of score controllers 1546 may be implemented on other multiple goal courses, such as a disc golf course, to provide automated score keeping as detailed herein.

Figure 16A:
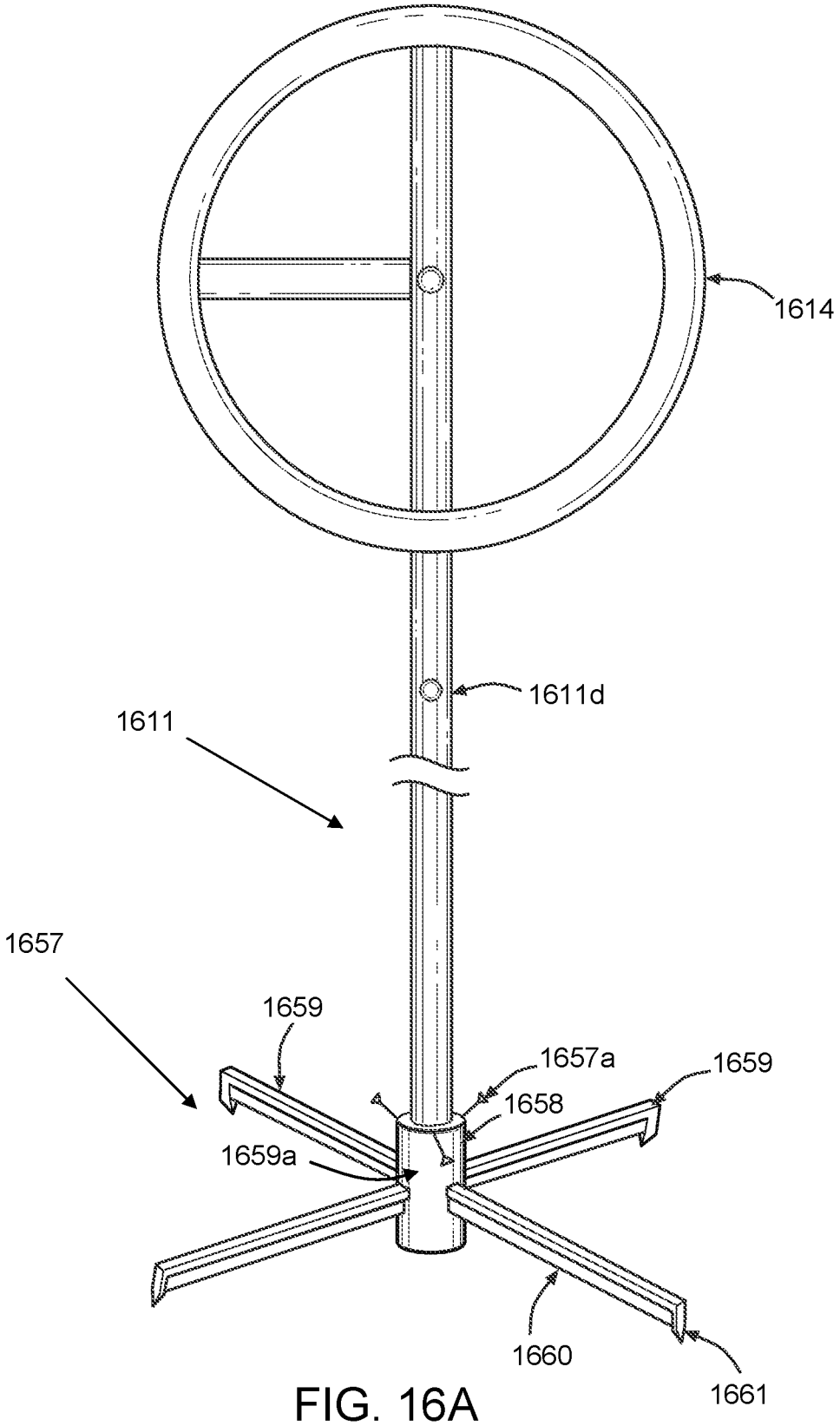
FIG. 16A illustrates the front view of a target loop attached to a goal mount and the goal mount attached to a fixture stand, according to an aspect.
Figure 16B:
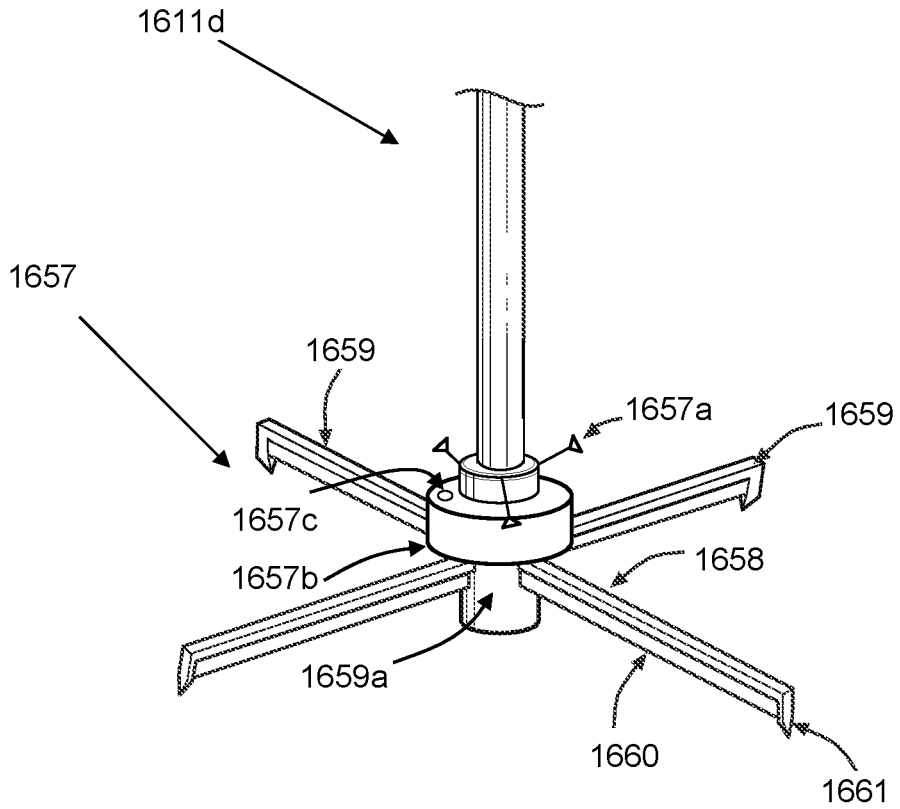
FIG. 16B illustrates the front view of a bottom portion of a goal mount attached to a fixture stand having a water weight as a base weight, according to an aspect.

FIG. 16A illustrates the front view of a target loop 1614 attached to a goal mount 1611 and the goal mount 1611 attached to a fixture stand 1657, according to an aspect. FIG. 16B illustrates the front perspective view of a bottom portion of a goal mount attached to a fixture stand having a water weight 1657*b* as a base weight, according to an aspect. Like the previously described mechanism for stabilizing a goal mount, the fixture stand 1657 used as a stand unit detailed herein is capable of keeping the goal mount 1611 upright and stable. The fixture stand 1657 may be comprised of a fixture stand body 1658 having a post slot (not shown) adapted to fit a base end of a goal mount 1611. A plurality of fixture screws 1657*a* may be screwed through the fixture stand body 1658 into the post slot in such a way that the bottom of the goal post 1611*d* is secured to the fixture stand 1657. The fixture stand body 1658 may be attached to three or four fixture legs 1659, each fixture leg having a support bar 1660 and a tapered leg stake 1661. The tapered leg stakes are shaped in such a way that they may be sunken into softer surfaces, such as grass or sand, or rest upon harder surfaces, like concrete or the floor of an indoor play arena. The support bars 1660 provide stability to their respective legs and may help to further stabilize the goal mount 1611 by increasing the stability of each leg fixture. The addition of a water weight 1657*b* to the goal mount may help to further weight down and stabilize the goal mount. The water weight 1657*b* may include a plug 1657*c* for filling or emptying water as needed and may be attached to the fixture stand body 1658 as shown in FIG. 16B. Abase weight, such as the described water weight 1657*b*, may use sand, dirt, or any other suitable weighted object to achieve the desired stabilization the attached goal mount 1611.

Figure 17:
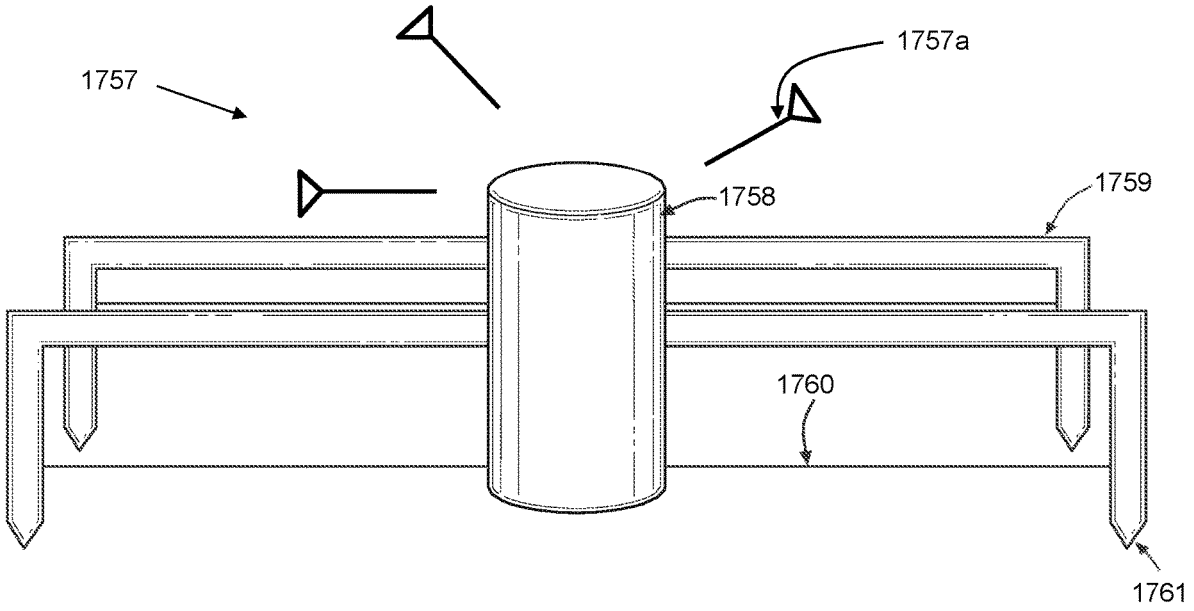
FIG. 17 illustrates the front view of a fixture stand in a folded orientation, according to an aspect.

FIG. 17 illustrates a fixture stand 1757 in a folded orientation, according to an aspect. One benefit of using the fixture stand 1757 as a means of stabilizing a connected goal mount is that when the goal is not in use, the fixture stand may have its fixture legs 1759 folded together. The fixture stand 1757 may be comprised of two nested stand sections, each stand section having two fixture legs, positioned at opposite sides of the stand section (not shown). When installed, the fixture screws 1757*a* may travel through screw ports (not shown) in both stand sections, the screw ports positioned such that upon installation of the fixture screws 1757*a*, the fixture legs 1759 from one stand section form 90-degree angles with the fixture legs from the other stand section, as seen in FIG. 16. However, upon removal of the fixture screws 1757*a* from the screw ports, the stand sections may be rotated manually. As such, the stand sections may be rotated to move sets of fixture stand legs 1759 from the nested stand sections closer together, as depicted in FIG. 17. This in turn will reduce the overall size of the fixture stand 1758 and make it easier to store and transport.

Figure 18A:
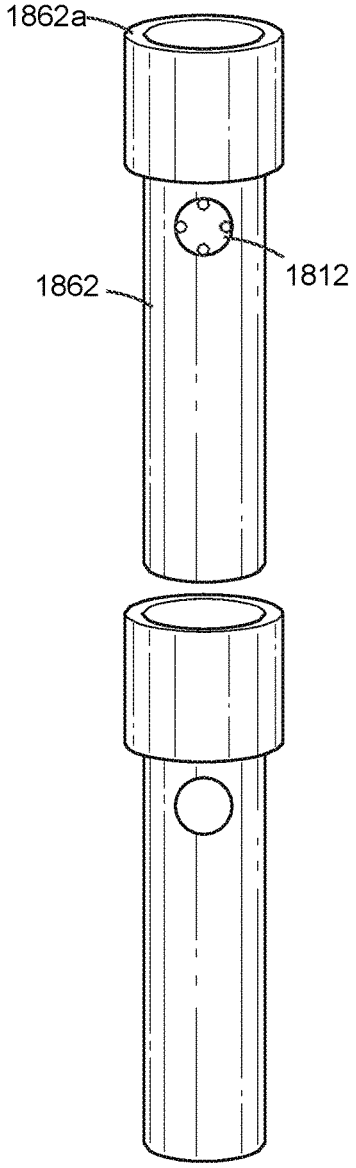
FIG. 18A illustrates the front view of two of disconnected separable pole sections, according to an aspect.
Figure 18B:
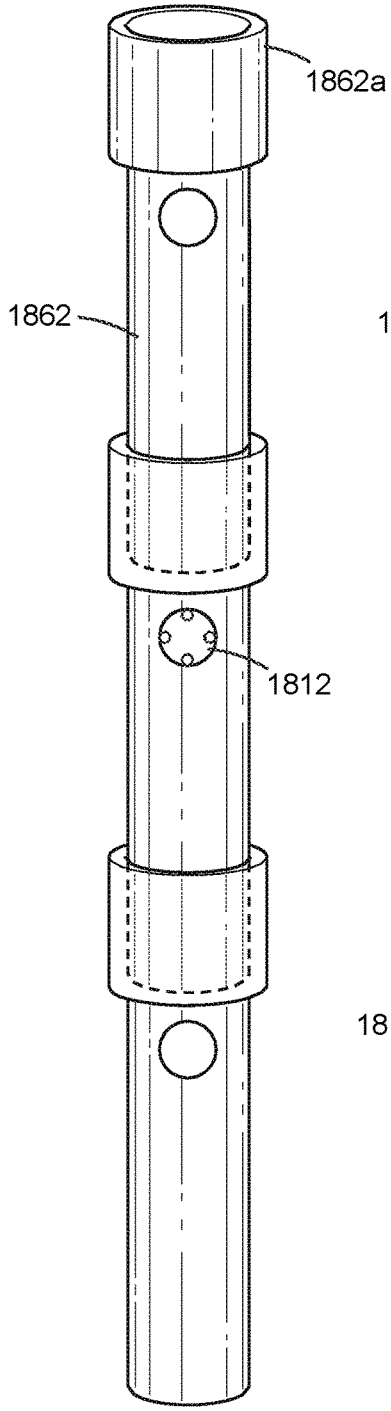
FIG. 18B illustrates the front view of a plurality of interconnected separable pole sections forming a goal post, according to an aspect.
Figure 18C:
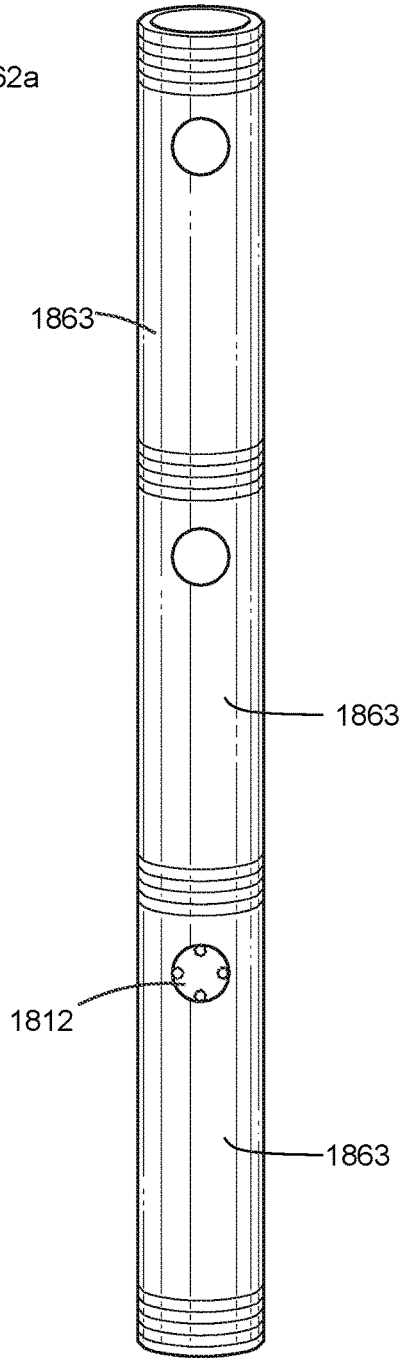
FIG. 18C illustrates the front view of a goal post formed from a plurality of threaded separable pole sections, according to an aspect.

FIG. 18A illustrates the front view of two of disconnected separable pole sections 1862, according to an aspect. FIG. 18B illustrates the front view of a plurality of interconnected separable pole sections 1862 forming a goal post, according to an aspect. FIG. 18C illustrates the front view of a goal post formed from a plurality of connected, threaded pole sections 1863, according to an aspect. Based on the desired portability a goal assembly, amongst other factors, it may be prudent to provide goal post in a variety of forms. In cases in which portability of the device is important or desirable, the goal post may be provided in the form of separable pole sections 1862. Each separable pole section may house a top junction 1862*a* having an empty cylindrical port on a top portion of the pole section 1862 configured to securely friction fit a bottom portion of another pole section 1862, as seen in FIG. 18B. Each pole section 1862 may also be fitted with a target port 1812 or other target holder, such that each pole section is capable of connecting to a target loop. In addition to using pole sections 1862 with top junctions 1862*a*, one may also implement threaded pole sections 1863 as separable pole sections. These threaded pole sections 1863 may each have a threaded slot on one end and a threaded shaft on the other end. One threaded pole section 1863 may be connected to another threaded pole section 1863 by screwing the threaded shaft from one threaded pole section 1863 into the threaded slot of another. Similarly to pole sections 1862, threaded pole sections 1863 may also house a target port 1812 in each pole section. Elements of these types of separable pole sections may be suitably combined, such as including threads within a top junction 1862*a*, adapted to fit a threaded bottom end of another separable pole section. The modular nature of a goal post constructed of separable pole sections 1862 may allow for variable heights of the resultant goal post based on the amount of separable poles sections 1862 or threaded pole sections 1863 used.

FIG. 19A illustrates the front view of a score controller, according to an aspect. FIG. 19B illustrates the side view of two score controllers electronically interfacing, according to an aspect. In addition to the score controller 1946 elements discussed in FIG. 13A-13C, additional score controller 1946 elements may be implemented. Score controller 1946 is further comprised of a microphone 1964, a spacing laser emitter 1965 and a spacing laser receiver 1965*a*. The previously detailed score controller elements, including a vibration sensor 1946*a*, a wireless transmitter (not shown), rechargeable battery (not shown), a time clock 1946*b*, score sensor(s) 1947, a viewing camera 1947*a*, score indicator light(s) 1948, and a score buzzer 1949 may also be included on this score controller 1946, as well as the later described score controllers. Said components may suitably retain their functionalities described previously, such as the time clock 1946*b* being provided on the score controller to display the game time remaining, a shot clock timer, or other pertinent time-based information. A microphone 1964 on the score controller may capture the sounds that occur during play, as well as discussions from nearby players. The audio captured by this microphone 1964 may be transmitted via Wi-Fi or comparable mechanism for listening within the aforementioned game app on a Wi-Fi enable device, similarly to the video captured by the viewing camera 1947*a*. The game app may be used with the herein disclosed goal assembly in order to broadcast the audio and video captured by their respective score controller elements to Wi-Fi enabled devices such as a smartphone. This game app may further broadcast this audio and video to others using the internet on the Wi-Fi enabled device, enabling spectators or even competitors to see and hear gameplay from anywhere with an internet connection.

The usage of a spacing laser emitter 1965 and accompanying spacing laser receiver 1965*a* may help when setting up two goal mounts and their respective target loops a fixed distance apart, therefore acting as a distance verification device. When playing the herein disclosed game, being able to easily establish a proper distance or position for a player to throw from may become relevant in a casual or competitive environment. By setting up two goal mounts with scoring controllers facing each other and aligning their spacing laser emitters 1965 with a spacing laser receivers 1965*a* on the opposing goal assembly, as represented by laser trails 1965*b*, the distance between two goal target loops can be determined electronically. The distance information measured by the laser receivers 1965*a* may be presented to the players through the aforementioned game app on a smart device that is in communication with both score controllers. It may also be possible to set a desired distance of separation between the two target loops from within the game app, and then have the game app use the device it is installed upon to wirelessly manipulate the score controllers to make the spacing laser emitters 1965 align with the spacing laser receiver 1965*a* on the opposing goal assembly at a certain distance. Once a set distance is established between the two score controllers, using the spacing laser emitter 1965 and spacing laser receiver 1965*a*, and by extension all other attached elements of the goal assembly, one may choose to use the area behind or beside one goal assembly as the throwing position (or "allowable play area") for scoring on the opposite goal assembly. Rules may be established for the herein disclosed game that prevents the player from scoring points in a goal assembly if said player is not standing behind or beside the opposite goal assembly.

Based on the above details, the two-goal assembly displayed in FIG. 19B may be used for competitive play, as it provides a method of spacing verification, effective cheating detection regardless of which target loop is being scored upon, as well as multiple angles to view the gameplay from. The spacing laser emitters 1965 and spacing laser receivers 1965*a*, or other distance verification device, may be configured to prevent gameplay if the proper distance is not established between the two score controllers, potentially by not starting the time clock 1946*b* and not allowing any points to be score until the said proper distance between the score controllers is established. The distance verification device may be configured to allow the game to be started after the set distance between the two goal posts is established though a "start button" within the interface of the game app. When a player is throwing a flying disc at target loop, the viewing camera on the scoring monitor attached within said target loop may be configured to allow a judge to visually confirm that the player is standing at an appropriate distance from the attached goal mount and within the allowable play area, such as behind or beside the opposite goal mount. Due to the presence of a viewing camera 1947*a* on each of the score controllers 1946, the game may be configured to allow the player to score in a target loop on either goal assembly. This may enable a rapid form of play in which a player may throw a flying disc through a target loop 1902 on one goal mount, run to retrieve the flying disc, then quickly line up behind said goal mount to throw the flying disc at the opposite target loop 1902, then again running to retrieve the flying disc. The repetition of this process may allow a user with one or few flying discs to be capable of quickly scoring points, while limiting the required running distance between throws. Both viewing cameras 1947*a* may also be viewed by spectators and other players, allowing them to see from the perspective of both goal mounts at any point regardless of which one is being scored upon. An alternative game set may be provided for use with competitive play, which may include one or more flying discs, two goal mounts, at least two target loops 1902 and at least two scoring monitors 1946, such that the two goal assembly arrangement detailed hereinabove may be provided to a player. One of the two goal assemblies may be referred to as a first goal assembly, with the other referred to as the second goal assembly. Such a set may provide a standardized and easy way to allow players to readily compete with other players around the world.

Figure 20:
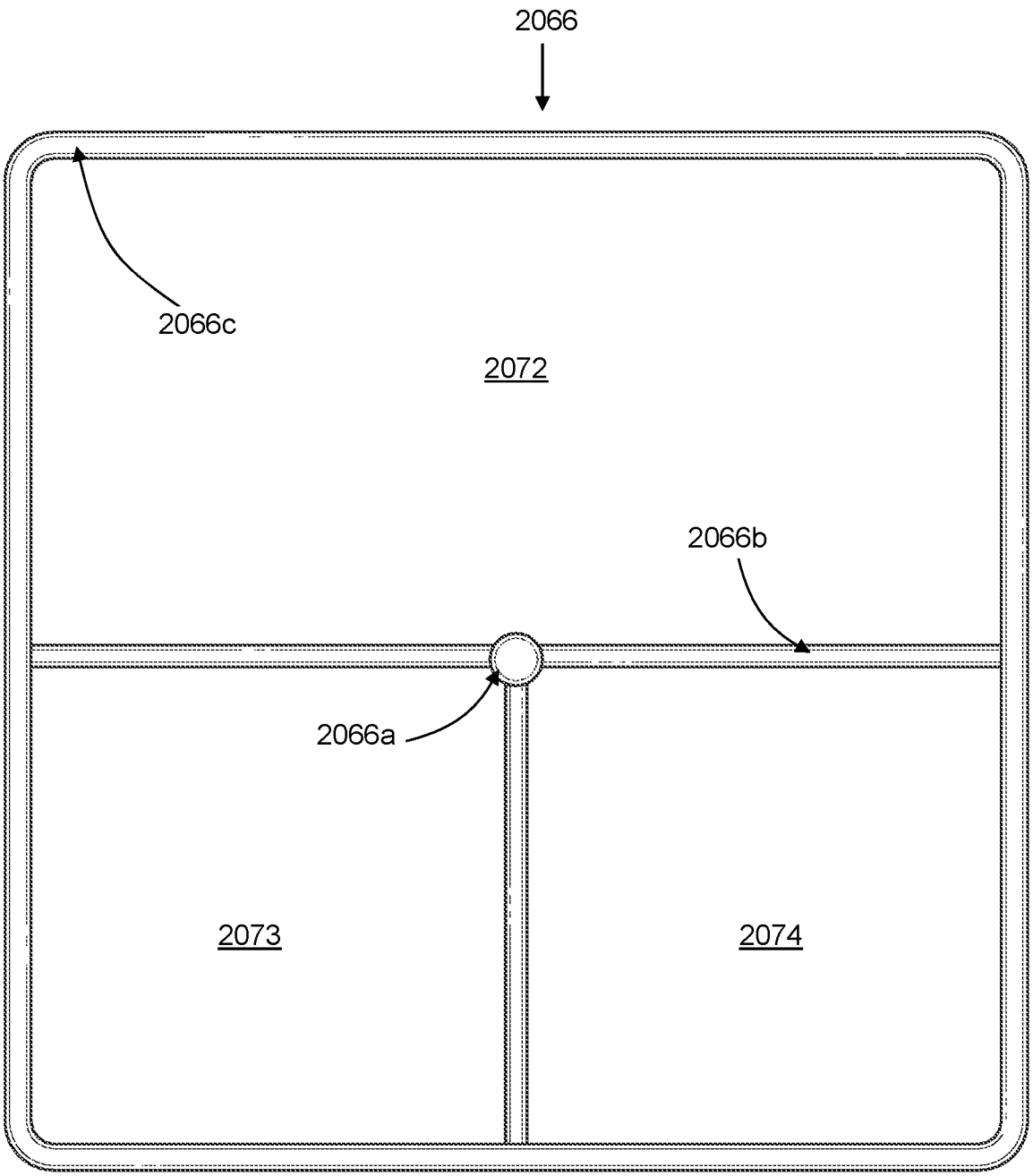
FIG. 20 illustrates the front view a rounded square target loop, according to an aspect.

FIG. 20 illustrates the front view a rounded square target loop 2066, according to an aspect. While the circular loop shaped described and utilized hereinabove may be a suitable shape for the target loop, this shape may be modified to cause various effects. A loop surface 2066*c* having a rounded square shape as seen in FIG. 20, may be easily implemented within a goal assembly with minimal modification needed within the goal mount. The docking mount 2066*b* connected to the loop surface 2066*c* must be adapted accordingly to properly fit and divide the loop into a plurality scoring portals 2072, 2073 and 2074, as needed. The docking rod 2066*c* may remain unchanged regardless of which shape of target loop is implemented. This rounded square target loop 2066 may also be used without internal scoring portal divisions, having only a singular rounded square scoring portal. The usage of the rounded corners on the square shaped target loop 2066 may make the target loop easier to produce through injection molding, and also more durable, when compared to a square shape with sharp 90-degree corners. The usage of alternate shapes of target loops, like the above rounded square shape, may affect the possible trajectories of thrown discs that may pass through their scoring portals, and thus the resultant difficulty for a user to score points. Other alternative shapes of target loops may be implemented, including hexagons and triangles, as long as the docking mount is modified accordingly. Having multiple shapes of target loops within the same goal assembly will allow for scoring portals to have variable difficulty levels associated with scoring in them, and thus may be granted point values accordingly, with more difficult scoring portals awarding greater quantities of points for scoring in them.

FIG. 21A illustrates the front view of a score controller 2168 having four electronic tag readers 2170, a viewing camera 2147*a*, a time clock 2146*b*, a scoreboard 2146*c*, a microphone 2164 a loudspeaker 2167 and various additional elements, according to an aspect. FIG. 21B illustrates the top perspective view of a flying 2101 disc having an attached electronic tag 2171, according to an aspect. In accordance with previous descriptions on score sensors, the quantity of electronic tag readers 2170 acting as score sensors may be suitably varied as needed but must be capable determining which scoring portal is scored upon. Based on the nature of the flying disc used for scoring, certain features of the score controller 2168 may be adjusted accordingly. Flying disc 2101*a* is fitted with an electronic tag 2171 which may be an NFC tag, RFID tag, or comparable wave-emitting electronic element. Incorporation of electronic tag readers 2170, which may be NFC readers, RFID readers, or comparable tag reading devices, as scoring sensors on the score controller 2168 may allow for detection of a goal being scored within a scoring portal, without a need for optics-based scoring sensors. Both NFC and RFID readers are signal-based sensors, which may be able to detect the presence of a nearby signal emitting tag, such as an NFC or RFID tag, respectively, regardless of the lighting conditions. Additionally, both NFC and RFID technologies may allow for the score controller 2168 to determine if a specific disk 2101*a* was scored in a specific scoring portal. This information may be used in conjunction with the game app to enable electronic score keeping. If each player uses a flying disc 2101*a* (or multiple flying discs) with a unique NFC or RFID tag, the score controller 2168 may be configured keep track of each player's score and display each player's score on a device having the game app as well as the provided scoreboard 2146*c*. Additionally, information including player scores and gameplay footage, such as instant replays, may be transmitted using the incorporated wireless transmitter through the internet using an internet enabled device with the game app, allowing for players to compete with other players despite not being near each other. The inclusion of a wireless transmitter on the score controller 2168 may allow for video data collected from the viewing camera 2147*a*, audio data from the microphone 2164, and scoring data from the sensors to be uploaded to the internet, while also allowing scoring data and other pertinent information to be downloaded from the internet onto the score controller 2168. Such a feature may enable players from around the world to play socially or compete in tournaments in real time, despite their geographical distances. This concept of the herein disclosed game being played in a "physical virtual" format, will be discussed in greater detail below.

In addition to having the majority components described in score controller 1946 of FIG. 19A, including score indicator lights 2148, a viewing camera 2147*a*, a wireless transmitter (not shown), a score buzzer 2149, a time clock 2146*b*, a vibration sensor 2146*a* and a microphone 2164, score controller 2168 also houses a variety of other components in order to further enhance the provided gameplay experience. A loudspeaker 2167 may be present on the score controller. When used in tournaments, the loudspeaker 2167 may be used to allow for tournament staff and judges to communicate with players easily or otherwise be configured to provide other audio data from a device with the game app connected the internet as needed. A scoreboard 2146*c* may provide players an easy method of viewing the current score without using the game app. The scoreboard 2146*c* may include an attached scoreboard switch (not shown) to allow players to manually toggle between the player or team score displayed by pressing the scoreboard switch. The act of pressing the scoreboard switch to display a player/team score may also enable scoring for said player/team. This may allow the players to participate in scorekeeping by confirming which player/team is currently attempting to score with the score controller 2168. Alternatively, the score controller 2168 may interface with the game app to allow player to make this change from their wireless device, or even automatically after a certain amount of time passes, or a goal is detected from a flying disc having a particular electronic tag. The usage of a scoreboard 2146*c* may also remove the need for multiple score indicator light 2148 or other methods of score differentiation, as the scoreboard 2146*c* may present the total score, as well as the points scored from a particular goal, visually on the score controller 2168. An ultrasonic wave emitter and detector 2169 may be used in place of the aforementioned spacing laser emitter and spacing laser receiver as a distance verification device and emit ultrasonic waves which bounce off of the opposite score controller and are return to the ultrasonic emitter and detector 2169 in order to determine the distance between goal assemblies. As mentioned previously, a wireless transmitter (not shown) may be provided on the scoring monitor in order to facilitate a wireless connection between the scoring monitor 2168, a device running the game app and the internet.

The many elements provided with the score controller 2168 may be used in conjunction with an internet enabled device using the game app in order to enable competitive play, such as in tournaments. The disclosed game may be played as a "physical virtual" game, having players physically playing at their own location, but competing virtually with players from anywhere the world using the internet. For example, this "physical virtual" game may enable players from different countries, such as the United State, Japan, Germany, China, etc. to play in the same tournament. To maintain a fair playing field, such tournaments may choose to implement a 24-hour window to complete a set-time limit game, such that players around the world will not be forced participate at the exact same time. Each score controller 2168 may have a unique ID code that differentiates it from all other score controllers 2168. It may be possible to input this unique ID code into the game app on a device to allow for players, spectators, and judges from anywhere in the world to see and hear from the perspective of the specific score controller 2168. Usage of this unique score controller ID code will make the viewing of aforementioned "physical virtual" game easy and straightforward for players, spectators, and judges alike. The viewing camera 2147*a* may be used not only to provide a unique view from the perspective of the target loop to spectators but may also assist judges in adjusting awarded point values, such as in the event of points being mistakenly awarded by the vibration sensor triggering from the flying disc 2101*a* colliding with the goal post or in the event rule infractions (player throws from beyond allowable play area, etc.). These point value adjustments may be used in conjunction with the already implemented tracked scoring for each player using an electronic tag 2171 to provide a streamlined and efficient scoring procedure for tournaments and other types of play. The microphone 2164, in addition to providing viewers using the game app with gameplay sound, may provide the players with an easy method of communication with tournament staff if needed. "Physical virtual" play aspects, including the uploading/streaming of video and audio footage and scoring data during play, may be implemented on any goal assembly having the proper score controller elements. For example, a previously described multiple goal assembly courses may be used for a "physical virtual" tournament, with each viewing camera 2147*a* on each score controller 2168 streaming the gameplay of any player that uses them to the internet. The score controllers 2168 of said multiple goal assembly courses may implement a fully automated score keeping system to simplify their usage, as described herein.

As described previously, the usage of electronic tags 2171 on the flying disc and electronic tag readers 2170 on the score controller 2168, when used in conjunction with the unique ID codes of each scoring monitor 2168, may allow for allow for a fully automated score keeping system with minimal effort from the players. In a provided set, each player may be provided with one or more flying discs 2101, each flying disc 2101 having an identical electronic tag that is different from those provided in other sets. This will result in each set of flying discs being uniquely indefinable, much like the score controllers with unique ID codes. A player may register this unique set of electronic tags from their set of flying discs within the game app. As a result, the game app may be configured to determine which player has scored in any scoring portal on any score monitor anywhere in the world. This may allow for a completely automated score keeping procedure which may streamline scoring during both casual and competitive play.

A multiple goal assembly course having 18 goal assemblies may be available for use at a play location. This 18-goal assembly course may be fitted with NFC tag readers and/or RFID tag readers on each of its score controllers and utilize permanent goal mounts. A player with a device having a game application may configure said device to automatically keep track of a player's score for the 18-goal assembly course by communicating with the score controllers on each goal assembly. A player having a flying disc with a unique NFC tag and the device with the game app installed on it would begin the course at a first goal assembly by throwing said flying disc at the target loop of said first goal assembly and scoring a certain number of points. The score controller on the first goal assembly would then communicate with the player's device, as a result of it recognizing the player's unique NFC tag, and record the score for the first goal assembly within the game app. The player may then continue this process, throwing their flying disc at each goal assembly following a predefined sequence, while the game app continually records the player's score for each goal assembly, as well as a total score throughout the 18-goal assembly course. After the player throws the flying disc at the $18^{th}$ goal assembly, the game app will record the player's score for said 18th goal assembly and display the player's final score for the entire 18 goal assembly course. This automatic score keeping process of starting score recording on a first goal assembly, continually score recording for each sequential goal assembly and stopping score recording after a final goal assembly has been scored on may be applied to any multiple goal assembly course as a convenient feature for players. The game app may also be configured to accept payment digitally for use of a course, further simplifying the use of the course. Additionally, a player may make a reservation or set a "tee time" to use a multiple goal assembly course at a specific time, which also may be scheduled through the game app. The ability of the game app to coordinate with the score controllers of the multiple goal assembly course to allow for automatic score keeping, digital payment and tee time scheduling helps provide players with a simple and convenient playing experience.

The game app configured for use with the hereinabove disclosed score controllers may provide a large array of functionalities that may enhance the experiences of both the viewers and players. As discussed above, the game app may be configured to prevent gameplay in the event that the provided distance verification device does not register the proper distance, resulting in the game clock 2146*b* not starting and the score sensors not registering any scoring, effectively preventing the score controller 2168 from "going live" until the proper distance between two goal assemblies is confirmed. Electronic score keeping enabled by the app may allow for a streamlined experience which limits the amount of time and effort required to keep score, which may be useful for players and judge alike. Usage of the aforementioned unique ID codes on each score controller within the app may make it easy for spectators, players and judges to sync their game app with that score controller to quickly and easily watch instant replays or live footage from an attached viewing camera, which may be particularly helpful for players or judges trying to verify points registered by the vibration sensor, as discussed previously. The game app may also connect with the internet and create a leaderboard of player scores within a particular tournament, so that players may see where they rank with the other competitors in the tournament.

As discussed, a multiple goal assembly course comprised of a plurality of goal assemblies may be established at a play location in order to provide a place for players to play the disclosed game without a need for them to purchase a game set for personal use. A proprietor for a multiple goal assembly course may establish said course using the steps listed hereinbelow: providing a play space, providing a plurality of goal assemblies within said play space and allowing players to access the play space and use the plurality of goal assemblies. Additional steps, including providing a platform for players to schedule a play time for use of said play space, allowing said player to access the play space and use the multiple goal assembly course at the scheduled time and accepting payment from said player through said platform may also be implemented. The platform used by players to make payments and schedule their play time or "tee time" may be a game app available to players on a smart device such as a smartphone that communicates with the internet. Players may pay for use of the course electronically through the previously described platform or in person upon reaching the play space. Alternatively, a multiple goal assembly course may be provided in a public place, such as a public park, and be available for public use, without requiring players to pay for or schedule their usage of the course. The proprietor may also provide various instructional elements for play, such as providing a required sequence to complete the provided goal assemblies or providing a shot time in which the player must complete each provided goal. As discussed prior, providing a sequence to use the available goal assemblies may be necessary to enable automated score keeping, in the absence of certain automation enabling technologies, such as RFID/NFC readers and tags. The play space may be provided as an indoor play space, such as a play arena, gymnasium, or other type of indoor facility. The play space may alternatively be located outdoors, in open outdoor area such as a public park or amusement part, or within a fenced enclosure. The multiple goal assembly course provided at the play space may have 9, 18, or 27 goal assemblies as described previously. Each goal assembly of the multiple goal assembly course may be different to provide a unique play experience for each goal, and each goal assembly may be provided as a permanent or temporary goal assembly, depending on if the proprietor wants to change one or more of the goal assemblies periodically to provide a varied play experience. Each goal assembly of the plurality of goal assemblies in the multiple goal assembly course may have comparable elements to other goal assemblies described herein, having a goal mount, target loop and score controller attached to each other accordingly that perform their herein described functions.

For example, the first goal assembly or "hole" of a multiple goal assembly course may look like the goal assembly from FIG. 9, with a singular target loop 914 having three scoring portals. A score controller may be provided on the target loop of this first goal assembly, as well as for every target loop of the herein described example in order to provide automated score keeping services as described previously. After a player scores in the first goal assembly, the score controller on the first goal assembly may communicate wirelessly with a player's game application enabled device to provide them with their score for the first "hole". The player may then proceed to the second goal assembly, which may look like the goal assembly of FIG. 12, but with score controllers positioned on the goal assembly to enable score keeping for each scoring portal. After scoring in the second goal assembly, the game app may again be updated to provide the player with their score for the second "hole", as well as their total score. This process may repeat for each sequential goal assembly until the final goal assembly, which may look like the goal assembly of FIG. 15, is scored in. After this, the game app may provide the player with their final score, and upload said final score to a leaderboard, if configured to do so, such as in tournament play. Viewing cameras provided on each of the score controllers of each of the goal assemblies may provide video footage of the player during play, for both entertainment and rule verification purposes. Video footage of competitive play recorded at said multiple goal assembly course may be streamed for viewing on a televised network, such as ESPN, or an internet based streaming platform, such as Twitch.

Figure 22:
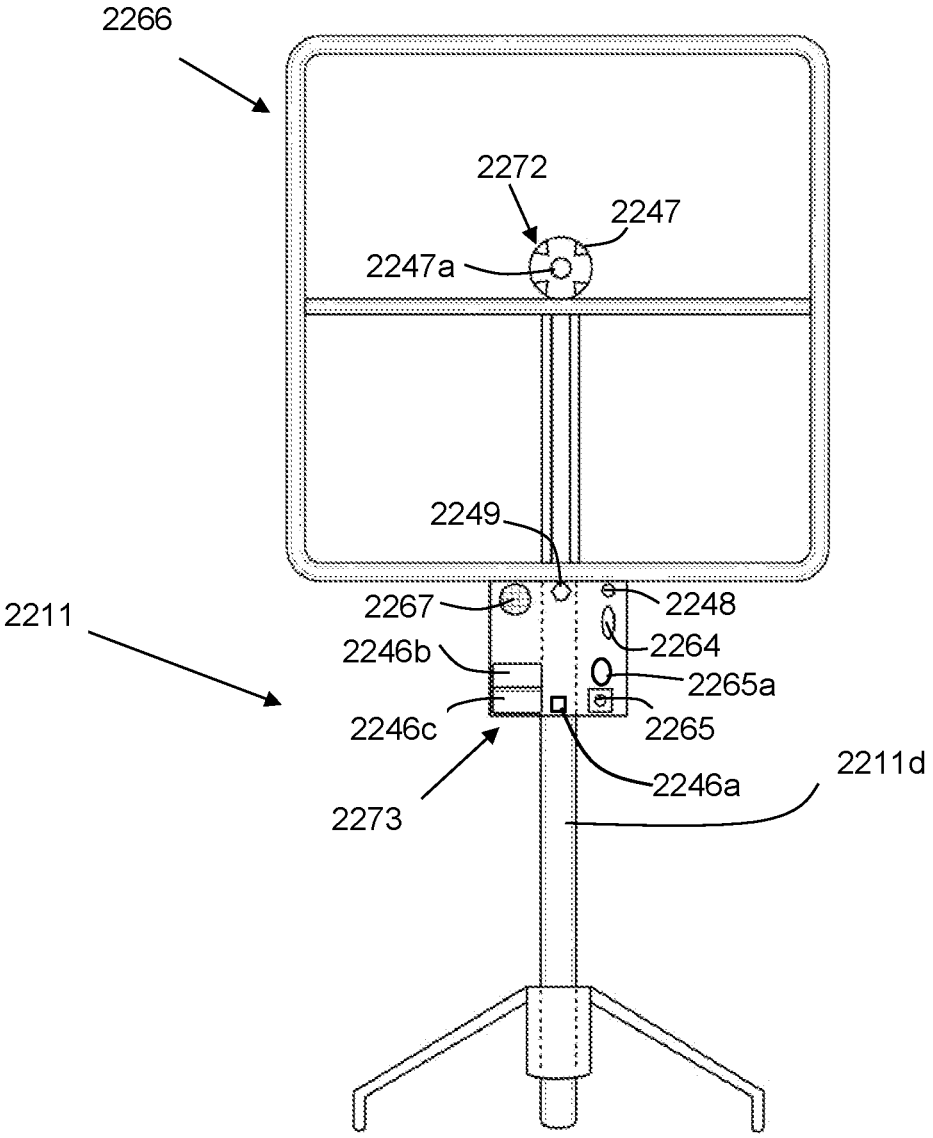
FIG. 22 illustrates the front view of a goal assembly with two attached score controller units: one main score controller and one auxiliary score controller, according to an aspect.

FIG. 22 illustrates the front view of a goal assembly with two attached score controller units: one main score controller 2272 and one auxiliary score controller 2273, according to an aspect. Due to the large variety of elements that may be provided on a score controller, it may become necessary to provide an additional score controller housing that is not located within the scoring loop to prevent unnecessary blockage of the provided scoring portal(s). As such, a score controller as shown previously may be divided into separate score controller units, including a main score controller 2272 and an auxiliary score controller 2273. The main score controller 2272 may continue to be positioned within the target loop 2266 and may hold a viewing camera 2247*a* and any needed score sensors 2247. The viewing camera 2247*a* and score sensors 2247 may need to be positioned within the target loop 2272 in order to retain the desired functionalities as described previously. In contrast to the viewing camera 2247*a* and score sensors 2247, many of the elements of a score controller do not need to be positioned within the target loop to function properly. For housing these components, an auxiliary score controller 2273 may be provided on the goal mount 2211. Elements that may be included on said auxiliary score controller 2273 are a time clock 2246*b*, a scoreboard 2246*c*, a score buzzer 2249, a score indicator light 2248, a battery pack (not shown), a loudspeaker 2267, a microphone 2264, a spacing laser emitter 2265 and a spacing laser receiver 2265*a*, a vibration sensor 2246*a* and a wireless transmitter (not shown). The elements on the auxiliary score controller 2273 may retain their necessary functionality as described hereinabove, without being located within the target loop 2266. The proximity of the auxiliary score controller to the target loop 2266 may allow elements such as the vibration sensor 2246*a* to be able to detect vibrations at the target loop 2266 without being located within it. The main score controller 2272 may communicate with the auxiliary score controller 2273 through an attached wire (not shown) or an additional wireless transmitter (not shown) may be provided on the main score controller 2272 in order to enable communication between the main score controller 2272, auxiliary score controller 2273 and external wireless devices, such as a smartphones or other Wi-Fi or Bluetooth enabled devices. The same may be said for a provided energy source; an energy source such as a rechargeable battery (not shown) may be provided on each score controller unit, or simply on one score controller unit with a power wire running between the score controller units. Wireless power transfer devices, comparable to those known in the industry, may be implemented on the main score controller 2272 and auxiliary score controller 2273 to wirelessly transfer power between the two score controller units. The usage of a smaller main score controller 2272 within the target loop 2266, and an auxiliary score controller 2273 on the goal mount 2211 helps to prevent the unintended blockage of the scoring portals of a target loop 2266, while still providing the score controller elements that may be needed in order to facilitate enhanced or competitive play.

As discussed previously, the goal assembly depicted in FIG. 22 may include only a singular score indicator light 2248 and provide scoring differentiation information using the provided scoreboard 2246*c*. For example, upon a player scoring within a particular scoring portal that awards two points, the player may be notified of receiving these two points by a flashing light from the score indicator light 2248, a noise from the score buzzer 2249, and a "two points" notification from the scoreboard 2246*c*, followed by displaying of the player's total score on the scoreboard 2246*c*. Through such a method, the scoreboard may be configured to emit alerts, which may be unique alerts based on the scoring configuration and therefore useful for score keeping purposes. This may simplify the score controller assembly somewhat by replacing the need for other potential elements, such as additional score indicator lights 2248. This scoreboard 2246*c* may also be synchronized with the game app to provide simultaneous scoring information to other players, viewers, and judges all around the world through the game app, such as displaying competing players scores on a different player's scoreboard 2246*c*.

Figure 23A:
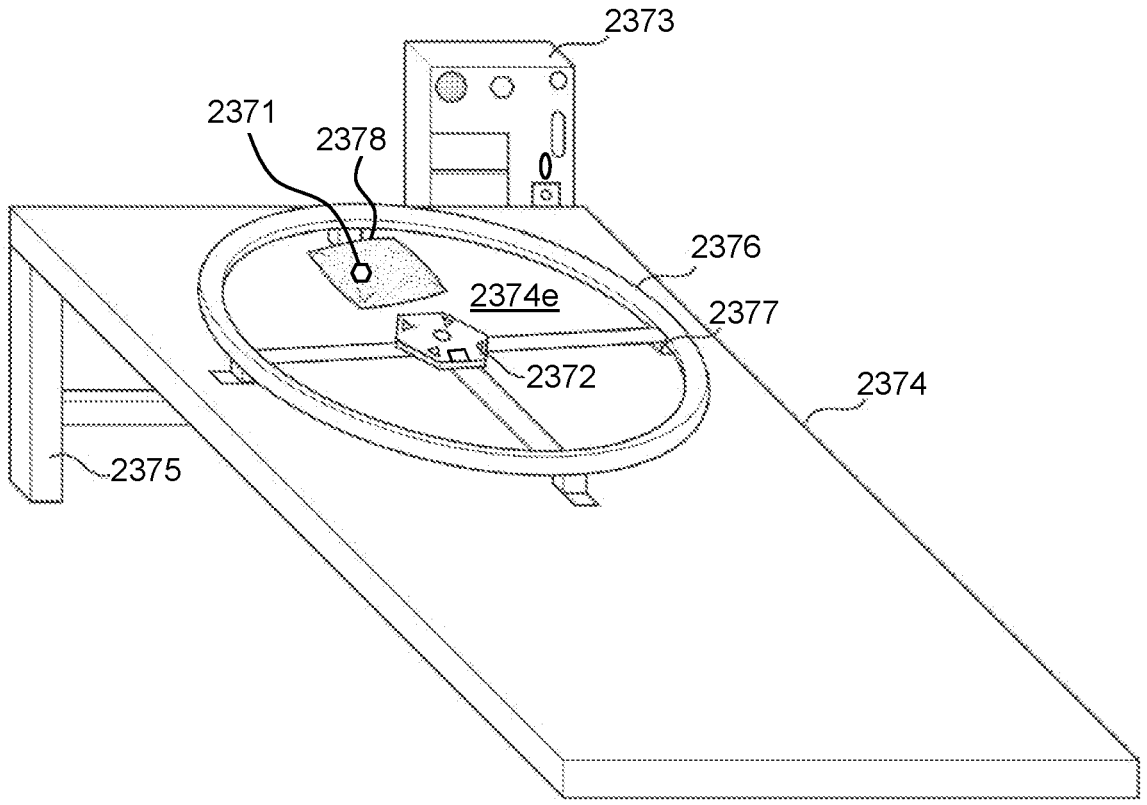
FIG. 23A illustrates the front perspective view of a bean bag scoring in a target loop of a game board based goal assembly, according to an aspect.
Figure 23B:
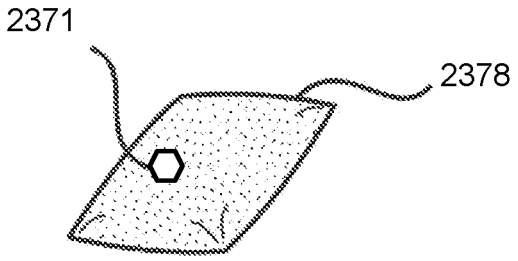
FIG. 23B illustrates the front perspective view of a bean bag having an electronic tag, according to an aspect.

FIG. 23A illustrates the front perspective view of a bean bag 2378 scoring in a target loop 2376 of a game board 2374 based goal assembly, according to an aspect. FIG. 23B illustrates the front perspective view of a bean bag 2378 having an electronic tag 2371, according to an aspect. While the above disclosed versions of the provided goal assemblies used a goal post as part of the goal mount assembly, target loops 2376 and score controllers may also be fit to alternatively designed goal mounts, such as a game board 2374. When using a game board 2374 as a goal mount, it may become necessary to also alter the type of propellable object used, such as using a bean bag 2378, weighted sack or other compatible propellable object, instead of the flying disc used previously, as scoring on a target loop 2376 that is almost parallel with the ground as depicted in FIG. 23A using a flying disc may prove too difficult for some players. The bean bag 2378 may be comprised of a transparent plastic outer case containing sand, a plurality of plastic pellets, or another weighted material, while said plastic elements may be plant-based bioplastic resins that are biodegradable, compostable, sustainable and renewable. Depending on the type of score sensors provided, it may also be necessary to include an electronic tag 2371 within or otherwise attached to the bean bag 2378, such as an NFC tag or RFID tag to be read by NCF tag readers or RFID tag readers as score sensors on a score controller, respectively. Providing certain elements, such as the target loop 2376 and bean bag elements in a glow in the dark material may enable play in the dark, similarly to how it did for providing the previous target loops and flying discs in glow in the dark materials did.

The goal assembly depicted in FIG. 23A uses a main score controller 2372 located within the target loop and an auxiliary score controller 2373 mounted to the game board 2374, but may also use alternatively described score controllers, including those detailed previously, such as a singular unit score controller 2168 described in FIG. 21. The main score controller 2372 may contain score sensor(s), a vibration sensor and a viewing camera. Said score sensor(s) should be provided in a form that is compatible with a provided thrown object. For example, the score sensors may be provided as NFC tag readers when using a bean bag 2378 containing an NFC tag as the propellable object. The viewing camera may retain its previously listed functionalities regardless of the style of goal mount used, providing a unique view from the perspective of the target loop to be streamed to devices through the internet using the game app, for the purposes of spectating, player positioning verification and score confirmation. The auxiliary score controller 2373 may be attached to the game board 2374 in a location that allows it to be visible to players, but without obstructing the target loop 2376. Said auxiliary score controller 2373 may contain any score controller element that does not need to be positioned within the target loop, including a microphone, distance verification device, scoreboard, game clock, loudspeaker, score buzzer and score indicator light(s). Much like the score controller elements on the main score controller 2372, these score controller elements on the auxiliary score controller 2373 may also retain their prior disclosed functionality, as none of these functionalities are dependent upon the goal mount having goal post.

The game board 2374 may be comprised of a body portion, such as a rectangular board, with a foldable angling leg 2375 on one of its ends, such that the game board 2374 may be angled when the foldable angling leg 2375 is locked in its operational position, as depicted in FIG. 23A, making it easier to score in an attached target loop 2376 than if the board were laying parallel with the ground. The foldable angling leg 2375 may also be folded into a stored position in which it lay parallel with the game board 2374 surface. The body portion may have a target hole 2374*e* through it that is positioned coaxially with and is the same size as an attached superjacent target loop 2376, such that an object that travels through a scoring portal on the target loop 2376 will also travels through the target hole 2374*e* in the game board 2374. The game board 2374 may be composed of a wood, plastic, metal, such as aluminum or other suitable lightweight material. A basic version of the game board 2374 may be provided through the omission certain elements, potentially providing a game board 2374 having a body portion, a target hole 2374*e* in the body portion and one or more target holders on the body portion arranged around the perimeter of the target hole 2374*e*, such that the solid outer portion of an attached target loop may encompass the perimeter of the target hole 2374*e*.

Figure 24A:
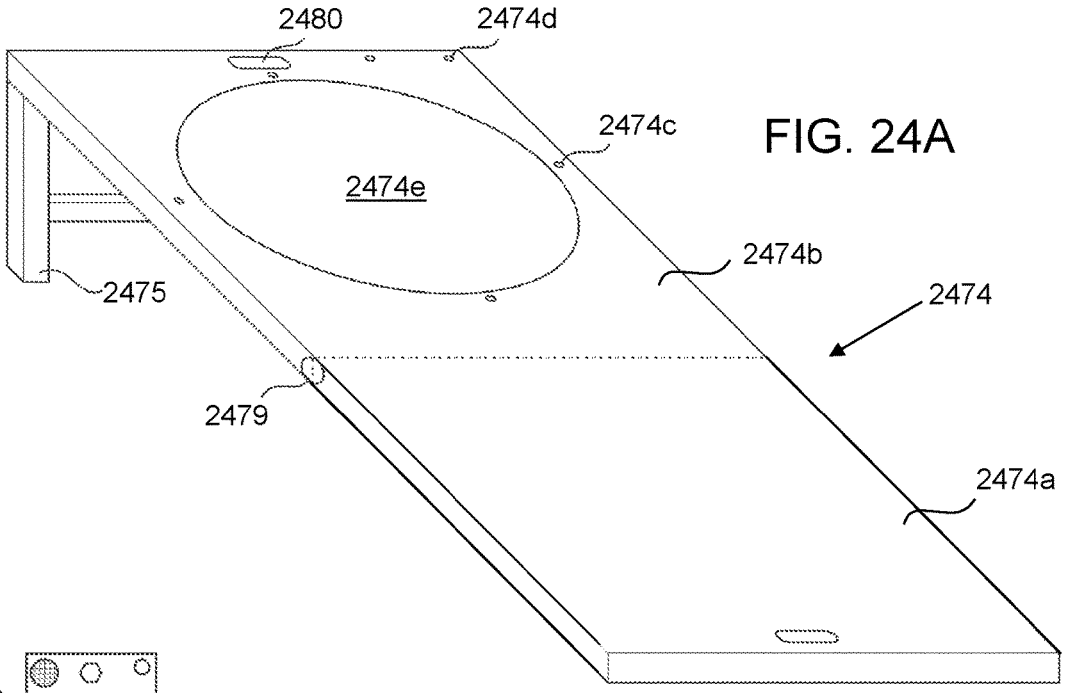
FIG. 24A illustrates the front perspective view of a game board configured to hold a target loop and a score controller, according to an aspect.

FIG. 24A illustrates the front perspective view of a game board 2474 configured to hold a target loop and a score controller, according to an aspect. The game board 2347 disclosed in FIG. 23 may be provided with numerous features to properly house the various goal assembly elements, as well as enhance the goal assembly's functionality. A folding hinge 2479 may be provided on the game board 2474 to allow for the game board 2474 to be folded for storage or goal assembly alteration purposes. This folding hinge 2479 may be placed on a central portion of the game board and divide the game board into a lower portion 2474*a* and an upper portion 2474*b*. A plurality of target loop mounting ports 2474*c* may be provided around the perimeter of a target hole 2474*e* in the upper portion of the game board 2474 in order to allow for the securing of a target loop to the game board 2474 at the appropriate location. These target loop mounting ports may act as target holders and function comparably to other target holders described hereinabove. A plurality of auxiliary score controller mounting ports 2474*d* may be provided on the upper portion 2474*b* of the game board 2474, such that an implemented auxiliary score controller may be positioned in a location that is visible to the players but does not obstruct an attached target loop during use. One or more handles 2480 may be provided on the game board 2474 in order to facilitate easy movement of the game board 2474, potentially while it is folded into its stored configuration.

Figure 24B:
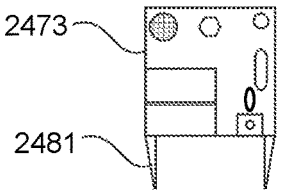
FIG. 24B illustrates the front view of an auxiliary score controller adapted to attach to a game board, according to an aspect.
Figure 24C:
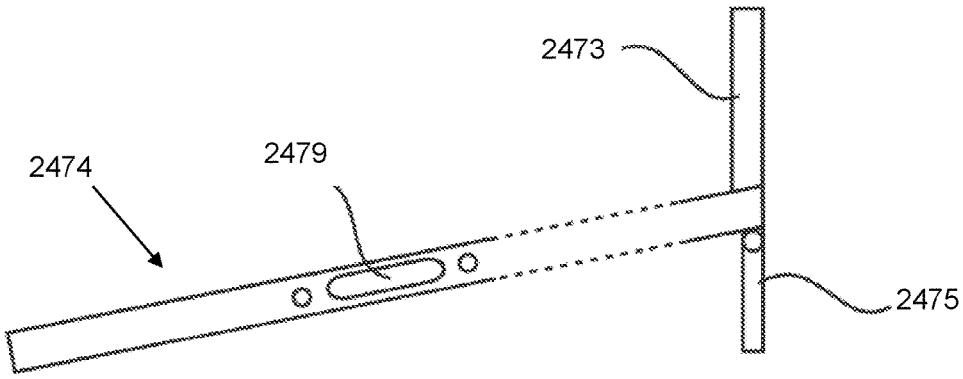
FIG. 24C illustrates the side view of a game board with an attached auxiliary score controller, according to an aspect.

FIG. 24B illustrates the front view of an auxiliary score controller 2473 adapted to attach to a game board, according to an aspect. FIG. 24C illustrates the side view of a game board 2474 with an attached auxiliary score controller 2473, according to an aspect. The auxiliary score controller 2473 may connect to the game board 2474 through insertion of a plurality of auxiliary score controller mounting cones 2481 on the auxiliary score controller 2473 into the plurality of auxiliary score controller mounting ports 2474*d* on the game board 2747, such that each mounting cone 2481 is inserted into a different mounting port 2474*d*. This fitting of the auxiliary score controller 2473 to the game board 2747 goal mount may be modified similarly to the attachment of a target loop to a goal post, depending on the requirements of the application. The positioning of the auxiliary score controller mounting ports 2464*d* may be such that upon attachment of the auxiliary score controller 2473 to the game board 2474, the auxiliary score controller 2473 is positioned on the upper portion 2474*b* of the game board. The foldable angling leg 2475 may also be positioned on the upper portion 2474*b* of the game board as depicted in FIG. 24C.

Figure 24D:
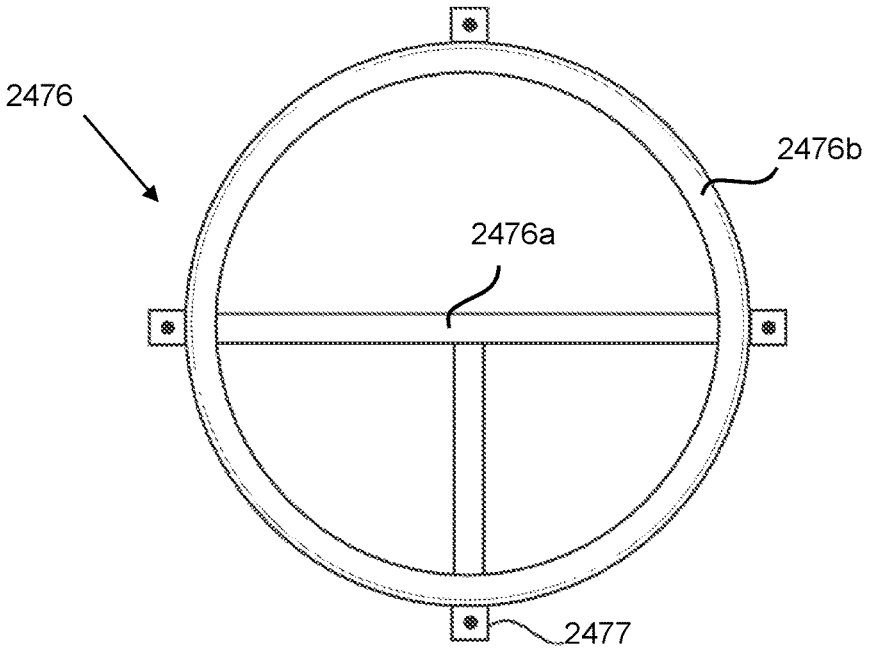
FIG. 24D illustrates the front view of a target loop adapted to attach to a game board, according to an aspect.
Figure 24E:
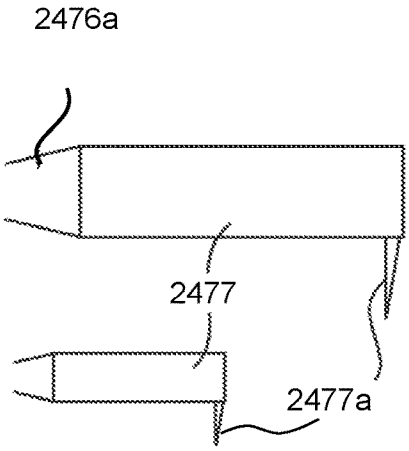
FIG. 24E illustrates the side view of a mounting cap attached to target loop cone, according to an aspect.
Figure 24F:
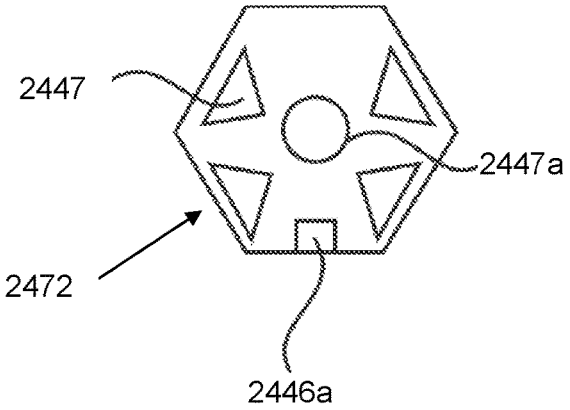
FIG. 24F illustrates the front view of a main score controller adapted to attach to a target loop, according to an aspect.

FIG. 24D illustrates the front view of a target loop 2476 adapted to attach to a game board 2474, according to an aspect. FIG. 24E illustrates the side view of a mounting cap 2477 attached to target loop cone 2477*a*, according to an aspect. FIG. 24F illustrates the front view of a main score controller 2472 adapted to attach to a target loop 2476, according to an aspect. The provided target loop 2476 may have a target loop divider 2476*a* that separates the target loop 2476 into a plurality of scoring portals, much like the docking mount present on previously described target loops. Unlike the previously described target loops used with goal post-based goal mounts, the target loop 2476 used with the herein described game board-based goal mount may attach to it using a plurality of target loop cones 2477*a* positioned around and attached to the periphery of the target loop 2476 by mounting caps 2477. These mounting caps 2477 may attach to the target loop divider 2476*a* or the target loop surface 2476*b*. The target loop 2476 may attach the game board 2474 through insertion of each target loop cone 2477*a* into a different target loop mounting port 2474*c* on the game board 2474, resulting in the solid outer portion of the target loop 2376 encompassing the perimeter of the target hole 2374*e*. While the depicted target loop 2476 may have four target loop cones 2477*a*, variations to the number target loop cones 2477*a* and the number of target loop mounting ports 2474*c* in the game board 2474 may be made accordingly as needed. The mounting caps 2477 and their attached target loop cones 2477*a* may acts as a mounting portion on the target loop 2476 and said elements may be varied in much the same way as the mounting portion on other target loops described prior, and thus may be provided with friction bumps, in alternative forms such as threaded shafts, or any other form that suitably attaches the target loop 2476 to the game board 2474 goal mount. The main score controller 2472 may contain score controller elements that need to be located within the target loop, such as the viewing camera 2447*a*, vibration sensor 2446*a* and the score sensor(s) 2447 and will be discussed in greater detail hereinbelow.

Figure 25A:
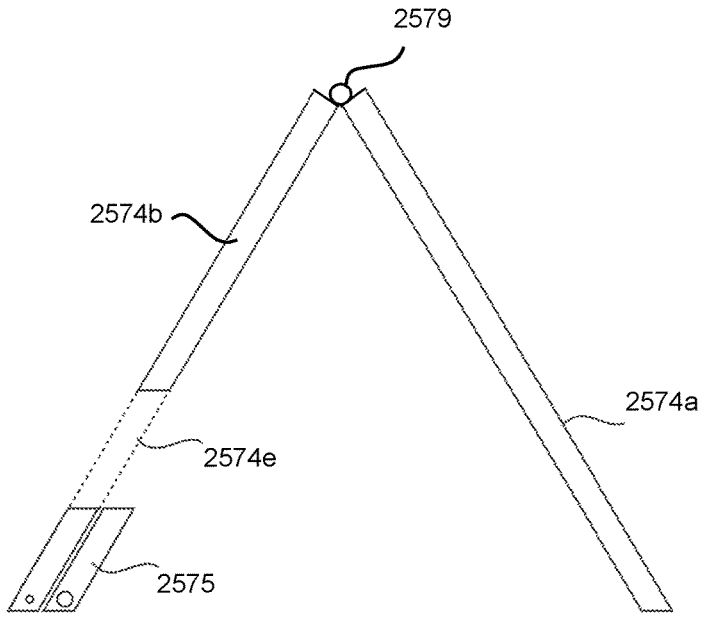
FIG. 25A illustrates the side view of a game board folded into an upright orientation, according to an aspect.
Figure 25B:
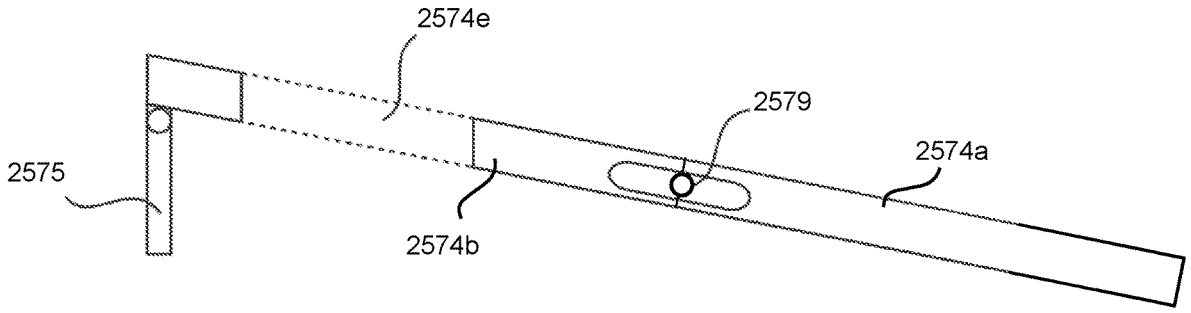
FIG. 25B illustrates the side view of a game board unfolded into a laying orientation, according to an aspect.

FIG. 25A illustrates the side view of a game board 2574 folded into an upright orientation, according to an aspect. FIG. 25B illustrates the side view of a game board 2574 unfolded into a laying orientation, according to an aspect. In addition to the folding hinge 2579 included on the game board 2574 goal mount providing the benefit of optimizing its storage dimensions, the folding hinge 2579 may also be used to alter the goal assembly during play. The game board 2574 may be set up for play by arranging it in the laying orientation as depicted in FIG. 25B, much like how it has been depicted in previous figures, or in an upright orientation as depicted in FIG. 25A. While in game board 2574 is folded in the upright position or fully folded for storage, the foldable angling leg 2575 may be positioned is its stored position as depicted in FIG. 25A. While the game board 2574 is in its upright position, the target loop is almost vertically oriented (almost perpendicular to the ground), making it similar to the target loops attached to goal posts depicted in previous goal assemblies. This alteration to a more vertically oriented goal assembly may allow previously disclosed propellable objects, such as flying discs, to be scored with more easily in this goal assembly. As such, a game set may include both flying discs and bean bags as propellable objects, or similar flying and weighted objects, if the provided goal mount is capable of allowing a player to score using both types of propellable objects through its different potential configurations.

Figure 26A:
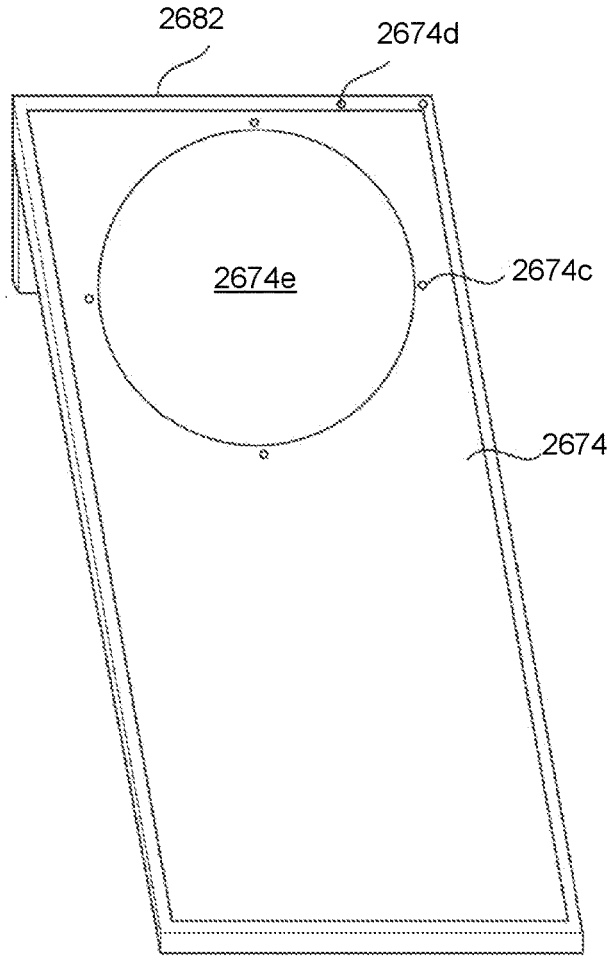
FIG. 26A illustrates the front view of a game board goal mount having a glow in the dark game board border, according to an aspect.
Figure 26B:
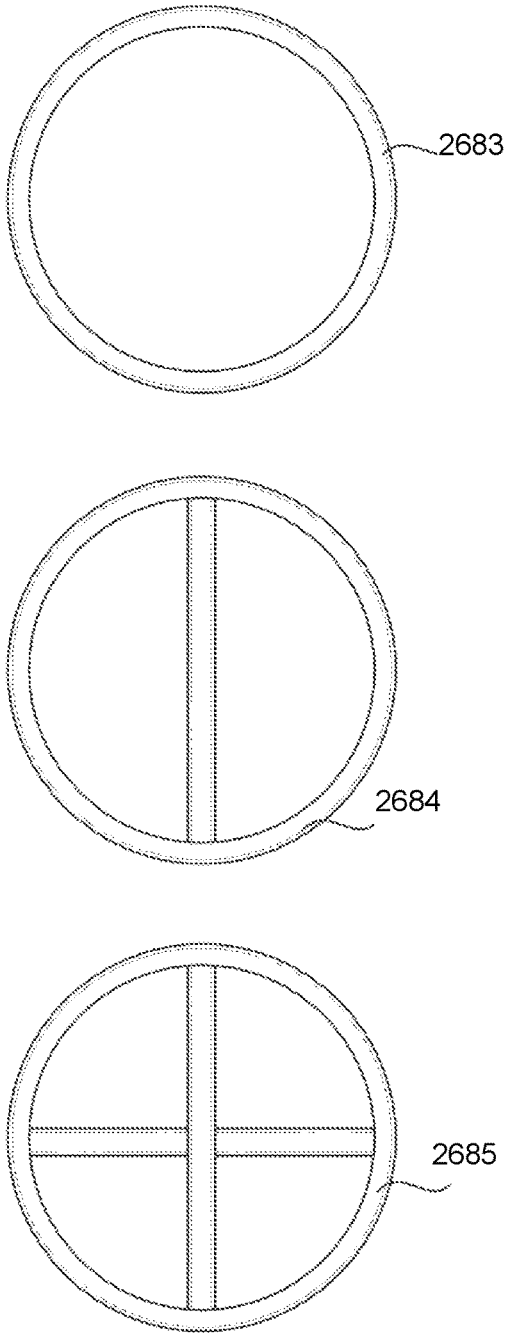
FIG. 26B illustrates the front view of three potential target loop variations for use with a game board-based goal assembly, according to an aspect.

FIG. 26A illustrates the front view of a game board 2674 goal mount having a glow in the dark game board border 2682, according to an aspect. FIG. 26B illustrates the front view of three potential target loop variations for use with a game board-based goal assembly, according to an aspect. Providing a game board border 2682 in a glow in the dark material around the perimeter of the game board 2675 may help enable play in the dark when used in conjunction with a glow in the dark target loop, as all pertinent goal elements, including the perimeter of the game board 2675 and the target loop itself, can be made visible to players in the dark using a UV light source. In addition to providing a perimeter around the game board 2675, the game board boarder 2682 may also be configured to allow a propellable object that is capable of rolling, such as a ball, to roll back to the player, to allow them to toss it again. For example, if the player is standing close to the game board while playing, and the propellable object is capable of rolling, a game board boarder 2682 that provides raised walls around the perimeter of game board 2675 may prevent said propellable object from rolling off the game board 2675 after it is thrown. This would allow the player to easily retrieve the propellable object from the game board 2675, as the angle of the game board 2675 will result in the propellable object being retained by a lower portion of the game board boarder 2682. The game board boarder 2682 may also be made of a material that does not glow in the dark when used in applications that do not require this feature.

In order to further accommodate the difficulty adjustment needs of the player(s), the target loops may be provided in a variety of forms, including a one scoring portal target loop 2683, a two scoring portal target loop 2684, and a four scoring portal target loop 2685. One may suitably use additional configurations, including the three scoring portal target loop 2476 depicted in FIG. 24D, as long as the provided propellable object may fit through each formed scoring portal. Other adjustments comparable to those possible with the goal-post based goal assemblies may applied to a game board-based goal assembly, such as having different sized target loops (as well as an accordingly sized, subjacent target hole), different sized propellable objects, and different set throwing distances, amongst other variations discussed prior. Other alterations, including using glow in the dark materials to make the target loop, bean bag or other propellable object, and other pertinent elements visible in the dark may also be used to enhance the gameplay experience, as they have done for previously described goal assemblies.

Figure 27A:
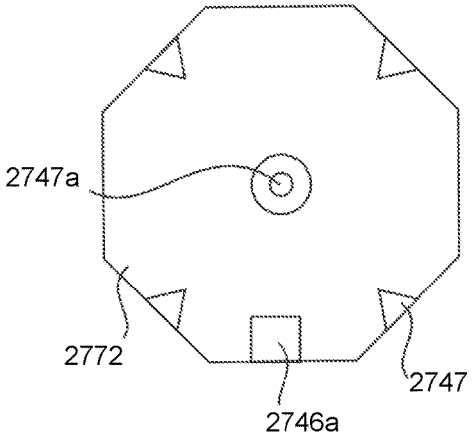
FIG. 27A illustrates the front view of a main score controller, according to an aspect.
Figure 27B:
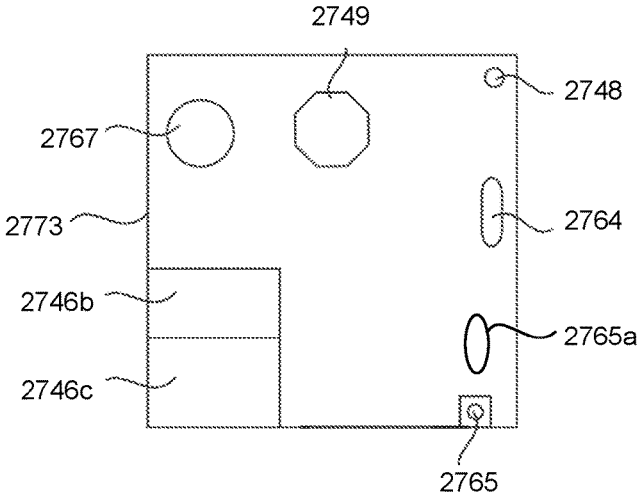
FIG. 27B illustrates the front view of an auxiliary score controller, according to an aspect.
Figure 27C:
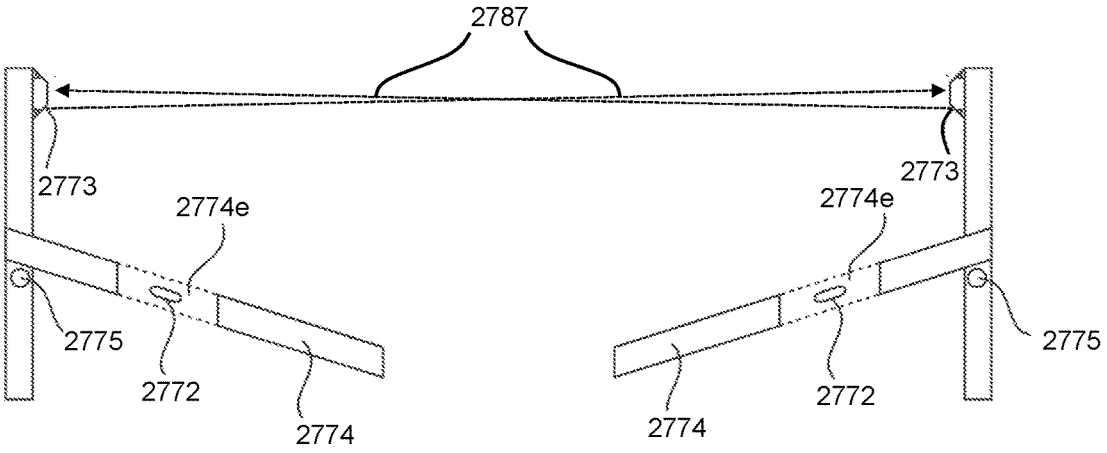
FIG. 27C illustrates the side view of two game board-based goal assemblies electronically interfacing with each other using distance verification devices on each goal assembly, according to an aspect.

FIG. 27A illustrates the front view of a main score controller 2772, according to an aspect. FIG. 27B illustrates the front view of an auxiliary score controller 2773, according to an aspect. FIG. 27C illustrates the side view of two game board-based goal assemblies electronically interfacing with each other using spacing lasers on each goal assembly, according to an aspect. As described hereinabove, the usage of the two separate score controller units may be useful in minimizing the amount of space taken up within an attached target loop. By providing a minimally sized main scoring portal 2772 containing only the score controller elements that need to be in the target loop and an auxiliary score controller 2773 having all other needed score controller elements located elsewhere, the probability of the main score controller being directly impacted by a propellable object may be reduced. The essential score controller elements depicted on the main score controller 2772 of FIG. 27A may include a viewing camera 2747*a*, at least one score sensor 2747 for each scoring portal and a vibration sensor 2746*a*. All main score controller elements need to be positioned within (or appropriately close) to the installed target loop in order to provide their desired functionalities including automated score keeping and providing footage for spectators using the game app.

Conversely, all other score controller elements may be provided on an auxiliary score controller 2773 provided elsewhere on the goal assembly. This auxiliary score controller 2773 as depicted in FIG. 27B may include a scoreboard 2746*c*, a game clock 2746*b*, a microphone 2764, a score buzzer 2749, a loudspeaker 2767, a distance verification device, such as a spacing laser emitter 2765 and spacing laser receiver 2765*a*, and a score indicator light 2748. This auxiliary score controller 2773 must also be in an appropriate location to enable proper functionality of all included elements. For example, an auxiliary score controller 2773 having a distance verification device may need to have its auxiliary score controller positioned in such a way that the included distance verification device may be suitably aligned with another distance verification device on another auxiliary score controller. The spacing laser emitter 2765 from a first auxiliary score controller may emit a laser that is received by a spacing laser receiver 2765*a* on a second auxiliary controller, as the spacing laser emitter 2765 from the second auxiliary score controller emits a laser that is received by a spacing laser receiver 2765*a* on the first auxiliary score controller. This interaction described above and depicted by the included laser trails 2787 may be necessary for a two goal assembly setup, such as the one depicted in FIG. 27C, as it may be used to establish a desired distance between the two goal assemblies, similarly to the previously listed two goal assembly set of FIG. 19B. This distance may be used to establish an allowable play area for players, such as behind or beside one of the goal assemblies, when throwing or otherwise propelling an object to score on the other goal assembly. Establishing this allowable play area for players to stand while scoring may become exceptionally pertinent if these two goal assembly sets are being used by players in tournaments or other prize awarding competitions. Alternative distance verification devices may also be employed in addition to, or instead of the spacing laser emitter 2765 and spacing laser receiver 2765*a*, such as the aforementioned ultrasonic emitter and detector 2169 depicted in FIG. 21, or any other distance verifying device known in the industry, including those that utilize sound waves or light reflection techniques.

As described hereinabove, two goal assembly setups for game board-based goal assemblies may be established by properly aligning two distance verification devices on two different game board-based goal assemblies, similarly to the two goal assembly setup for goal post-based goal assemblies depicted in FIG. 19B. As such, a competitive set for this game board-based variant of the previously discussed flying disc game may be provided. This competitive set may include a plurality of bean bags, each containing an electronic tag compatible with the score sensors, and two game board-based goal assemblies, each assembly comprising a target loop with at least one scoring portal, a main score controller 2772 comprising a viewing camera 2747*a*, vibration sensor 2746*a* and an appropriately positioned tag reader for each scoring portal, an auxiliary score controller 2773 to house all other required score controller elements not needed on the main score controller, and a game board 2774 configured to attach to the target loop, main score controller 2372 and auxiliary score controller 2373. The attachment of the main score controller 2372 to the game board 2374 may be indirect, having the main score controller 2372 connected directly to the target loop 2372 (and by extension the game board 2374). Variations on this set that may utilize different types of sensors, more or fewer score controller elements, and various other changes already described previously with other goal assemblies and game sets.

The two goal assembly sets may be used for competitive "physical virtual" gameplay set ups, which may interface with a game app on an electronic device, such as a smartphone or other mobile device, in order to enable internet connectivity for the score controller (both the main 2772 and auxiliary score controller 2773 units). The main score controller 2772 and auxiliary score controller 2773 may be connected to each other by a wire, with a wireless transmitter (not shown) included on one of the score controller units, or both the score controller units may be fitted with their own wireless transmitter to facilitate communication between the score controller units and an electronic device using the herein discussed game app. This may be done in the same manner regardless of whether the goal assemblies use a goal post or a game board to mount the target loop and score controller(s). If the two score controller units are connected to each other by wiring, only one wireless transmitter and one power source may be needed.

As discussed previously, the score controller elements may retain their desired functionality with the application regardless of the type of goal mount used. The viewing camera 2747*a* on the main score controller may continue to stream footage of players throwing from the perspective of the target loop, providing a unique viewing angle for spectators viewing gameplay through the game app that also may be used by judges to confirm that the player is standing in an allowable position while playing and otherwise following the established rules. Again, all score controller elements on both score controller units may continue to suitably interface with the game app using the wireless transmitter(s) included. This includes capturing video footage, audio recordings, and scoring information from the score controller using the viewing camera 2747*a*, microphone 2764, score sensor(s) 2747 and vibration sensor 2746*a*, accordingly, and uploading/streaming it to the internet, as well as downloading/streaming scoring and game time information from the internet to display on the scoreboard 2746*c* and game clock 2746*b*, respectively, and audio transmissions from judges or other event officials to play through the loudspeaker 2767. With suitable accommodations, the herein described score controller, as well as its variations and equivalents, may be adapted to fit any goal mount, regardless of its geometry or orientation, allowing for "physical virtual" play of a variety of different game types.

In addition to using a goal post or game board as part of a goal mount assembly, one may choose to vary other aspects of the goal assembly to facilitate different scoring mechanisms based on the propellable object used. One may adapt a goal assembly to be similar to a basketball hoop with a backboard, configured to fit basketballs within its scoring portal(s) that activate score sensors on its provided score monitor. Other adaptations of the goal assemblies may be provided to accept other throwable, kickable or otherwise propellable objects, such as a football target-based goal assemblies configured to be score upon by thrown footballs, and a soccer net-based goal assemblies configured to be scored upon by kicked soccer balls. The herein described target loops and score monitors may be used in almost any type of goal assembly and with almost any propellable object, as long as the propellable object is suitably compatible with the provided goal assembly by being properly sized to fit within the provided scoring portal(s) and capable of being detected doing so. Other types of propellable objects that may have goal assemblies adapted for their use may include various types of balls, including baseballs, ping pong balls, bowling balls, golf balls, tennis balls and racquetballs, as well as other shaped objects like hockey pucks, ring toss rings and horseshoes. Much like the flying discs described previously, all propellable objects may be fitted with electronic tags, such as RFID or NFC tags, in order to allow for the detection mechanism described hereinabove, allowing for automated score keeping with the proper score controller configuration. All target loops, propellable objects and other suitable goal assembly elements may be made of a glow in the dark material, enabling indoor or outdoor play, during the day or night of a wide variety of sports, games and other physical activities. Through appropriate alteration of the herein disclosed goal assemblies, "physical virtual" play of nearly any goal-based game may be possible in a "physical virtual" setup for both casual and competitive players.

Figure 28A:
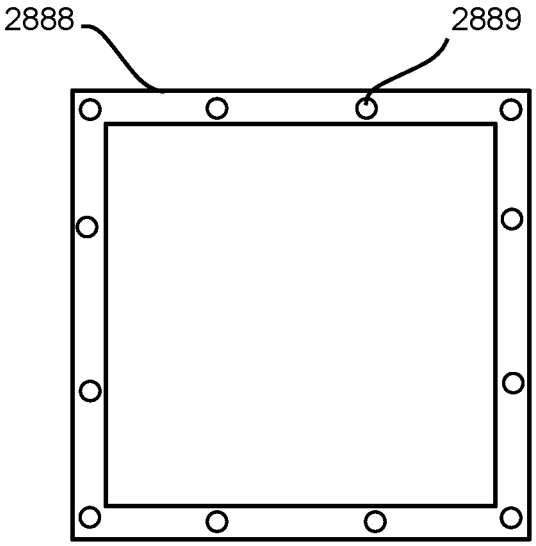
FIG. 28A illustrates the front view of an adjustable target loop having multiple divider ports, according to an aspect.
Figure 28B:
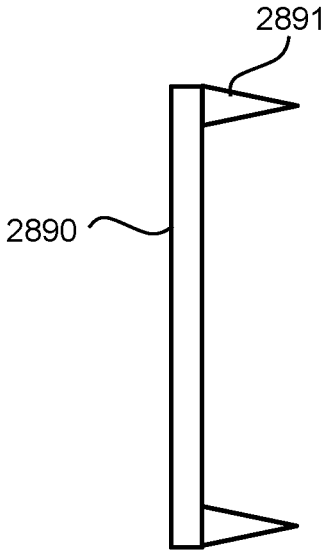
FIG. 28B illustrates the side view of a loop crossbar having tapered crossbar pins, according to an aspect.
Figure 28C:
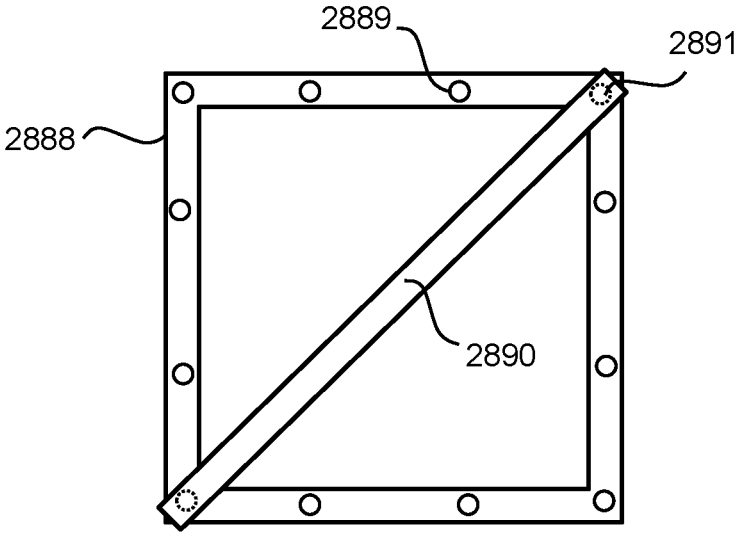
FIG. 28C illustrates the front view of an adjustable target loop assembly having an adjustable target loop with an attached loop crossbar, according to an aspect.

FIG. 28A illustrates the front view of an adjustable target loop 2888 having multiple divider ports 2889, according to an aspect. FIG. 28B illustrates the side view of a loop crossbar 2890 having tapered crossbar pins 2891, according to an aspect. FIG. 28C illustrates the front view of an adjustable target loop assembly having an adjustable target loop 2888 with an attached loop crossbar 2890, according to an aspect. Certain modifications may be applied to a conventional, non-adjustable target loop in order to convert it into an adjustable target loop 2888. One or more divider ports 2889 may be provided on the solid portion of the loop surface of an adjustable target loop 2888, with each divider port 2889 configured to house a tapered crossbar pin 2891 within it. A loop crossbar 2890 having said tapered crossbar pins 2891 may be attached to the adjustable target loop 2888 through the friction fitting of the tapered crossbar pins 2891 into the available divider ports 2889, further dividing the present scoring portal(s). The plurality of divider ports 2889 may be provided on the adjustable target loop 2888 in order to accommodate different potentials positions of loop crossbar 2890, allowing a singular adjustable target loop 2888 and loop crossbar 2890 to be arranged in various ways to create different scoring portal arrangements. For example, an adjustable target loop assembly may be comprised of an adjustable target loop 2888 having a square shape with a loop crossbar 2890 attached to the adjustable target loop 2888 by divider ports 2889 at opposing corners of the square shaped adjustable target loop 2888, forming two triangular scoring portals, as seen in FIG. 28C.

This adjustable target loop assembly may be modified in various ways, including having different shapes of adjustable target loop 2888, quantities and positions of divider ports 2889 and tapered crossbar pins 2891, connection methods, such as having magnets or clips on the adjustable target loop 2888 adapted to hold the loop crossbar 2890 and shapes of loop crossbar 2890 designed to divide the existing scoring portal in different ways. The adjustable target loop assembly described may be used in any goal assembly, including those disclosed hereinabove. The adjustable nature the herein described adjustable target loop assembly may allow a player to create various scoring portal arrangements using only a singular adjustable target loop 2888 and a loop crossbar 2890. Additionally, a game set may include an adjustable target loop with multiple loop crossbars 2890, allowing for different scoring portal configurations to be formed depending on how many loop crossbars 2890 are attached to the adjustable target loop 2888, the shape of said loop crossbars 2890 and how the loop crossbars 2890 are arranged on the adjustable target loop 2888.

Other techniques may be used in order to provide different types of adjustable target loops. A target loop may be provided with locking hinges (not shown) on the loop surface in order to facilitate folding of said target loop. By folding this locking hinge version of the target loop, the shape of the resultant scoring portals may also be modified. For example, a square target loop may have locking hinges on opposite corners of the loop surface, such that upon folding of said target loop, the formed scoring portal is triangular. Other shapes of target loop and positions of locking hinge may be provided in order to allow for the formation of differently shaped scoring portals from differently shaped target loops.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A game set comprising:

a flying disc and a goal assembly, the goal assembly comprising:

a goal mount having:

a base end;

a goal post connected to the base end;

a plurality of target holders on the goal post;

a target loop configured to attach to one of the plurality of target holders, the target loop comprising:

a loop surface having a solid outer portion that surrounds an open middle portion, the open middle portion having at least one distinct opening, wherein each distinct opening within the open middle portion defines a scoring portal;

a docking portion connected to the solid outer portion of the loop surface and configured to connect to one of the plurality of target holders; and a score controller configured to attach to the goal assembly, the score controller having:

at least one score sensor configured to detect the passage of the flying disk through each scoring portal;

a vibration sensor, wherein the vibration sensor is configured to detect the target loop being impacted by the flying disc and wherein the score controller is configured to emit an alert when the score sensor or the vibration sensor is triggered; and wherein the score controller is provided with a unique identification code used to differentiate it from other score controllers.

2. The game set of claim 1, wherein the target loop has a circular shape or square shape.

3. The game set of claim 1, wherein the open middle portion of the target loop is bisected by the goal post, resulting in the formation of at least one additional scoring portal.

4. The game set of claim 1, wherein the docking portion is comprised of a docking mount attached to a docking rod, wherein the docking mount divides the open middle portion into a plurality of scoring portals and wherein the docking rod is configured to securely fit within one target port of a plurality of target ports acting as target holders on the goal mount.

5. The game set of claim 1, wherein the docking portion is comprised of a docking mount attached to a threaded shaft, wherein the docking mount divides the open middle portion into a plurality of scoring portals and wherein the threaded shaft is configured to travel through one target port of the plurality of target ports acting as a target holders on the goal mount and be secured to the goal post using a threaded shaft locking nut.

6. The game set of claim 1, wherein the docking portion is comprised of a docking mount with a central port, wherein the docking mount divides the open middle portion into a plurality of scoring portals and wherein the central port is configured to securely fit one post rods of a plurality of post rods acting as target holders on the goal mount.

7. The game set of claim 4, wherein the docking rod and target ports are fitted with friction bumps configured to provide a more secure fit of the docking rod in the target port.

8. The game set of claim 1, wherein the score controller is configured to produce a unique alert for each score sensor being triggered and a different unique alert for the vibration sensor being triggered.

9. The game set of claim 1, wherein the goal post is comprised of a plurality of separable pipe sections.

10. The game set of claim 1, wherein the goal mount is further comprised of a horizontal mount section disposed between the base end and the goal post and a weight mount attached to the goal mount, wherein the horizontal mount section runs perpendicular to the goal post and base.

11. The game set of claim 1, further comprising a stand unit configured to attach to the goal mount, wherein the stand unit is configured to stabilize the goal mount on surrounding terrain.

12. The game set of claim 1, wherein the base end is a base spike configured to be driven into the ground to stabilize the goal mount.

13. The game set of claim 1, further comprising a base weight attached to the goal mount, wherein additional weight provided by the base weight stabilizes to the goal mount.

14. The game set of claim 1, wherein the score sensors are optics-based sensors.

15. The game set of claim 1, wherein the score sensors are signal-based sensors and wherein the flying disc is further comprised of a signal emitting tag attached to a body portion of the flying disc.

16. The game set of claim 1, the score controller further comprising a wireless transmitter.

17. The game set of claim 16, wherein the wireless transmitter is configured to transmit data between the score controller and an electronic device through the utilization of a game application present on the electronic device and further transmit and receive data through an internet connection.

18. The game set of claim 17, the score controller further comprising a viewing camera configured to capture video data.

19. The game set of claim 18, wherein the captured video data may be presented as live footage or an instant replay on the electronic device.

20. The game set of claim 17, the score controller further comprising a microphone configured to capture audio data.

21. The game set of claim 17, the score controller further comprising a game clock.

22. The game set of claim 17, the score controller further comprising a loudspeaker configured to emit audio data.

23. The game set of claim 17, the score controller further comprising a scoreboard.

24. The game set of claim 17, the score controller further comprising a distance verification device.

25. The game set of claim 1, the score controller further comprising two separate score controller units, a main score controller and an auxiliary score controller.

26. The game set of claim 1, wherein the target loop and flying disc are made of a glow in the dark material.

27. The game set of claim 26, further comprising a glow maintenance lighting source configured to attach to the goal mount to provide UV-light to allow the target loop to maintain a visible level of phosphorescence during use.

28. The game set of claim 27, the glow maintenance lighting source comprising a solar panel, a UV light fixture, a glow photosensor and a battery, wherein said battery is configured to attach to the solar panel, the UV light fixture and the score controller, the goal mount is permanent, the solar panel is configured to harvest solar energy and store said solar energy on the battery and the battery is configured to provide power to the score controller and UV light fixture.

29. The game set of claim 26, further comprising a UV flashlight configured to provide UV light to the target loop and flying disc, in order to maintain a visible level of phosphorescence in both the target loop and flying disc during use.

30. The game set of claim 1, wherein the game set comprises a first and a second goal assembly.

31. The game set of claim 30, wherein a distance verification device on the score controller of the first goal assembly is configured to interact with a distance verification device on the score controller on the second goal assembly to allow activation of the score controllers on the first goal assembly and the second goal assembly when the first goal assembly and second goal assembly are separated by a specific distance.

32. The game set of claim 1, wherein the game set comprises a plurality of goal assemblies configured to be arranged to form a multiple goal assembly course.

33. The game set of claim 32, wherein the multiple goal assembly course is comprised of 9, 18 or 27 goal assemblies, wherein each goal assembly has a permanent goal mount.

34. The game set of claim 32, wherein a device having a game application is configured to interface with each score controller of the plurality of goal assemblies to automatically keep track of a player's score for the multiple goal assembly course.

35. The game set of claim 34, wherein the game application is configured to record the player's scores through the usage of signal-based score sensors on each score controller and a signal-based tag on the flying disc.

36. The game set of claim 34, wherein the plurality of goal assemblies must be used in a particular sequence in order to enable automatic score keeping.

37. The game set of claim 34, wherein the game application is configured to accept payment for use of multiple goal assembly course.

38. The game set of claim 34, wherein the game application is configured to allow a player to schedule a time to use the multiple goal assembly.

39. A game set comprising:

a flying disc and a goal assembly, the goal assembly comprising:

a goal mount having:

a base end;

a goal post connected to the base end;

a plurality of target holders on the goal post, wherein each target holder is a loop hook;

a plurality of target loops, each target loop configured to attach to one of the plurality of target holders, each target loop comprising:

a loop surface having a solid outer portion that surrounds an open middle portion, the open middle portion having at least one distinct opening, wherein each distinct opening within the open middle portion defines a scoring portal;

a docking portion, wherein the docking portion is the solid outer portion of the loop surface and configured to connect to a target holder of the plurality of target holders; and a plurality of score controllers, each score controller configured to attach to the goal assembly, each score controller having:

at least one score sensor configured to detect the passage of the flying disk through each scoring portal;

a vibration sensor, wherein the vibration sensor is configured to detect the target loop being impacted by the flying disc and wherein the score controller is configured to emit an alert when the score sensor or the vibration sensor is triggered.

40. The game set of claim 39, further comprising a plurality of crossbars, each crossbar fitted with a crossbar rod, wherein each crossbar bar rod is configured to secure the crossbar to the goal post through insertion of the crossbar rod in a target port on the goal post and wherein each crossbar has at least one target holder configured to attach to a target loop.

41. The game set of claim 40, wherein a top target loop is attached to a top target port on the goal post, two upper target loops are attached to an upper crossbar, wherein the upper crossbar is attached to an upper target port and wherein each one of the upper target loops is positioned on a different end portion of the upper crossbar, and two lower target loops are attached to a lower crossbar, wherein the lower crossbar is attached to a lower target port and wherein each one of the lower target loops is positioned on a different end portion of the lower crossbar.

42. The game set of claim 40, wherein three crossbars are attached to the goal post, each crossbar rod on each crossbar positioned on one end of the crossbar and inserted within a different target port on the goal post, and each crossbar having a target holder configured to connect to a target loop.

43. A game set comprising:

a propellable object made of a glow in the dark material; and a target loop, the target loop comprising:

a loop surface having a solid outer portion that surrounds an open middle portion, the open middle portion having at least one distinct opening, wherein each distinct opening within the open middle portion defines a scoring portal and a docking portion connected to the solid outer portion of the loop surface; and a game board having: a body portion, a target hole in the body portion and a plurality of target holders on the body portion, said plurality of target holders arranged around a perimeter of the target hole, wherein the plurality of target holders are configured to attach to the docking portion of the target loop such that the solid outer portion of the target loop encompasses the perimeter of the target hole.

44. The game set of claim 43, further comprising a goal mount having: a base end; a goal post connected to the base end and a plurality of target holders on the goal post, each target holder of the plurality of target holders configured to hold a target loop.

45. The game set of claim 43, wherein the propellable object is one of a flying disc, a bean bag, a ball, a football, a golf ball, a soccer ball, a basketball, a tennis ball, a baseball, a ping pong ball, a racquetball, a hockey puck, a ring toss ring, a horseshoe and a bowling ball.

46. The game set of claim 43, the body portion comprising a rectangular board having a lower portion, an upper portion connected to the lower portion by a folding hinge, at least one handle on the rectangular board, a foldable angling leg attached to the rectangular board and a plurality of auxiliary score controller mounting ports on the rectangular board, wherein each target holder of the plurality of target holders is a target loop mounting port and the docking portion of the target loop is a plurality mounting caps, each mounting cap having a target loop cone configured to fit within a different target loop mounting port of a plurality of target loop mounting ports.

47. The game set of claim 46, wherein the game board is configured to be folded into an upright orientation through usage of the folding hinge.

48. The game set of claim 43, further comprising a game board border attached to the rectangular board and positioned around an outer perimeter of the rectangular board.

49. The game set of claim 48, wherein the game board border is made of a glow in the dark material.

50. The game set of claim 46, further comprising a main score controller configured to attach to the target loop and an auxiliary score controller having a plurality of auxiliary score controller mounting cones, each auxiliary score controller mounting cone configured to fit within a different auxiliary score controller mounting port of the plurality of auxiliary score controller mounting ports to attach the auxiliary score controller to the rectangular board.

51. The game set of claim 50, the main score controller comprising at least one score sensor configured to detect the passage of the propellable object through each scoring portal, a viewing camera and a vibration sensor and the auxiliary score controller further comprising a scoreboard, a game clock, a distance verification device, a microphone, a buzzer, a loudspeaker, a tag reader mechanism and a score indicator light.

52. A game set comprising:

a flying disc and a goal assembly, the goal assembly comprising:

a goal mount having:

a base end;

a goal post connected to the base end;

a plurality of target holders on the goal post;

a target loop configured to attach to one of the plurality of target holders, the target loop comprising:

a loop surface having a solid outer portion that surrounds an open middle portion, the open middle portion having at least one distinct opening, wherein each distinct opening within the open middle portion defines a scoring portal;

a docking portion connected to the solid outer portion of the loop surface and configured to connect to one of the plurality of target holders; and a score controller configured to attach to the goal assembly, the score controller having:

at least one score sensor configured to detect the passage of the flying disk through each scoring portal;

a vibration sensor, wherein the vibration sensor is configured to detect the target loop being impacted by the flying disc and wherein the score controller is configured to emit an alert when the score sensor or the vibration sensor is triggered;

wherein the game set comprises a plurality of goal assemblies configured to be arranged to form a multiple goal assembly course; and wherein a device having a game application is configured to interface with each score controller of the plurality of goal assemblies to automatically keep track of a player's score for the multiple goal assembly course.

* * * * *